US006130502A

United States Patent [19]

Kobayashi et al.

[11] Patent Number: 6,130,502

[45] Date of Patent: Oct. 10, 2000

[54] CATHODE ASSEMBLY, ELECTRON GUN ASSEMBLY, ELECTRON TUBE, HEATER, AND METHOD OF MANUFACTURING CATHODE ASSEMBLY AND ELECTRON GUN ASSEMBLY

[75] Inventors: Kazuo Kobayashi, Yokohama; Takashi Sudo, Chigasaki; Toshiharu Higuchi, Yokohama; Hideharu Takahashi; Sakae Kimura, both of Tokyo; Shinpei Koshigoe, Fukaya; Takumi Fujiuchi, Hyogo-ken, all of Japan

[73] Assignee: Kabushiki Kaisha Toshiba, Kawasaki, Japan

[21] Appl. No.: 09/000,334

[22] PCT Filed: May 21, 1997

[86] PCT No.: PCT/JP97/01706

§ 371 Date: Jan. 16, 1998

§ 102(e) Date: Jan. 16, 1998

[87] PCT Pub. No.: WO97/44803

PCT Pub. Date: Nov. 27, 1997

[30] Foreign Application Priority Data

May 21, 1996 [JP] Japan ..... 8-125900
Jun. 11, 1996 [JP] Japan ..... 8-148776

[51] Int. Cl.[7] ..... H01J 29/04; H01J 01/20

[52] U.S. Cl. ..... 313/446; 313/270; 313/337; 313/346 DC

[58] Field of Search ..... 313/412, 414, 313/270, 337, 346 R, 346 DC, 446

[56] References Cited

U.S. PATENT DOCUMENTS

| | | | |
|---|---|---|---|
| 3,432,714 | 3/1969 | Schmidt | 313/270 X |
| 4,151,440 | 4/1979 | Buescher . | |
| 5,015,908 | 5/1991 | Miram et al. . | |
| 5,475,281 | 3/1969 | Heijboer | 313/270 X |

FOREIGN PATENT DOCUMENTS

| | | |
|---|---|---|
| 350 358 | 1/1990 | European Pat. Off. . |
| 408 342 A2 | 7/1990 | European Pat. Off. . |
| 389 228 | 9/1990 | European Pat. Off. . |
| 408 342 A3 | 1/1991 | European Pat. Off. . |
| 632 479 A1 | 6/1994 | European Pat. Off. . |
| 2 664 427 | 1/1992 | France . |
| 1564841 | 5/1970 | Germany . |
| 42-5057 | 3/1967 | Japan . |
| 48-25645 | 3/1973 | Japan . |
| 50-57165 | 5/1975 | Japan . |
| 51-59265 | 5/1976 | Japan . |
| 57-12534 | 3/1982 | Japan . |
| 57-41938 | 9/1982 | Japan . |
| 58-144746 | 9/1983 | Japan . |
| 59-141140 | 8/1984 | Japan . |
| 61-7696 | 3/1986 | Japan . |
| 2-239536 | 9/1990 | Japan . |
| 3-64823 | 3/1991 | Japan . |
| 3-201346 | 9/1991 | Japan . |
| 4-359829 | 12/1992 | Japan . |
| 7-58970 | 3/1995 | Japan . |

OTHER PUBLICATIONS

Kuhnert, et al, "Image processing using light–sensitive chemical waves", Nature, vol. 337, No. 6204, Jan. 1989, pp. 244–247.

*Primary Examiner*—Ashok Patel
*Attorney, Agent, or Firm*—Pillsbury Madison & Sutro LLP

[57] ABSTRACT

A cathode assembly (27) includes a thermally conductive insulating substrate (21) having a pair of opposing surfaces. A cathode base member (24) is formed on one surface of the insulating substrate, and a heating member (25) for heating the cathode base member is formed on the other surface of the insulating substrate. A heater electrode terminal (26) is fixed to the electrode of the heating member through a metal layer (26*a*). A first grid (30) is fixed to the insulating substrate to oppose the cathode base member through a predetermined space.

18 Claims, 35 Drawing Sheets

CATHODE ASSEMBLY, ELECTRON GUN ASSEMBLY, ELECTRON TUBE, HEATER, AND METHOD OF MANUFACTURING CATHODE ASSEMBLY AND ELECTRON GUN ASSEMBLY

TECHNICAL FIELD

The present invention relates to a cathode assembly, an electron gun assembly, an electron tube, and a heater which are used for the electron guns of a color cathode ray tube, and a method of manufacturing the cathode assembly.

BACKGROUND ART

Recently, downsizing has been required for display units used for computers. With the widespread use of personal computers, in particular, a great deal of attention has been paid to flat displays, mainly liquid crystal displays. However, no flat display units have been developed, which can cope with electron tubes such as cathode ray tubes in terms of size, resolution, and cost. For this reason, electron tubes such as cathode ray tubes are in urgent need of reducing their total lengths and weights.

Similar needs are increasing with respect to traveling wave tubes designed to be mounted in satellites. With such needs, demands have arisen for compact, low-profile, light-weight electron guns including cathode assemblies as tube parts.

High-speed operations are often required for high-output traveling wave tubes. A general tube uses a hot cathode assembly as an electron source, and hence the temperature rise time in the cathode assembly dominates the time required for the stable operation of the tube. That is, quick heating of the cathode assembly is required for the quick operation of the tube.

Attempts have been made to develop low-profile, light-weight display units using electron tubes. For example, as disclosed in Jpn. Pat. Appln. KOKAI Publication No. 7-58970, a low-profile display unit using an electron tube in which a plurality of electron guns are arranged has been proposed.

A short, low-power-consumption, fast electron gun is required as each electron gun mounted in the electron tube of such a display unit to reduce the profile and weight of the display unit and improve its performance.

A conventional electron tube will be described below with reference to FIG. 67. FIG. 67 is a sectional view showing portions around the cathode assembly in the electron gun assembly used in the conventional electron tube.

The cathode assembly includes a cathode sleeve 1 consisting of an alloy such as nichrome. A base metal layer 2 consisting of nickel doped with a small amount of reducing material is fixed to one end of the cathode sleeve 1. The surface of the base metal layer 2 is coated with an emissive material 3 consisting of barium oxide (BaO), strontium oxide (SrO), calcium oxide (CaO), or the like. A cathode base member 4 is constituted by the base metal layer 2 and the emissive material 3. As the cathode base member 4, in addition to the above structure, a so-called impregnated cathode base member obtained by impregnating a porous cathode base member with an emissive material such as barium oxide (BaO), strontium oxide (SrO), or aluminum oxide ($Al_2O_3$) is used.

The cathode sleeve 1 is fixed to a cathode holder 6 consisting of Kovar (Fe—Ni—Co-based alloy) through a strap 5 consisting of invar (Fe—Ni-based alloy) as a low-thermal-expansion alloy. The cathode holder 6 =-surrounds the cathode sleeve 1 through a reflector 7 consisting of an Ni-based refractory alloy material for blocking/reflecting heat from the cathode sleeve 1. The cathode holder 6 is fixed to a cathode support strap 9 consisting of a stainless-steel-based alloy through a cathode support cylinder 8 consisting of a stainless-steel-based alloy.

A heater 10 for heating the cathode is mounted in the cathode sleeve 1. The heater 10 is obtained by helically winding an Re—W alloy wire, and coating its surface with aluminum oxide ($Al_2O_3$) as an insulating material. The heater 10 is an elongated member extending along the longitudinal direction of the electron gun. The heater 10 is inserted into the cathode sleeve 1 through the other end thereof such that the end portions of the heater protrude from the cathode sleeve 1. The end portions of the heater 10 are fixed to a heater tab strap 12 consisting of a stainless-steel-based alloy through a heater tab 11 consisting of a stainless-steel-based alloy. The cathode assembly is constituted by the cathode base member 4 and the above parts.

A first grid 13 consisting of a stainless-steel-based alloy and serving to control an electron flow is placed to oppose the cathode base member 4. The cathode assembly, the first grid 13, and the like constitute an electron gun assembly 15. A bead glass 14 surrounds this electron gun assembly 15. The cathode support strap 9, the heater tab strap 12, and the first grid 13 are fixed to the bead glass 14.

As the cathode base member, a member using an impregnated cathode obtained by impregnating a base metal layer with an emissive material is provided instead of a member using the above oxide-coated cathode. A thin iridium layer may be formed on the electron emission surface of the cathode base member.

For example, the following dimensions are set for the electron gun assembly having the above structure. The cathode sleeve 1 is 4 mm long. The base metal layer 2 is 1.1 mm long. The length from the surface of the emissive material 3 to the lower end of the cathode holder 6 is 9.0 mm. The distance from the upper end of the first grid 13 to the surface of the emissive material 3 is 0.5 mm. The distance from the lower end of the cathode holder 6 to the lower end of the heater tab 11 is 5 mm. The total length of the conventional electron gun assembly is therefore 14.5 mm.

In the general cathode assembly, as the heater 10, a refractory metal wire coiled into a cylindrical shape, a helical shape, or the like is used. For example, a tungsten wire having a diameter of about 50 $\mu$m is used as the heater of a cathode assembly for a cathode ray tube. Such a wire needs to have a length of about 100 to 130 mm to heat the cathode to the rated temperature. When this wire is formed into a heater with insulation being maintained, the heater has a diameter of about 1.0 mm and a total length of about 7 mm. This length is 90% or more of the total length of the cathode assembly. That is, the heater must be reduced in size and profile to reduce the size and profile of the cathode. However, the existing heaters used in the conventional cathode assemblies have reached their limits in terms of dimensions.

In the above cathode assembly, the cathode base member 4 is the so-called oxide cathode, whose operating temperature is 830° C. The heater power required to raise the cathode temperature to this operating temperature is 0.35 W. In addition, it takes 10 seconds for the cathode assembly to stabilize displayed images after the power is turned on.

The fast operation characteristics, i.e., fast heating, of the cathode assembly are dominated by heat conduction from the heater to the cathode base member. It is ideal that heat from the heater be directly transmitted to only the cathode assembly.

The cathode base member in the cathode assembly is heated through two heat transmission routes. One route is the route through which the cathode is directly heated by radiant heat from the heater. The other route is the route through which the cathode base member is heated by heat diffusion in the assembly which is caused when the support cylinder is heated by radiant heat from the heater. The time required to set the cathode base member in a stable, high-temperature state is dominated by heat conduction through the latter route. This causes a decrease in temperature rise rate.

In the cathode assembly having the above structure, however, heat conduction to the sleeve cannot be prevented. As a method of quickly heating the cathode, a method of decreasing the mass of the cathode base member or the sleeve is used. In this case, however, problems are posed in terms of thermal distortion of the cathode itself; limitations are imposed on the application of this method. In an existing traveling wave tube, it takes three minutes or more for the cathode base member to reach a brightness temperature of 900 to 1,050° C.b and stabilize the tube operation after the heater power is turned on.

The following problems are posed when such a conventional electron tube is used for a low-profile display unit.

The total length of the electron gun assembly is too long. An electron tube used for a low-profile display unit is required to have a total length of 130 mm or less. The length from the first grid to the lower end of the heater tab in the conventional electron gun assembly, i.e., 14.5 mm, is too long to meet this requirement.

A plurality of electron gun assemblies are used for the electron tube used for the above low-profile display unit. For example, 24 electron gun assemblies are used for a 40-inch tube. For the overall electron tube, total heater power corresponding to the heater power required for one electron gun assembly (cathode assembly)×the number of electron gun assemblies is required. For this reason, the total heater power required for the overall electron tube must be minimized.

The heater power required for the cathode assembly in the conventional electron gun assembly is not sufficiently low. If a plurality of conventional electron gun assemblies are used, the total heater power required for the overall electron tube becomes high. If, for example, conventional electron gun assemblies are used, the total heater power becomes 0.35 W×24 (assemblies)=8.4 W, posing a problem in terms of power saving in the electron tube.

In addition, in an electron tube having a plurality of electron gun assemblies, if the fast operation characteristics of the cathode assemblies of the respective electron gun assemblies vary, the overall image displayed on the display unit after the power is turned on is disturbed. In order to prevent this image disturbance, therefore, the fast operation characteristics of each electron gun assembly must be improved.

In a conventional electron gun assembly, however, it takes 10 seconds to obtain a stable image. This rise time is too long to regard the fast operation characteristics as good characteristics.

As described above, according to the cathode assembly in the conventional electron tube, it is difficult to attain the decreases in size and power consumption, and the fast operation characteristics. Demands have therefore arisen for a cathode assembly having a new structure. A cathode assembly which can solve such a problem is disclosed in U.S. Pat. No. 5,015,908.

The heater unit used in the cathode assembly disclosed in this reference is obtained by forming a heating member having an anisotropic pyrolytic graphite (APG) heater pattern on a substrate consisting of anisotropic pyrolytic boron nitride (APBN). This unit is very thin; about 1 mm thick. In addition, the heater unit allows the lower surface of an insulating substrate to be directly connected to the cathode assembly. That is, the fast operation characteristics can be attained with decreases in size, profile, and thermal capacity.

The above cathode assembly is suitable for an electron tube having a large structure such as a crystron or a traveling wave tube. However, no special consideration is given to a compact, low-power-consumption electron tube which is mass-produced, e.g., a cathode ray tube.

In the conventional cathode assembly, there is a large difference in thermal expansion coefficient between the cathode assembly and the heater or the heater substrate, resulting in poor joining properties. For this reason, the cathode assembly is joined to the insulating substrate through a thin tungsten layer and tungsten and nickel powders by sintering, resulting in a very complicated manufacturing process. Problems are therefore posed in the conventional cathode assembly in terms of mass production and manufacturing cost.

That is, the heater unit and the heating member are fixed by coating the outermost surface of the insulating substrate with tungsten, inserting nickel and tungsten powders between the outermost surface, the cathode lower surface, and the sleeve, and sintering the resultant structure at 1,300° C. When these members are joined by sintering, however, the joining strength is very low. During the operation of the cathode assembly, therefore, the joined members may peel off. In addition, as sintering progresses with the operation of the cathode assembly, the heater characteristics very likely change.

A problem is also left unsolved in forming an electrode from the heater unit. The electrode of the heater is mechanically joined to the heating member by a mechanical joint by screwing or pressing. For this reason, a connection failure may be caused by thermal expansion upon heating. In addition, in a compact cathode base member having a diameter of about 1 mm, e.g., a cathode base member used in a cathode ray tube, the heater power increases owing to the thermal capacity of the screwed portion.

In a color cathode ray tube, three cathode assemblies are used per electron gun assembly, and the cathode assemblies are fixed while the spaces between the first grid and the respective cathode assemblies are measured by an air micrometer or the like to make the distances constant. In this case, if the positions where the cathode assemblies are fixed vary, electrons emitted from the respective electron gun assemblies vary when the switch of the cathode ray tube is turned on (the power switch of the electron tube is turned on), resulting in imperfect color reproduction. Therefore, the spaces between the first grid and the cathode assemblies must be set with high precision.

DISCLOSURE OF INVENTION

The present invention has been made in consideration of the above situation, and has as its object to provide a cathode assembly which can attain the decreases in size and power consumption, and the fast operation characteristics, and an electron gun assembly and electron tube having the same.

It is another object of the present invention to provide an electron gun assembly which can attain the decreases in total length and power consumption, the fast operation characteristics, and high precision in the space between the first grid and each cathode assembly.

It is still another object of the present invention to provide a heater which allows a heating member and an electrode terminal to be easily and firmly connected to each other.

It is still another object of the present invention to provide a cathode assembly manufacturing method capable of easily manufacturing a cathode assembly which can attain the decreases in size and power consumption, and the fast operation characteristics.

In order to achieve the above objects, according to the present invention, there is provided a cathode assembly comprising a thermally conductive insulating substrate having a pair of opposing surfaces, a cathode base member provided on one surface of the insulating substrate, a heating member provided on the other surface of the insulating substrate to heat the cathode base member, and an electrode terminal joined to the heating member through a conductive layer formed on the heating member.

According to this arrangement of the present invention, the length of the heater constituted by the insulating substrate and the heating member can be greatly reduced as compared with that in the prior art. In addition, the heater power can be reduced, and the fast operation characteristics can be improved. Furthermore, the electrode terminal can be firmly fixed.

In addition, according to the present invention, if a grid is provided to oppose the cathode base member and joined to the insulating substrate, an electron gun assembly which can attain the decreases in size and power consumption, and the fast operation characteristics can be obtained.

According to the present invention, there is provided an electron gun assembly comprising a thermally conductive insulating substrate having a pair of opposing surfaces, a cathode base member provided on one surface of the insulating substrate, a heating member provided on the other surface of the insulating substrate to heat the cathode base member, and first and second grids opposing the cathode base member. The first and second grids are stacked on each other through a spacer consisting of an electric insulating material to constitute a grid unit. The first grid of the grid unit is fixed to the insulating substrate.

According to this arrangement of the present invention, there is provided an electron gun assembly which attains a great decrease in total length, a decrease in heater power, fast operation characteristics, and high precision in the space between the first grid and each cathode assembly.

The heater of the present invention comprises an insulating substrate consisting of boron nitride, a heating member consisting of a graphite and provided on the insulating substrate, and an electrode terminal joined to the heating member through a conductive layer. With this structure, the heating member can be easily and firmly connected to the electrode extraction member, and a heater especially suitable for a cathode assembly can be obtained.

According to the present invention, the cathode assembly and the grid unit are joined to each other through the spacer, and the cathode assembly is positioned by the spacer. With this structure, there are provided an electron gun assembly and an electron tube which can attain a low-profile structure, low power consumption, fast operation characteristics, high precision in the distance between each cathode assembly and the grid, and an increase in joining strength.

In addition, according to the present invention, an electron gun assembly having cathode assemblies, each attains the decreases in size and power consumption, and the fast operation characteristics, is formed by arranging the cathode assemblies, each having the above structure, side by side, thereby obtaining an electron tube suitable for a color cathode ray tube and an electron tube suitable for a low-profile display unit.

Furthermore, according to the present invention, there is provided a cathode assembly manufacturing method comprising the steps of forming an anisotropic pyrolytic graphite layer on one surface of a thermally conductive insulating substrate, forming a heating member having a predetermined pattern by patterning the anisotropic pyrolytic graphite layer, joining a cathode base member on the other surface of the insulating substrate through a conductive layer, fixing an electrode terminal to an electrode of the heating member through a conductive layer.

Moreover, according to the present invention, there is provided a cathode assembly manufacturing method comprising the steps of forming an insulating substrate having a predetermined thickness by using anisotropic pyrolytic boron nitride, forming an anisotropic pyrolytic graphite layer on one surface of a thermally conductive insulating substrate, forming a plurality of heating members, each having a predetermined pattern, by patterning the anisotropic pyrolytic graphite layer, joining a plurality of cathode base members on the other surface of the insulating substrate through a conductive layer, forming a plurality of cathode assemblies by dividing an insulating substrate on which the heating members and the cathode base members are formed, and fixing an electrode terminal to an electrode of the heating member of each of the cathode assemblies through a conductive layer.

BEST MODE OF CARRYING OUT THE INVENTION

An electron tube according to the first embodiment of the present invention will be described below with reference to the accompanying drawing.

Figure 1:
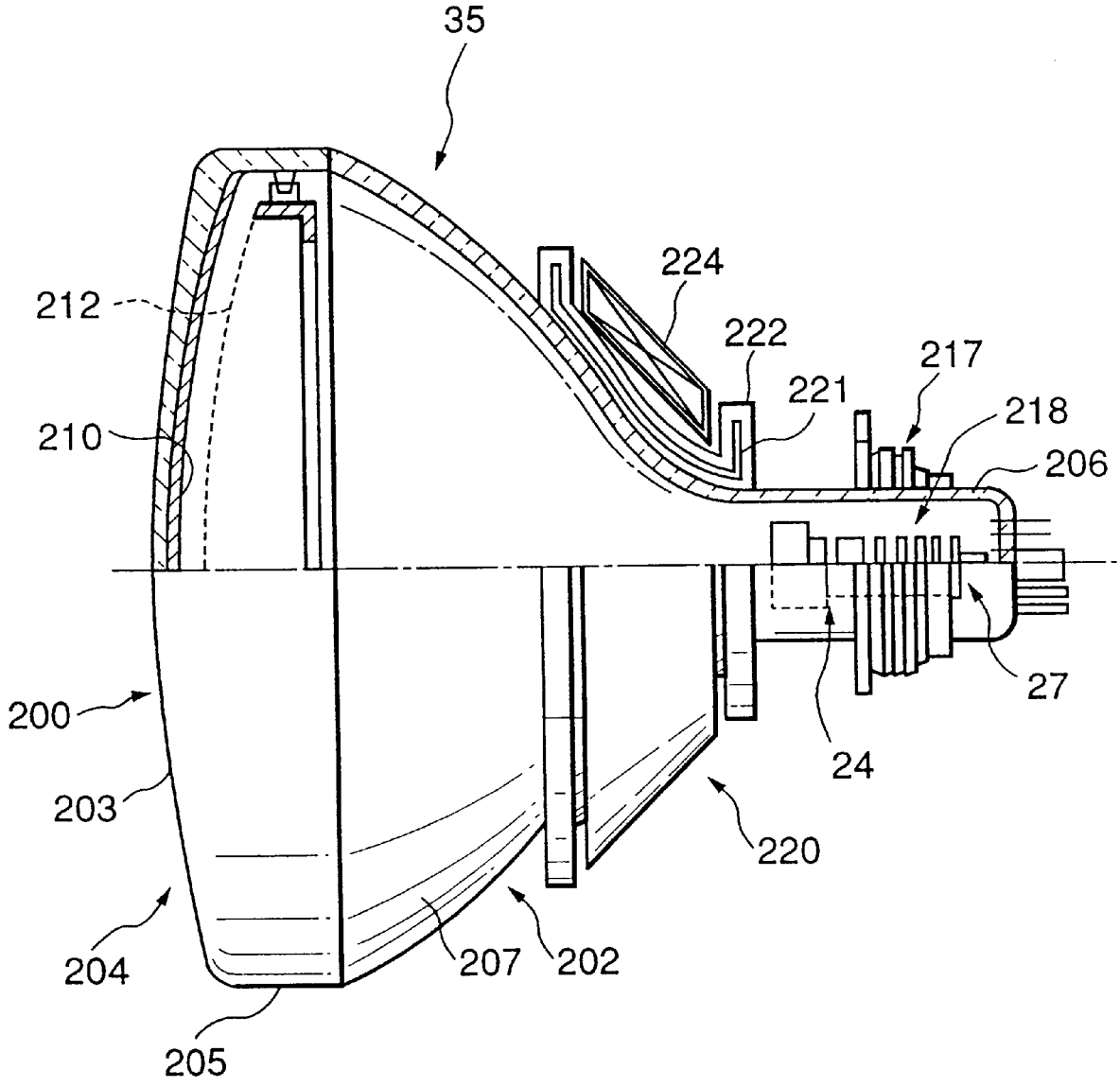
FIG. 1 is a partially cutaway side view of an electron tube according to a first embodiment of the present invention.

As shown in FIG. 1, an electron tube 35 includes a vacuum envelope 204 having a face panel 200 formed of glass and a funnel 202 joined to the face panel 200. The face panel 200 has a substantially rectangular effective portion 203 and a skirt portion 205 extends upright from the periphery of the effective portion 203. The funnel 202 has a cylindrical neck 206 at one end portion thereof, and a substantially rectangular, large-diameter cone portion 207 at the other end portion. The cone portion 207 corresponds to the outer shape of the skirt portion 205 of the face panel 200. The funnel 202 has a funnel-like shape as a whole. The cone portion 207 is joined to the face panel 200.

A phosphor screen 210 having of phosphor layers of three colors which emit blue, green, and red light beams is formed on the inner surface of the effective portion 203 of the face panel 200. A substantially rectangular shadow mask 212 is arranged in the vacuum envelope 204 to oppose the phosphor screen 210. An electron gun 214 is arranged in the neck 206 of the funnel 202.

As will be described later, the electron gun 214 comprises a cathode assembly 27 for emitting an electron beam, a plurality of grids 218 for controlling, focusing, and accelerating the emitted electron beam, and the like. A convergence magnet 217 for converging the electron beam is mounted on the outer surface of the neck 206.

A deflection yoke 220 is mounted around the portion near the boundary portion between the neck 206 and the cone portion 207 of the funnel 202. The deflection yoke 220 comprises a trumpet-shaped separator 221 formed of a synthetic resin, a pair of saddle-shaped horizontal deflection coils 222 arranged on the inner surface side of the separator 221 to be vertically symmetrical, and a pair of toroidal vertical deflection coils 224 arranged on the outer surface side of the separator 221 to be vertically symmetrical.

The electron beam emitted from the electron gun 214 is deflected in the horizontal and vertical directions by the electric field generated by the deflection yoke 220, and undergoes color selection by the shadow mask 212. The electron beam is then incident on the phosphor screen 210 to display a desired image.

The electron gun 214 for emitting an electron beam will be described in detail next. As shown in FIGS. 2 to 5, the cathode assembly 27 as part of the electron gun 214 comprises a substantially rectangular insulating substrate 21 having a pair of opposing surfaces, a cathode base member 24 provided on one surface of the insulating substrate 21, and a heating member 25 provided on the other surface of the insulating substrate 21.

The insulating substrate 21 is formed of a thermally conductive material, e.g., anisotropic pyrolytic boron nitride (to be referred to as APBN hereinafter). The insulating substrate 21 has a length of 4 mm, a width of 1.2 mm, and a thickness of 0.25 mm. A circular base metal layer 22 is formed on the central portion of one surface of the insulating substrate 21 (the upper surface in FIGS. 2 to 5). The base metal layer 22 consists of nickel (Ni) doped with magnesium (Mg) and silicon (Si), which are reducing metals, in small amounts. The base metal layer 22 has a thickness of 0.05 mm and a diameter of 0.9 mm. The base metal layer 22 integrally has an electrode terminal 22*a* for applying a voltage to the cathode. The electrode terminal 22*a* extends from the periphery of the base metal layer 22 and crossing the other surface of the insulating substrate 21. The electrode terminal 22*a* is connected to a cathode strap 33.

The base metal layer 22 is joined on the insulating substrate 21 through a metal layer 22*b* formed of titanium and serving as a conductive layer. The electrode terminal 22*a* may extend from the metal layer 22*b*.

The surface of the base metal layer 22 is coated with an electron emissive material 23 in the form of a circle. As the electron emissive material 23, barium oxide (BaO), strontium oxide (SrO), calcium oxide (MgO), or the like is used. The coating portion of the emissive material 23 has a diameter of 0.75 mm and a thickness of 0.05 mm. The cathode base member 24 of a so-called oxide cathode type is constituted by the base metal layer 22 and the emissive material 23.

Figure 4:
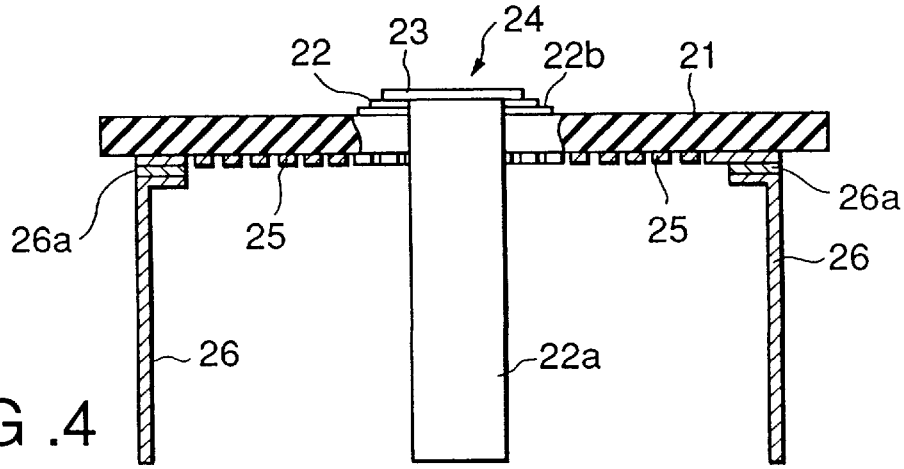
FIG. 4 is a sectional view taken along a line IV—IV in FIG. 3.
Figure 5:
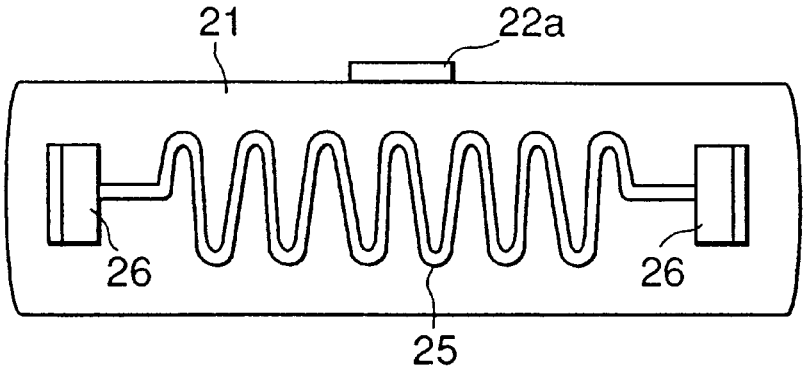
FIG. 5 is a plan view of the heating member formation portion of the cathode assembly.

As shown in FIGS. 4 and 5, the heating member 25 is formed on the other surface of the insulating substrate 21. The heating member 25, which constitutes a heater, together with the insulating substrate 21, has a zigzag pattern extending in the longitudinal direction of the insulating substrate 21, and consists of anisotropic pyrolytic graphite (to be referred to as APG hereinafter). Metal layers 26*a* consisting of titanium (Ti) and serving as conductive layers are formed on the surfaces of the two longitudinal end portions of the heating member 25. A pair of heater electrode terminals 26 are joined on these metal layers 26*a* and extend perpendicular to the insulating substrate 21. Each heater electrode terminal 26 is made of nickel (Ni) in the form of an elongated plate, and attached to a bead glass 29 through a heater strap 28 consisting of stainless steel.

Figure 2:
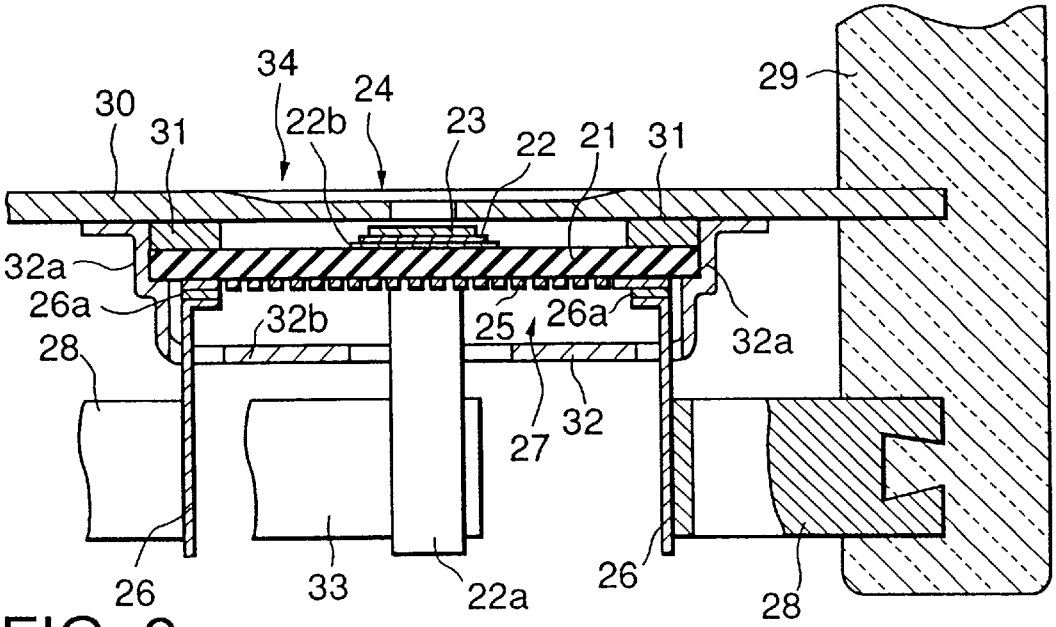
FIG. 2 is a sectional view of an electron gun assembly mounted in the electron tube.
Figure 3:
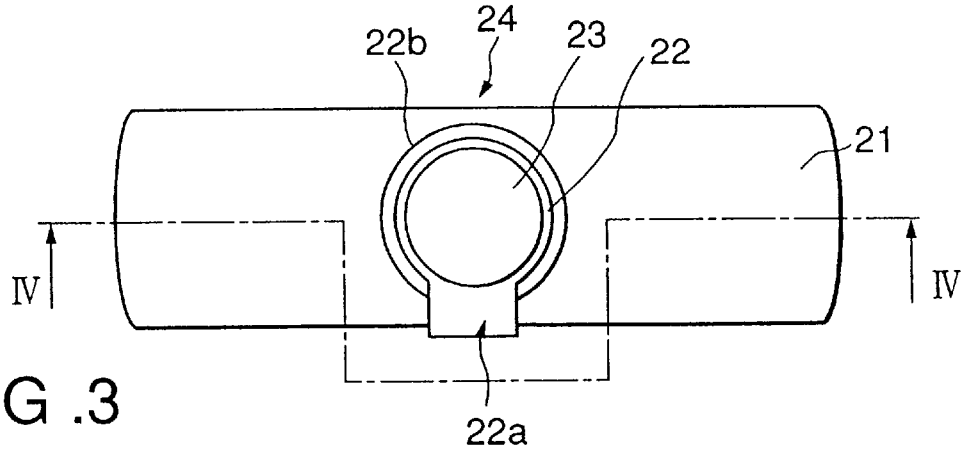
FIG. 3 is a plan view of a cathode assembly as part of the electron gun assembly.

The insulating substrate 21, the cathode base member 24, the heating member 25, and the heater electrode terminals 26 constitute the cathode assembly 27. As shown in FIG. 2, this cathode assembly 27 is designed such that the distance from the surface of the electron emissive material 23 to the distal end of the heater electrode terminal 26 is 2.0 mm. That is, the cathode assembly 27 is much shorter than the conventional cathode assembly 27.

As shown in FIG. 2, a first grid 30 of the electron gun is placed to oppose the cathode base member 24 of the cathode assembly 27. The first grid 30 consisting of stainless steel is placed to be parallel to the surface of the insulating substrate 21 on the cathode base member side. The two end portions of the first grid 30 are fixed to the bead glass 29 (only part of it is shown).

A spacer 31 formed of alumina is clamped between the first grid 30 and the two end portions of the insulating substrate 21 on the cathode base member side to hold the distance between the first grid 30 and the emissive material 23 to a desired value. A cap-like retainer 32 formed of stainless steel is fixed to the first grid 30 to cover the cathode assembly 27. A side wall 32*a* of the retainer 32 clamps the insulating substrate 21 and the spacer 31, together with the first grid 30, to couple the cathode assembly 27 to the first grid 30. A bottom wall 32*b* of the retainer 32 is parallel and opposite to the surface of the insulating substrate 21 on the heating member side through a space portion. The retainer 32 has the function of fixing the cathode assembly 27 to the first grid 30 and the function of reflecting heat from the heating member 25 toward the cathode assembly 27.

By adding the first grid 30 and the retainer 32 to the cathode assembly 27, an electron gun assembly 34 as part of the electron gun 214 is formed. If the thickness of the first grid 30 is 0.5 mm, the total length of the electron gun assembly 34 is the sum, i.e., 2.5 mm, of the length of the cathode assembly 27, which is 2.0 mm, and the thickness of the first grid 30, which is 0.5 mm. The electron gun assembly 34 is housed in the neck 206 of the funnel 202, together with the cylindrical bead glass 29 and the remaining components of the electron gun 214.

A method of manufacturing the electron tube having the above structure, and more specifically, the cathode assembly 27 will be described next. First of all, the 0.25-mm thick insulating substrate 21 consisting of APBN is manufactured by, for example, the chemical vapor deposition method (CVD method).

The heating member 25 is then formed on one surface of the insulating substrate 21. In this case, after an aluminum (Al) layer is formed on the surface of the insulating substrate 21 by the vacuum deposition method, the Al layer is coated with a resist. The resist is then exposed, developed, and etched to form a reverse pattern to that of the heating member 25. A portion of the Al layer which corresponds to the heating member pattern is removed by etching, and the heating member 25 consisting of APG is formed on the resultant portion (the heating member pattern portion) by the CVD method. Thereafter, the remaining portions of the Al layer are removed by etching. With the above steps, the heating member 25 having a predetermined pattern is formed on the surface of the insulating substrate 21.

A portion of the surface of the insulating substrate 21 to which the base metal layer 22 is joined, and portions of the heating member 25 to which the heater electrode terminals 26 are joined, i.e., the surfaces of the two end portions of the heating member 25, are coated with a titanium (Ti) powder. Thereafter, the insulating substrate 21 is treated at a high temperature to form the metal layers 22*b* and 26*a* consisting of titanium. Subsequently, the base metal layer 22 is fixed on the metal layer 22*b* on the insulating substrate 21, and the heater electrode terminals 26 are fixed on the metal layer 26*a* by a laser welding method. The surface of the base metal layer 22 fixed on the insulating substrate 21 is coated with the emissive material 23 by a spraying method or the like, thus forming the cathode base member 24. With the above steps, the cathode assembly 27 is manufactured.

The above method of manufacturing the cathode assembly 27 uses one insulating substrate 21 for one cathode base member 24. In order to improve the productivity and achieve a reduction in cost, a so-called multi-cathode substrate division method can be used, in which a plurality of combinations of heating member patterns and Ti metal layers are formed on a large insulating substrate, and the substrate is divided into a plurality of insulating substrates.

A method of assembling the electron gun assembly 34 will be described next. First of all, the spacer 31 is mounted on the surface of the insulating substrate 21. The retainer 32 is then mounted on the cathode assembly 27, and the two end portions of the side wall 32*a* of the retainer 32 are welded and fixed to the first grid 30. The first grid 30 and the heater strap 28 are embedded into the bead glass 29 set in a semi-fused state by a burner. Thereafter, each heater electrode terminal 26 is welded to the heater strap 28. Similarly, the electrode terminal 22*a* of the base metal layer 22 is connected/fixed to the retainer 32 by welding. In this manner, the electron gun assembly 34 and the electron tube 35 are manufactured.

According to the electron tube 35 having the above structure, the cathode assembly 27 comprises the thermally conductive insulating substrate 21 having a pair of opposing surfaces, the cathode base member 24 placed on one surface of the insulating substrate 21, and the heating member 25 placed on the other surface of the insulating substrate 21 to heat the cathode base member 24. With this structure, the heater constituted by the insulating substrate 21 and the heating member 25 is greatly decreased in length as compared with that in the prior art, thus greatly decreasing the total length of the cathode assembly 27.

Furthermore, with the use of this cathode assembly 27, the total length of the electron gun assembly 34, which was 2.5 mm, was decreased to 17% of that of the conventional electron gun assembly, which was 14.5 mm, thereby realizing great reductions in size and profile.

In addition, with the use of the cathode assembly 27 having the above structure, the power consumed by the cathode assembly can be reduced. When the cathode assembly 27 according to this embodiment and the conventional cathode assembly are respectively mounted in electron guns, the heater powers required to raise the respective cathode temperatures to 830° were compared with each other. As a result, it was found that 0.35 W was required in the conventional cathode assembly, whereas 0.15 W was required in the cathode assembly 27 according to this embodiment. That is, according to the cathode assembly 27, the power consumption can be reduced to about 43% of that in the prior art.

Moreover, the use of the cathode assembly 27 having the above structure can improve the fast operation characteristics of the cathode assembly. The cathode assembly 27 and the conventional cathode assembly were respectively mounted in electron guns, and the time intervals between the instant at which the heaters were turned on and the instant at which the cathode temperatures reached a stable temperature (830° C.) at which the displayed images are stabilized were compared with each other. As a result, it was found that 10 seconds were required to reach the stable temperature in the conventional cathode assembly, whereas two seconds were required in the cathode assembly 27 according to this embodiment.

That is, in the conventional cathode assembly, the heat generated by the heater is mainly transmitted to the cathode sleeve and the base metal layer in the form of radiation. Thereafter, the cathode temperature rises depending on the thermal capacities of the cathode sleeve and the base metal layer. In contrast to this, in the cathode assembly 27 according to this embodiment, the heat from the heating member 25 is transmitted through the insulating substrate 21 consisting of APBN in the form of thermal conduction. The insulating substrate 21 consisting of APBN has a high thermal conductivity and can efficiently heat the cathode base member 24. For this reason, the fast operation characteristics as short as two seconds can be attained.

The cathode assembly 27 according to this embodiment has the following effect. The heater voltage and current in the conventional cathode assembly are 6.3V and 56 mA, respectively. In contrast to this, the heater voltage and current in the cathode assembly 27 are 3V and 5 mA, respectively. Although the absolute values of the above voltages and currents differ from each other, the voltages and currents in both the cathode assemblies comply with those in the heater circuit of a cathode ray tube. A problem is posed when the heater voltage of the cathode ray tube becomes 0.5V or lower. At such a low voltage, the resistance of a wire used in the heater circuit cannot be neglected, making it difficult to set a proper heater voltage.

As an assembly similar to the cathode assembly 27, a cathode assembly coated with a thin tungsten film by the sputtering method may be considered. In this cathode assembly, however, the heater voltage is as low as about 0.2V. Therefore, this technique has not been put into practical use. The reason why a high heater voltage can be attained by using the cathode assembly 27 according to this embodiment is that APG as the heating member material has a high resistivity.

It is known that the service life of the conventional cathode assembly used in a cathode ray tube or the like is several ten thousand hours or more. The stability of the cathode assembly 27 during operation was checked by conducting a forced life test with the electron gun 214 having the cathode assembly 27 being mounted in a tube under test. The life test was performed for 3,000 hours at 135% heater voltage. For comparison, a life test was also conducted on the conventional cathode assembly and a cathode assembly coated with a thin tungsten film by the sputtering method. In measurement, the initial heater voltage was fixed, and changes in heater current during each life test were monitored. The rates of change after a lapse of 3,000 hours were 20% in the conventional and 1.8% in the cathode assembly 27, respectively. In the cathode assembly coated with the thin tungsten film, heater disconnection occurred after a lapse of 500 hours in the life test. It can be estimated on the basis of this result that the cathode assembly 27 according to this embodiment has almost the same life characteristics as those of the conventional cathode assembly.

According to the electron tube of the first embodiment of the present invention, the cathode base member 24 is fixed to the insulating substrate 21 through the metal layer 22*b* serving as a conductive layer, and the heater electrode terminals 26 are directly fixed to the end portions of the heating member 25 through the metal layers 26*a*. With this structure, the cathode base member 24 and the heater electrode terminals 26 can be reliably fixed to the insulating substrate 21 and the heating member 25. As a material for these metal layers, one type of metal selected from Mo, W, Nb, Ta, and alloys containing these metals, other than Ti which is used in this embodiment, can be used.

Note that the conductive layer may be a reaction layer formed by a reaction between APG and a metal powder when the metal powder applied to the heating member 25 consisting of APG is heat-treated. As a method of forming the metal layer, one of various thick film forming methods, e.g., a method of forming a thick film by forming a powder coat and heating it at a high temperature as in this embodiment or one of various thin film forming methods, e.g., the deposition method and the sputtering method can be used.

According to the cathode assembly 27 having the above structure, since the insulating substrate 21 consists of boron nitride, and the heating member 25 consists of graphite, a heater constituted by a high-productivity, high-quality insulating substrate and heating member can be obtained.

According to the cathode base member 24 of the cathode assembly 27, the oxide cathode is obtained by forming the base metal layer 22 on the surface of the insulating substrate 21 and coating the surface of the base metal layer 22 with the emissive material 23. The cathode base member 24 of the oxide cathode can be effectively used for the cathode assembly 27.

According to the cathode assembly 27, the retainer 32 as a reflector for reflecting the heat generated by the heating member 25 is placed to oppose the insulating substrate 21 through the space portion. With this structure, the radiant heat generated by the heating member 25 can be effectively used to heat the cathode base member 24 by reflecting the heat toward the insulating substrate 21 while the length of the heater constituted by the insulating substrate 21 and the heating member 25 is decreased. As a result, the heater power can be reduced.

Since the electron gun assembly 34 according to this embodiment is constituted by a combination of the above cathode assembly 27 and the grid 30 placed to oppose the cathode base member 24 of the cathode assembly 27, a compact, low-power-consumption, and fast electron gun assembly can be obtained, and a decrease in the overall size of the electron gun 214, a decrease in power consumption, and fast operation characteristics can be attained. Similarly, by forming the electron gun 214 and the electron tube 35 using the above electron gun assembly 34, the length of the neck 206 of the funnel 202 can be greatly decreased as compared with the prior art, thereby obtaining an electron tube suitable for a low-profile display apparatus.

Figure 6:
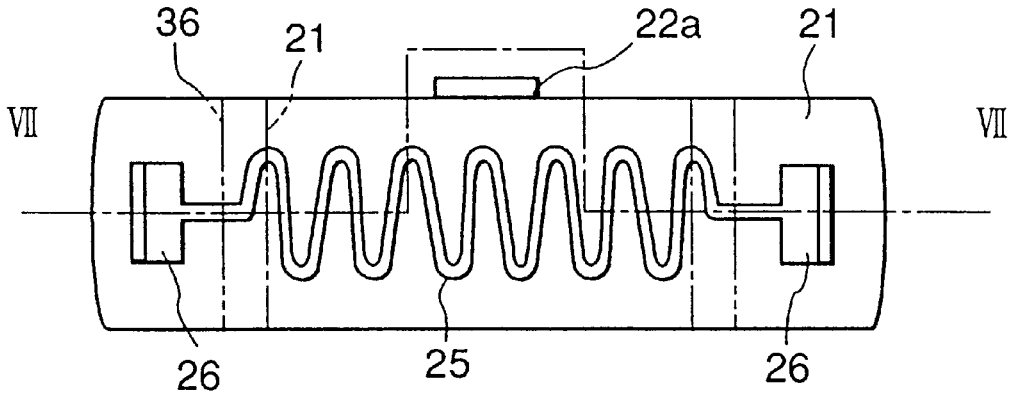
FIG. 6 is a plan view of the heating member formation portion of a cathode assembly according to a second embodiment of the present invention.
Figure 7:
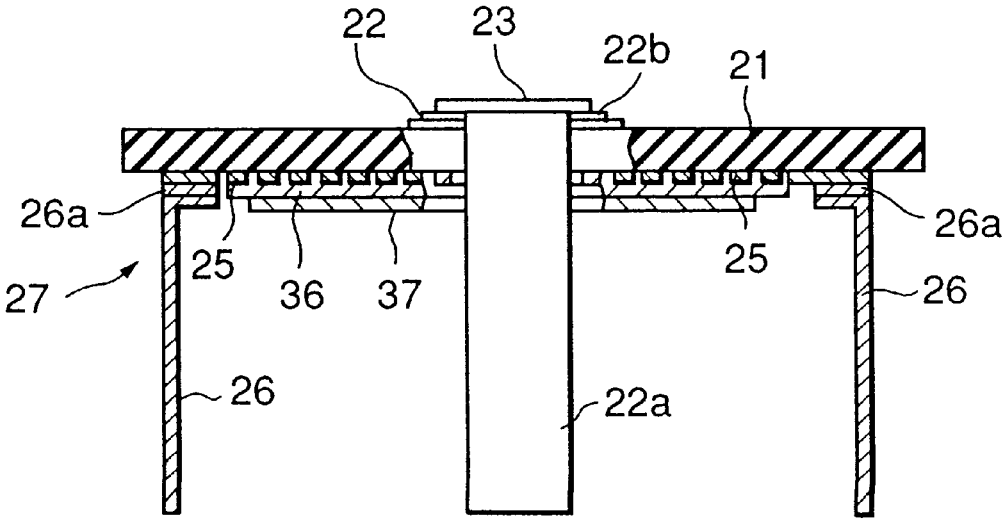
FIG. 7 is a sectional view taken along a line VII—VII in FIG. 6.
Figure 8:
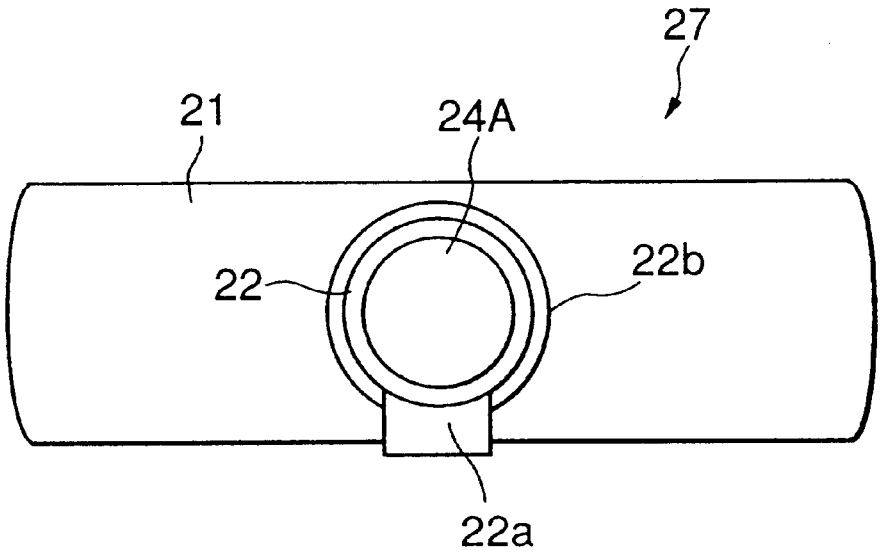
FIG. 8 is a plan view of an example of the cathode base member formation portion of a cathode assembly using an impregnated cathode base member.
Figure 9:
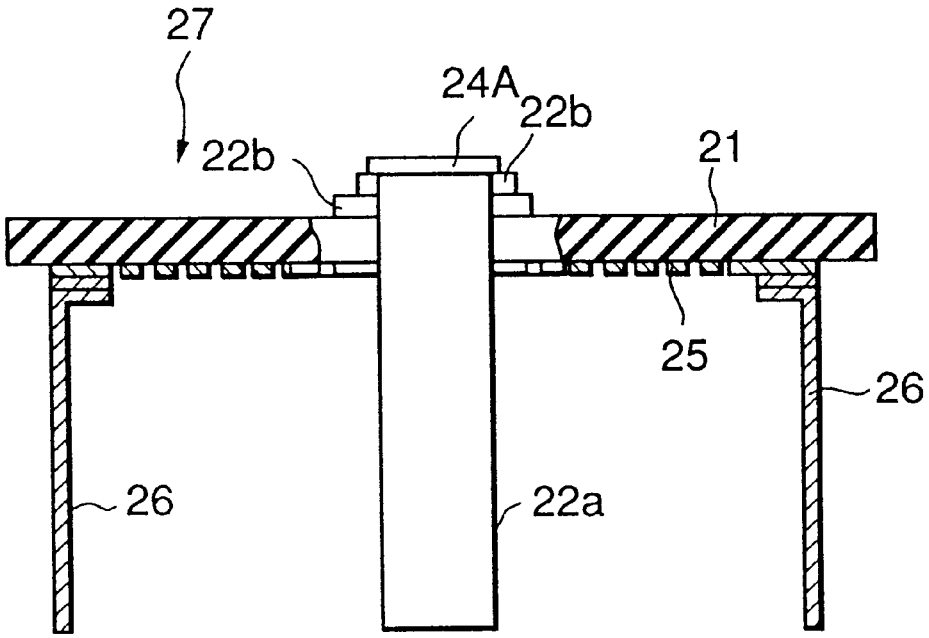
FIG. 9 is a sectional view of an example of the cathode assembly using an impregnated cathode base member.

FIGS. 6 and 7 show a cathode assembly 27 of an electron tube according to the second embodiment of the present invention. This cathode assembly 27 has the same structure as that of the cathode assembly 27 according to the first embodiment except for an electric insulating layer 36 and a reflecting layer 37. The same reference numerals in this embodiment denote the same parts as in the first embodiment, and a detailed description thereof will be omitted.

The electric insulating layer 36 is formed to cover a heating member 25 on the heating member formation surface of an insulating substrate 21, and consists of, for example, anisotropic pyrolytic boron nitride (to be referred to as APBN hereinafter). The reflecting layer 37 reflects the heat generated by the heating member 25. For example, the reflecting layer 37 consists of anisotropic pyrolytic graphite (to be referred to as APG hereinafter) and is stacked on the surface of the electric insulating layer 36. The electric insulating layer 36 protects the heating member 25 against the reflecting layer 37 and the outside, and provides electrical insulation.

According to the cathode assembly 27 having the above structure, since the reflecting layer 37 reflects the heat from the heating member 25 at the shortest distance to heat a cathode base member 24 through the insulating substrate 21, the heater power can further be reduced to, for example, 15% that in the cathode assembly 27 according to the first embodiment.

The material for the electric insulating layer 36 is not limited to APBN; any electrically insulating material with a heat resistance of 1,100° C. or higher may be used. In addition, since the aim of the reflecting layer 37 is to reflect heat, the layer may be made of a metal film. In this embodiment, the electric insulating layer 36 and the reflecting layer 37 are formed as a combination. However, the present invention is not limited to this. If a plurality of combinations of these layers are stacked on each other, the reflectance increases to allow a better heater power saving design.

In each of the first and second embodiments described above, the cathode base member uses the oxide cathode obtained by coating the base metal layer 22 with the emissive material. However, as the cathode base member, a cathode base member 24A of a so-called impregnated cathode can be used, which is obtained by impregnating a porous cathode base member consisting of a porous tungsten material or the like with an emissive material such as barium oxide (BaO), calcium oxide (CaO), or aluminum oxide ($Al_2O_3$). This cathode base member 24A is joined to the base metal layer 22. In the impregnated cathode, the porous cathode base member is impregnated with the emissive material, unlike in the oxide cathode in which the emissive material is formed on the base metal layer, as described with reference to FIGS. 2 to 6. With this structure, the impregnated cathode does not necessarily require a base metal layer which is required for the cathode base member of the oxide cathode. When, therefore, the cathode base member 24A of the impregnated cathode is to be used, it suffices to form a conductive layer serving to conduct a current from an electrode terminal 22*a* in place of the base metal layer 22. As this conductive layer, for example, Ta, an Re—Mo alloy, Mo, or Nb is used in consideration of operating temperatures.

The electron gun assembly of an electron tube according to the third embodiment of the present invention will be described next with reference to FIGS. 10 to 14B. The third embodiment differs from the first embodiment in the shape of the insulating substrate and the mounting structure of a cathode assembly 27 with respect to a bead glass 29. Other arrangements are substantially the same as those of the first embodiment. The same reference numerals in the third embodiment denote the same parts as in the first embodiment, and a detailed description thereof will be omitted.

Figure 10:
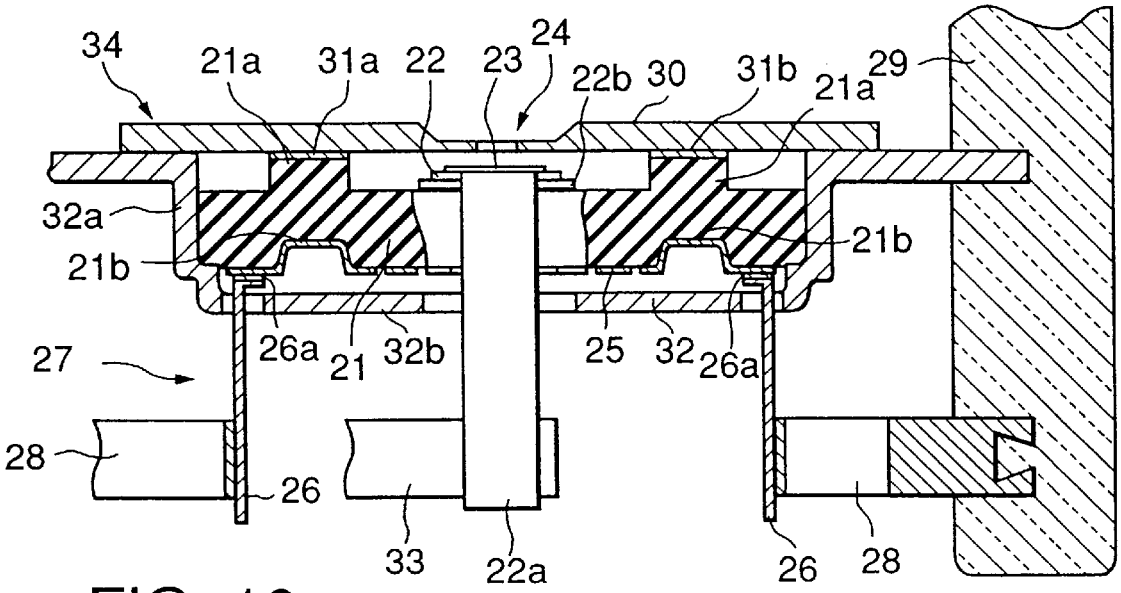
FIG. 10 is a sectional view of the electron gun assembly of an electron tube according to a third embodiment of the present invention.
Figure 11:
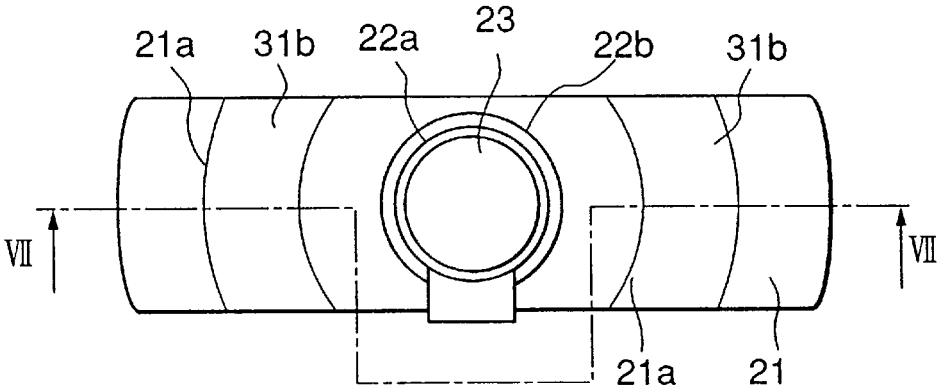
FIG. 11 is a plan view of the cathode base member formation portion of a cathode assembly mounted in the electron tube of the third embodiment.
Figure 12:
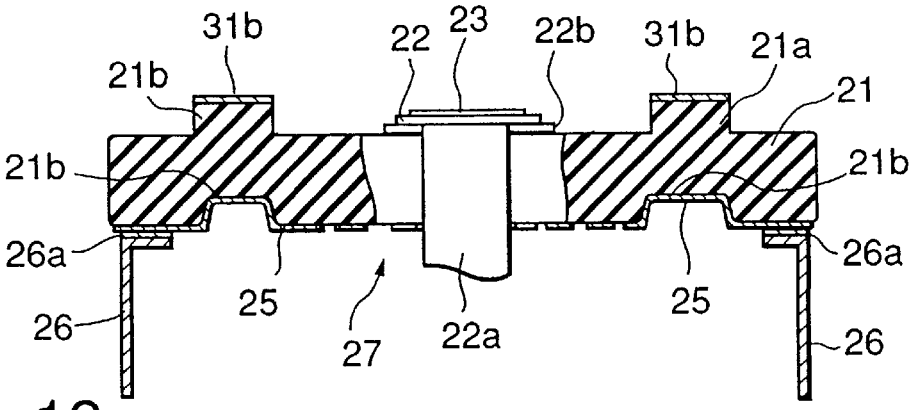
FIG. 12 is a sectional view taken along a line XII—XII in FIG. 11.

As shown in FIGS. 10 to 12, projections 21*a* having the same height are formed on one surface (cathode base member formation surface) of an insulating substrate 21 consisting of APBN at, for example, the two longitudinal end portions. Each projection 21*a* serves as a spacer for defining the space between a cathode base member 24 and a first grid 30. Recesses 21*b* are formed in the other surface (heating member formation surface) of the insulating substrate 21 at the opposite positions to the projections 21*a*. The cathode base member 24 is placed in the center of the upper surface of the insulating substrate 21 through a metal layer 22*b* to be located between the projections 21*a*. The insulating substrate 21 has a length of 4 mm, a width of 1.2 mm, and a thickness of 0.25 mm.

Note that the recesses 21*b* are arbitrarily set, and are not necessarily required.

The first grid 30 consisting of stainless steel is fixed to the projections 21*a* through metal layers 31*b* consisting of titanium. The metal layer 31*b* is an example of a metallized layer formed to reliably fix the first grid 30 to the projection 21*a*.

The end portion of a side wall 32*a* of a retainer 32 consisting of stainless steel and covering the cathode assembly 27 is fixed to the first grid 30 and attached to the bead glass 29. With this structure, the retainer 32 fixes/holds the cathode assembly 27 and the first grid 30, and also serves to reflect the heat from a heating member 25 toward the insulating substrate 21.

An electron gun assembly 34 is formed by adding the first grid 30 and the retainer 32 to the cathode assembly 27. If the thickness of the first grid 30 is 0.5 mm, the total length of the electron gun assembly 34 is the sum, i.e., 2.5 mm, of the length of the cathode assembly 27, which is 2.0 mm, and the thickness of the first grid 30, which is 0.5 mm.

Figure 13A:
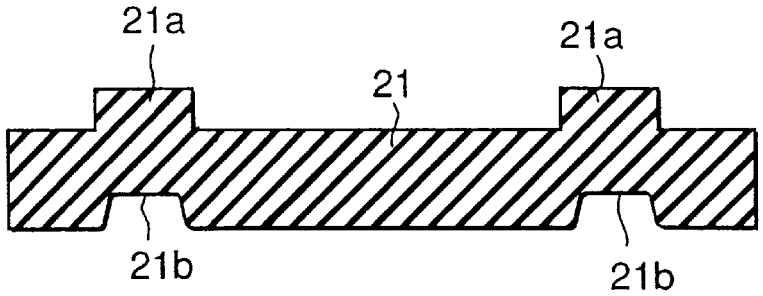
FIGS. 13A to 13E are sectional views showing the steps in manufacturing the cathode assembly according to the third embodiment.

A method of manufacturing the electron gun assembly 34 having the above structure will be described next. First of all, as shown in FIG. 13A, the 0.25-mm thick insulating substrate 21 consisting of APBN is manufactured by the chemical vapor deposition method (CVD method). As a base member on which APBM is to be deposited, carbon is generally used. The insulating substrate 21 is not flat; the projections 21*a* are formed on surface, and the recesses 21*b* are formed in the other surface.

Figure 13B:
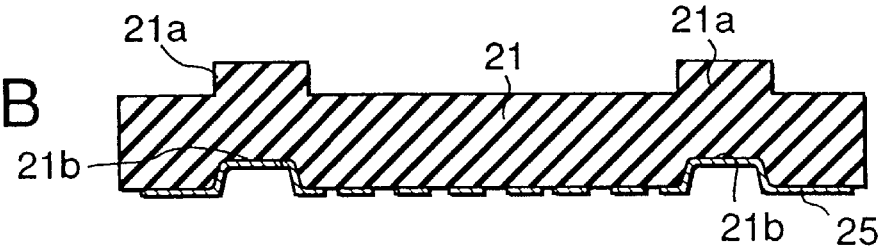

The heating member 25 is formed on the other surface of the insulating substrate 21. First of all, aluminum (Al) is deposited on the surface of the insulating substrate 21 by the vacuum vapor deposition method. Although the arbitrarily set recesses 21*b* are formed in the insulating substrate 21, no problem is posed because aluminum is uniformly deposited on this portion in vapor deposition. This Al layer is then coated with a resist. The resist is exposed, developed, and etched to form a reverse pattern to that of the heating member. A portion of the Al layer which corresponds to the heating member pattern is removed by etching, and an APG layer is formed on the etched portion (the heating member pattern portion) by the CVD method. Thereafter, the remaining Al layer portions are removed by etching. With this process, the heating member 25 having a predetermined pattern is formed on the other surface of the insulating substrate 21, as shown in FIG. 13B.

Figure 13C:
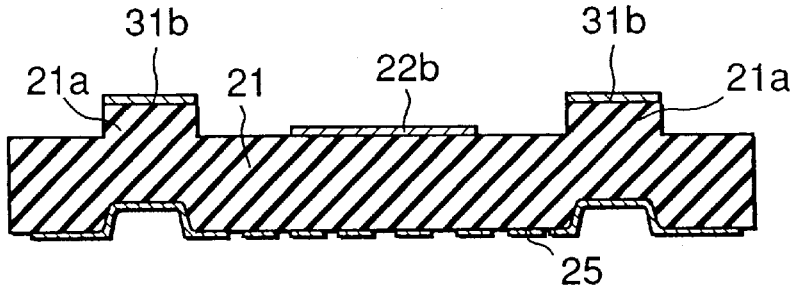

As shown in FIG. 13C, the metal layers 22*b* and 31*b* consisting of titanium are formed on one surface of the insulating substrate 21 and the projections 21*a* by the vapor deposition method. In this case, the entire surface of the insulating substrate 21 is coated with a resist, and the portions on which Ti is to be deposited are exposed on the surface of the insulating substrate 21 consisting of APBN by the exposure, development, and etching steps as in the manufacture of the heating member 25. At the same time, the resist portions on the projections 21*a* consisting of APBN are removed. By depositing Ti and removing the resist, the metal layers 22*b* and 31*b* are formed on the exposed portions, as shown in FIG. 13C. Thereafter, in order to improve the adhesion between the metal layers 22*b* and 31*b* and the insulating substrate 21, these layers are heat-treated in a vacuum at 1,670° C., thus performing a metallizing process for the metal layers.

Figure 13D:
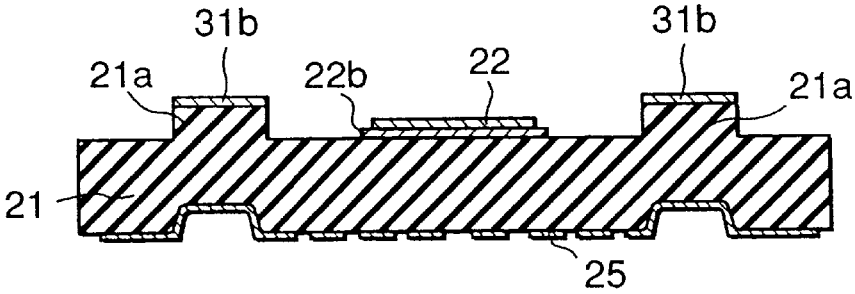
Figure 13E:
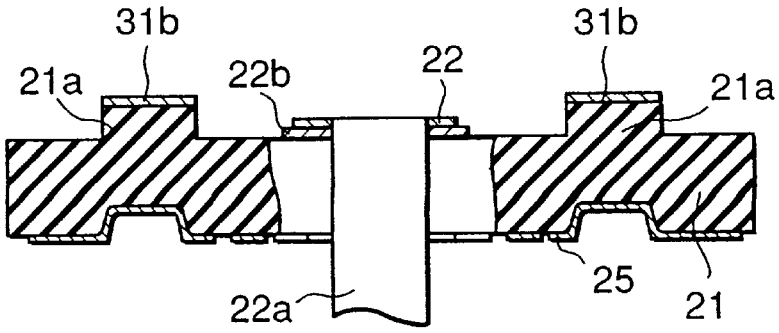

Subsequently, as shown in FIG. 13D, a base metal layer 22 consisting of nickel is deposited on the metal layer 22*b* by the same method as described above. After the base metal layer 22 is formed, the resultant structure is processed at about 1,300° C. at which nickel is diffused in a vacuum, thereby ensuring the adhesion between the base metal layer 22 and the metal layer 22*b*. At this time, as shown in FIG. 13E, an electrode terminal 22*a* which is independent of the base metal layer 22 is formed in contact with the base metal layer 22. In this case, the distal end portion of the electrode terminal 22*a*, which is independent of the base metal layer 22, is preferably bent to be in contact with the base metal layer 22.

Figure 14A:
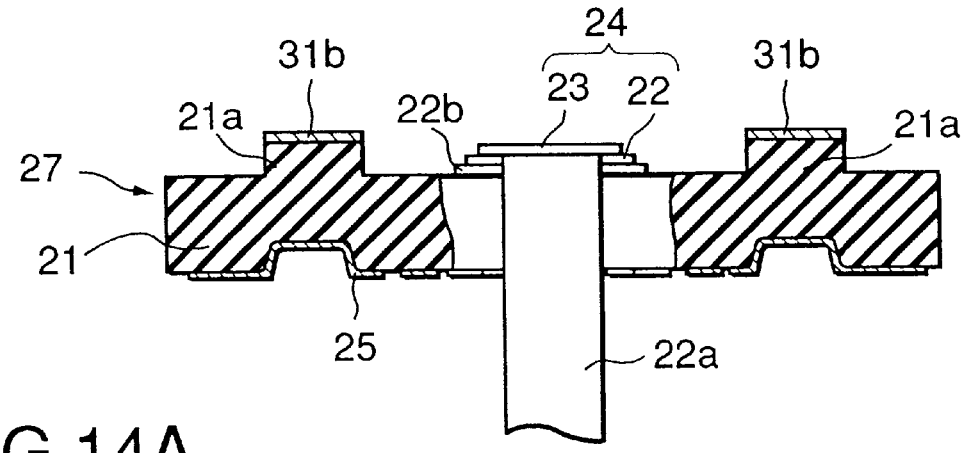
FIGS. 14A and 14B are sectional views showing the steps in forming the cathode assembly according to the third embodiment.

As shown in FIG. 14A, the surface of the base metal layer 22 is coated with the emissive material 23 by the spraying method to form the cathode base member 24. With the above process, the cathode assembly 27 is manufactured.

The above method of manufacturing the cathode assembly 27 uses one insulating substrate for one cathode. In order to improve the productivity and achieve a reduction in cost, a method of dividing an insulating substrate into many substrates may be used. In this method, heating member patterns, Ti-metallized layers, and base metal layers are formed on a multi-cathode substrate, and the substrate is divided into many substrates, thereby obtaining cathode members.

Figure 14B:
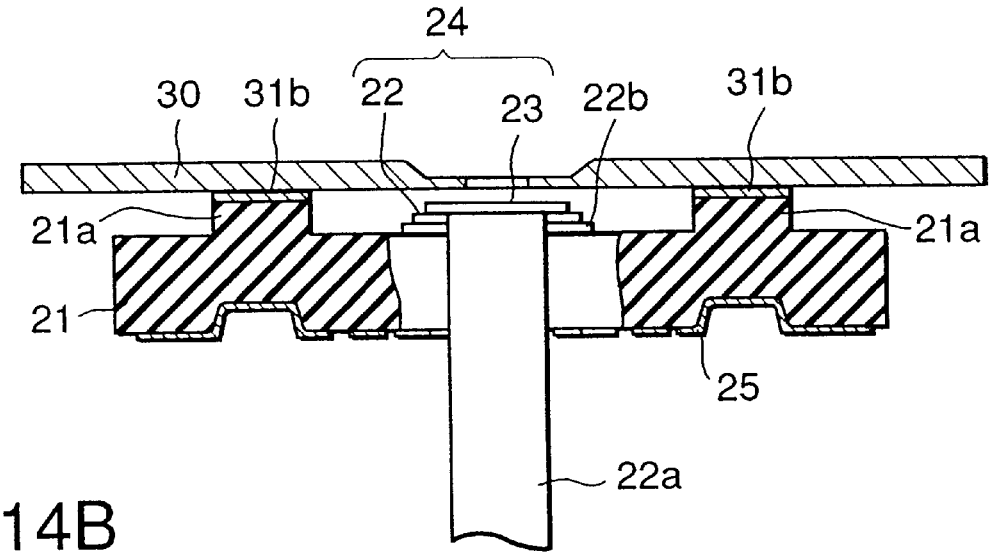

A method of assembling the electron gun assembly 34 will be described next. As shown in FIG. 14B, the first grid 30 having a predetermined shape is mounted on the metal layers 31*b* deposited on the projections 21*a* of the insulating substrate 21, and the metal layers 31*b* and the first grid 30 are fixed to each other by laser welding. In this case, the distance between the first grid 30 and the emissive material 23 is an important factor that determines whether electrons are emitted from the electron gun as designed. For this reason, each projection 21*a* must have an accurate height. Note that the Ti and Ni layers are formed by the vapor deposition method. Other thin film formation methods include the sputtering method, the ion plating method, and the like. One of these methods can be used without posing any problem.

Subsequently, the retainer 32 is mounted on the cathode assembly 27, and the retainer 32 is fixed to the first grid 30 by welding. The retainer 32 and a heater strap 28 are embedded into the bead glass 29 which is set in a semi-fused state by a burner. After this step, a heater electrode terminal 26 is welded to the heater strap 28. Similarly, the electrode terminal 22*a* is fixed to a cathode strap 533 by welding. In this manner, the electron gun assembly 34 and an electron tube 35 are manufactured.

In the cathode assembly 27, the electron gun assembly 34, and the electron tube having the above structures, the same effects as those in the first embodiment can be obtained. In addition, according to this embodiment, by integrally forming a spacer using the projections 21*a* of the insulating substrate 21, the assembly efficiency of the electron gun assembly can be improved.

Figure 15:
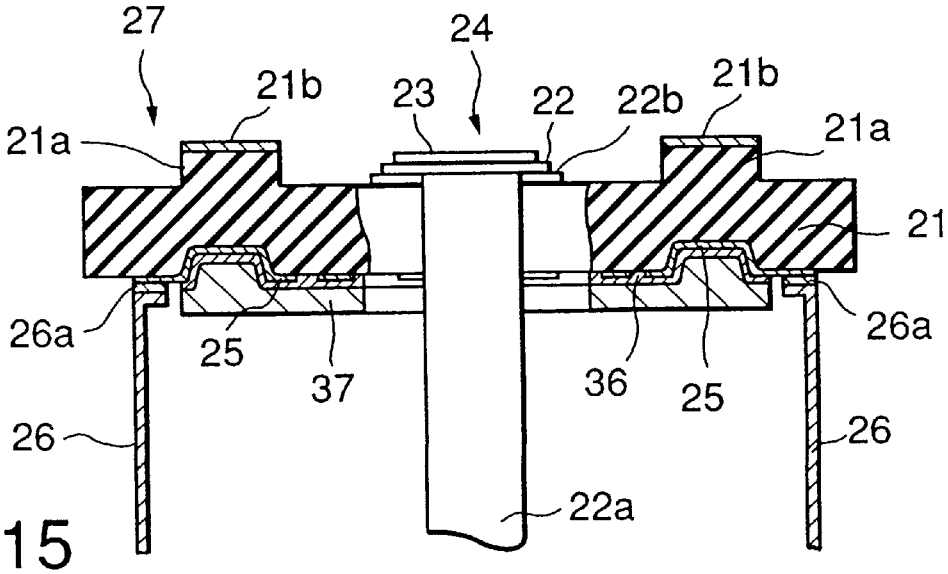
FIG. 15 is a sectional view of a cathode assembly according to a fourth embodiment of the present invention.

FIG. 15 shows the cathode assembly of an electron tube according to the fourth embodiment of the present invention. According to the fourth embodiment, the cathode assembly 27 in the third embodiment additionally has an electric insulating layer 36 and a reflecting layer 37.

The electric insulating layer 36 covers a heating member 25 on the heating member formation surface of an insulating substrate 21, and consists of, e.g., APBN. The reflecting layer 37 reflects the heat from the heating member 25, and consists of, e.g., APG. The electric insulating layer 36 protects the heating member 25 against the reflecting layer 37 and the outside, and provides electric insulation.

The material for the electric insulating layer 36 is not limited to APBN; any electrically insulating material with a heat resistance of 1,100° C. or higher may be used. In addition, since the aim of the reflecting layer 37 is to reflect heat, the layer may be made of a metal film. In this embodiment, the electric insulating layer 36 and the reflecting layer 37 are formed as a combination. However, the present invention is not limited to this. If a plurality of combinations of these layers are stacked on each other, the reflectance increases to allow a better heater power saving design.

In the first to fourth embodiments described above, the base metal layer 22 is fixed to the insulating substrate 21 consisting of APBN by using the method of interposing a metal layer consisting of titanium or the like between the metal layer and the substrate. However, the present invention is not limited to this; other methods, e.g., a caulking method using eyelets and a fixing method using clips, may be used singly or in combination. In addition, in the above embodiments, the heating member and the heater electrode terminal are fixed to each other by the method of interposing a metal layer between them. However, other methods, e.g., the caulking method using eyelets and the fixing method using clips, may be used singly or in combination.

In each of the third and fourth embodiments, the cathode base member uses the oxide cathode formed by coating the base metal layer with the emissive material. However, as the cathode base member, a cathode base member of a so-called impregnated cathode can be used, which is obtained by impregnating a porous cathode base member consisting of a porous tungsten material or the like with an emissive material such as barium oxide (BaO), calcium oxide (CaO), or aluminum oxide ($Al_2O_3$). This cathode base member is joined to the base metal layer. In the impregnated cathode, the porous cathode base member is impregnated with the emissive material, unlike in the oxide cathode in which the emissive material is formed on the base metal layer. With this structure, the impregnated cathode does not necessarily require a base metal layer which is required for the cathode base member of the oxide cathode. When, therefore, the cathode base member of the impregnated cathode is to be used, it suffices to form a conductive layer serving to conduct a current from an electrode terminal in place of the base metal layer. As this conductive layer, for example, Ta, an Re—Mo alloy, Mo, or Nb is used in consideration of operating temperatures.

Figure 16:
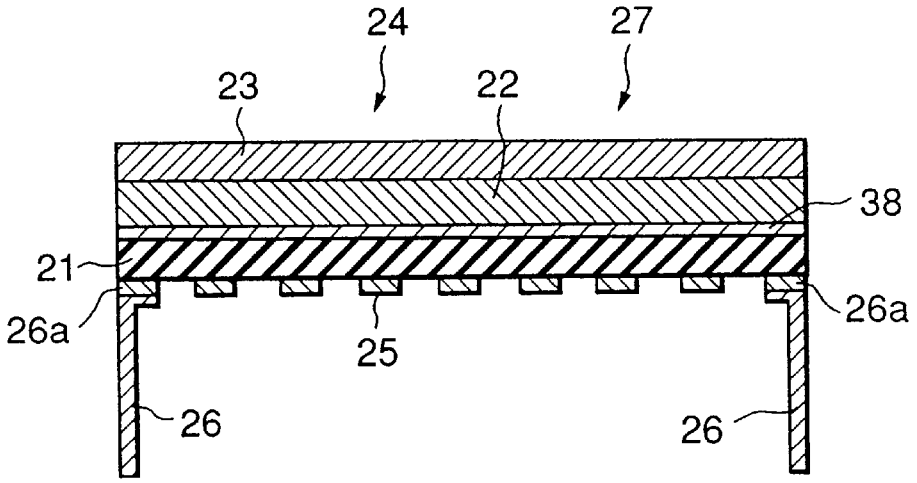
FIG. 16 is a sectional view of a cathode assembly according to a fifth embodiment of the present invention.

FIG. 16 shows the cathode assembly of an electron tube according to the fifth embodiment of the present invention. A cathode assembly 27 has an insulating substrate 21 consisting of APBN and having a pair of opposing surfaces. An APG heating member 25 with a zigzag pattern is formed on one surface of the insulating substrate 21. Heater electrode terminals 26, each consisting of a tungsten wire or the like, are joined to the two end portions of the heating member 25 through metal layers 26*a* consisting of titanium or the like.

A cathode base member 24 is formed on the other surface of the insulating substrate 21. The cathode base member 24 is constituted by a base metal layer 22 consisting of a nickel (Ni) powder doped with magnesium (Mg) and silicon (Si), which are reducing agents, in small amounts, and formed on the entire surface of the insulating substrate 21, and an emissive material 23 with which the base metal layer 22 is coated or impregnated. In this embodiment, the base metal layer 22 is formed on the surface of the insulating substrate 21 through an APG layer 38. The APG layer 38 is expected to reliably join the base metal layer 22 to the insulating substrate 21 and uniformly heat the cathode base member 24.

A method of manufacturing the cathode assembly 27 having the above structure will be described.

First of all, the APG heating member 25 and the APG layer 38 are formed on the insulating substrate 21. A base metal powder layer is then formed on the insulating substrate 21, on which the APG layer 38 is formed, by the screen printing method. In this case, screen printing was performed by using a 250-mesh screen. As a screen mixture, a material obtained by mixing an Ni powder containing a reducing agent with a solvent containing a binder to have a viscosity of about 2,300 P was used. The base metal powder layer can be formed by the spin coating method, the spraying method, or the pressing method.

Subsequently, the resultant structure is sintered in a vacuum or reduction atmosphere at 1,150° C. for 60 minutes to simultaneously form the base metal layer 22 and join the base metal layer 22 to the insulating substrate 21. That is, a heater is constituted by the insulating substrate 21 and the heating member 25, and formation of the base metal layer 22 and joining of the base metal layer 22 to the heater are simultaneously performed. Thereafter, the base metal layer 22 is coated or impregnated with a mixture of an emissive material 66 and a solvent by the spraying method, the brush coating method, or the like, thereby forming the cathode base member 24.

According to the fifth embodiment having the above structure, the APG layer 38 is formed between the base metal layer 22 and the insulating substrate 21. However, this APG layer 38 is arbitrarily formed, and the base metal layer 22 may be directly formed on the insulating substrate 21. That is, in the cathode assembly 27 according to this embodiment, the base metal layer which is formed in advance is not joined on the insulating substrate 21 (arbitrarily including the APG layer), but the base member powder layer is directly formed on the insulating substrate 21 (arbitrarily including the APG layer), and formation of the base metal layer 22 and joining of the base metal layer to the insulating substrate are simultaneously performed by sintering or the like.

Figure 17:
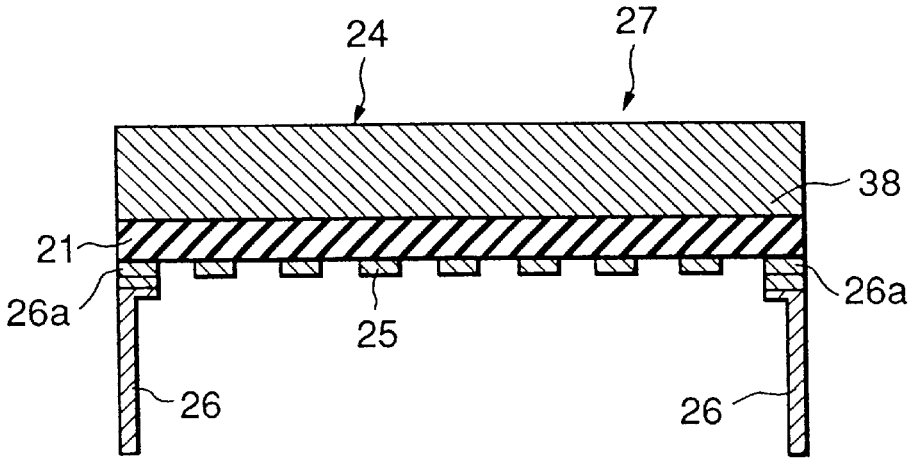
FIG. 17 is a sectional view of a cathode assembly according to a sixth embodiment of the present invention.

According to the sixth embodiment shown in FIG. 17, a heating member 25 is formed on one surface of an insulating substrate 21, and an impregnated cathode base member 24 consisting of a porous tungsten or molybdenum material impregnated with an emissive material is formed on the other surface of the insulating substrate 21. Other arrangements are the same as those in the fifth embodiment in FIG. 16, and the same reference numerals in the sixth embodiment denote the same parts in the fifth embodiment.

The cathode assembly 27 having the above structure is manufactured by the following method. First of all, a 50-$\mu$m thick porous cathode base powder layer is formed on one surface of the insulating substrate 21, on which no heating member is formed, by the spin coating method. In this case, as a coat mixture, a mixture of a tungsten powder with a diameter of 3 $\mu$m and a solvent containing a binder was used.

Subsequently, the resultant structure is sintered in a vacuum or reduction atmosphere at 1,900° C. for 60 minutes to simultaneously form the porous cathode base member 24 and join the cathode base member 24 to the insulating substrate 21. Thereafter, the hole portions of the porous base metal layer is impregnated with an emissive material to form the cathode base member 24.

According to each of the fifth and sixth embodiments having the above structures, the base metal powder layer of the cathode base member is directly formed on the insulating substrate 21 on which the heating member 25 is formed, and the resultant structure is sintered to simultaneously form the cathode base member and join the insulating substrate 21 and the cathode base member together. For this reason, the manufacturing process for the cathode assembly is simplified, and an improvement in productivity and a reduction in the cost of the cathode assembly can be attained. In addition, since the cathode base member is the sintered powder member, the thermal expansion difference between the cathode base member and the insulating substrate can be reduced to allow them to be joined to each other with sufficient joining strength. Furthermore, the decreases in the size and weight, and the fast operation characteristics of the cathode assembly can be attained at the same time.

Table 1 shows the characteristics of the cathode assemblies according to the fifth and sixth embodiments and the conventional, general cathode assembly for comparison.

TABLE 1

Comparison of Dimensions and Weights

| | Fifth Embodiment | Sixth Embodiment | Prior Art |
|---|---|---|---|
| Cathode Diameter | 20 mm | 20 mm | 20 mm |
| Total Length | 5 mm | 5.5 mm | 30 mm |
| Weight | 5 g | 7 g | 30 g |

*Prior art is impregnated cathode base member

Table 1 shows comparisons between the sizes and weights of the cathode assemblies. As is apparent from Table 1, the cathode assemblies according to the embodiments were reduced in both size and weight as compared with the conventional, general cathode assembly. In addition, by simultaneously performing formation of the cathode assembly and joining of the assembly to the heater, an improvement in productivity and a reduction in cost were attained at the same time.

Figure 18:
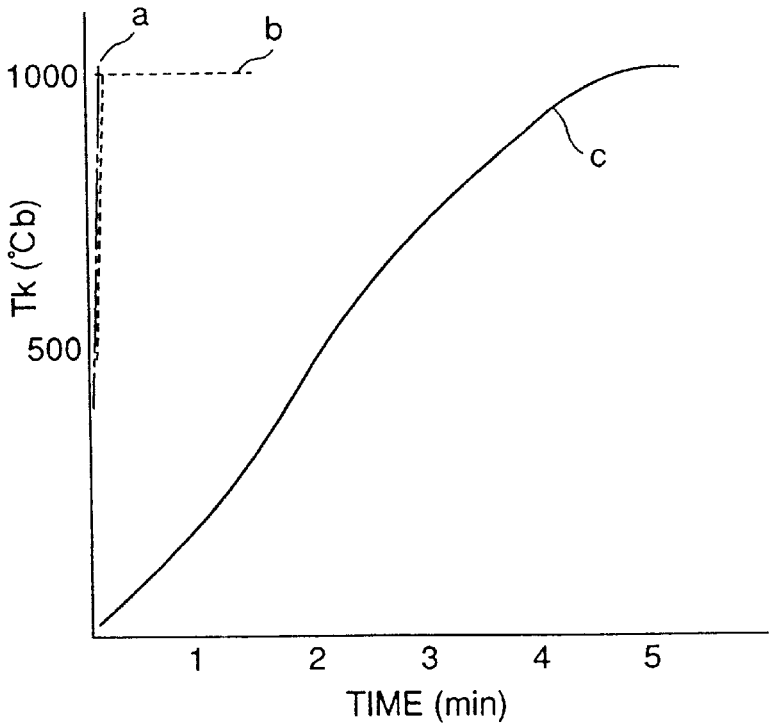
FIG. 18 is a graph showing the rise characteristics of the cathode assembly.

FIG. 18 is a graph showing the rise characteristics of cathode assemblies a and b of the fifth and sixth embodiments and a conventional, general cathode assembly c. Referring to FIG. 18, the ordinate represents a brightness temperature Tk (° C.b) each cathode assembly, and the abscissa represents a rise time Time (min) of each cathode assembly. As is apparent from this graph, the rise time of the conventional, general cathode assembly c, i.e., the time required to reach 1,000° C.b, was about five minutes. In contrast to this, the rise time of the cathode assembly a according to the fifth embodiment, which is indicated by a chain line a, was about five seconds, and the rise time of the cathode assembly b according to the sixth embodiment, which is indicated by a dashed line b, was about 10 seconds. It was therefore confirmed that the fast operation characteristics of the cathode assemblies according to the fifth and sixth embodiments were attained.

Figure 19:
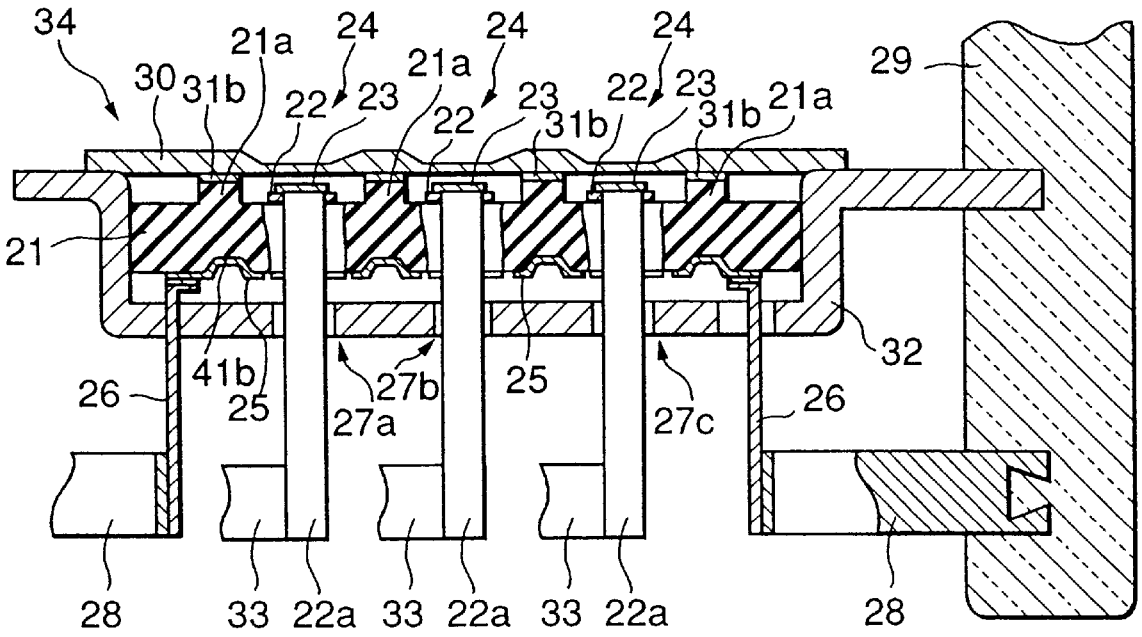
FIG. 19 is a sectional view of an electron gun assembly in an electron tube according to a seventh embodiment of the present invention.

The electron gun assembly of an electron tube according to the seventh embodiment of the present invention will be described next with reference to FIG. 19. An electron gun assembly 34 according to this embodiment is designed to be suited for a color electron tube, and includes three cathode assemblies 27*a* to 27*c* respectively corresponding to the three primary colors, i.e., red, green, and blue. The arrangement of each cathode assembly is almost the same as that in the third embodiment described above, and the same reference numerals in this embodiment denote the same parts as in the third embodiment.

Four projections 21*a* are formed side by side on one surface of an insulating substrate 21 at intervals in the longitudinal direction. For example, three cathode base members 24, each forming an oxide cathode, are arranged in the portions between the projections 21*a*. An electrode terminal 22*a* of a base metal layer 22 of each cathode base member 24 is connected to a cathode strap 23. Each projection 21*a* is joined to a first grid 30 through a metal layer 31*b*, and serves as a spacer and also prevents electron emission from the adjacent cathode base members 24 from affecting each other.

A common heating member 25 is formed on the other surface of the insulating substrate 21. Heater electrode terminals 26 are joined to the two end portions of the heating member 25 through metal layers 26*a*. The heating member 25 and the three cathode assemblies 27*a* to 27*c* are fixed/held by a command retainer 32.

According to this embodiment having the above structure, since the electron gun assembly 34 is constituted by a combination of the three cathode base members 24, each having the same effects as those in the third embodiment, and the grid 30, a compact, high-performance electron gun assembly and color cathode ray tube can be obtained.

A cathode assembly according to the eighth embodiment of the present invention will be described with reference to FIG. 20.

According to this embodiment, the cathode assembly includes an APBN insulating substrate 101 and an APG heating member 102 and a pair of electrodes 102*a* which are formed on one surface of the insulating substrate 101. An APBN layer 103 is formed on the surface of the insulating substrate 101 to cover the heating member 102. An impregnated cathode base member 105 consisting of a nickel powder containing an emissive material and a reducing agent is formed on the surface of the APBN layer 103 through an APG coat layer 104. The APG coat layer 104 covers the entire surface of the APBN layer 103. An APG coat layer 106 having at least the same area as that of the APBN layer 103 is formed on the other surface of the insulating substrate 101. These APG coat layers 104 and 106 are expected to improve the adhesion between the heating member 102 and the APBN layer 103 and uniformly heat the entire impregnated cathode base member 105 by uniformly dispersing the heat generated by the heating member 102.

A heater electrode terminal 107 consisting of a tungsten (W) wire or the like is connected to each electrode 102*a* of the insulating substrate 101. The heater electrode terminal 107 is directly joined to each electrode 102*a* by brazing using a brazing material 108.

A heater 120 of the cathode assembly is constituted by the insulating substrate 101, the heating member 102, the APBN layer 103, and the heater electrode terminal 107. The heater 120 heats the impregnated cathode base member 105 by energizing the heating member 102.

A method of manufacturing the cathode assembly having the heater 120 and the impregnated cathode base member 105 will be described below.

A method of mounting electrode terminals on the heater 120 will be described first. A tungsten wire forming the heater electrode terminal 107 is placed as a terminal on each electrode 102*a* of the heating member 102, and the connecting portion is coated with a metal powder by using a solvent containing a binder. The resultant structure is then subjected to brazing in a hydrogen atmosphere or a vacuum in a furnace.

In brazing, a metal used as the brazing material 108 and brazing conditions were examined as follows. The following eight types of metals were used as brazing materials: nickel (Ni), titanium (Ti), molybdenum (Mo), tungsten (W), niobium (Nb), and tantalum (Ta), which exhibit good wettability with respect to APG and have melting points of 1,400° C. or more, and ruthenium/molybdenum (Ru/Mo) and ruthenium/molybdenum/nickel (Ru/Mo/Ni), which are generally used for an electron tube.

It is confirmed by experiment that when APG is heat-treated in a hydrogen atmosphere at 1 atm and 1,600° C. or higher, APG reacts with hydrogen to gasify. For this reason, when the treatment temperature was 1,600° C. or higher, heat treatment was performed in a vacuum. That is, in this examination, only nickel brazing was performed in a hydrogen atmosphere, but the remaining brazing materials were treated in a vacuum. Table 2 shows the result.

TABLE 2

Result obtained by brazing APG electrode and metal wire using metal powder brazing material

| Brazing material | Process atmosphere | | Result |
|---|---|---|---|
| Ni | Hydrogen | 1475° C. | ○ |
| Ti | Vacuum | 1670° C. | ○ |
| Mo | Vacuum | 2000° C. | Δ Sintered state |
| W | Vacuum | 2000° C. | Δ Sintered state |
| Nb | Vacuum | 2000° C. | Δ Sintered state |
| Ta | Vacuum | 2000° C. | Δ Sintered state |
| Ru/Mo | Vacuum | 2050° C. | X |
| Ru/Mo/Ni | Vacuum | 1700° C. | X |

According to Table 2, it was confirmed that brazing was properly performed by using Ni and Ti. Although the electrode and the wire were joined to each other with Mo, W, Nb, and Ta, since they were refractory metals, joining was achieved by only sintering. Although Ru/Mo and Ru/Mo/Ni were fused, the electrode and the wire were not joined to each other with these brazing materials. It was found from this result that Ni and Ti were the optimum brazing materials used in a furnace. In this embodiment, Ni was used as a brazing material, and brazing was performed in a hydrogen atmosphere at 1,475° C.

A method of forming the impregnated cathode base member 105 on the heater 120 will be described next. An emissive material and a nickel powder containing a reducing agent are mixed together by using an organic solvent. The resultant material is then applied to the surface of the APBN layer 103 of the heater 120 to a thickness of 1 mm through the APG coat layer 104 by screen printing. As the coating method in this case, the spin coating method, the spraying method, or the like can be used. Thereafter, the emissive material pyrolysis step is performed, and the nickel powder containing the reducing agent is caused to adhere to the APG coat layer 104 by thermal diffusion, thereby manufacturing the cathode base member 105.

According to the embodiment having the above structure, the heater 120 comprises the insulating substrate 101 consisting of boron nitride, the heating member 102 consisting of graphite and formed on the insulating substrate 101, and the heater electrode terminals 107 joined to the heating member 102 by brazing. With this structure, the heating member 102 and the heater electrode terminals 107 can be easily and firmly connected to each other, and a heater suitable for a cathode assembly can be obtained.

In addition, since the impregnated cathode base member 105 is joined/fixed to the insulating substrate 101 in a stacked state, no support cylindrical member is required for the impregnated cathode base member 105, realizing a simple structure.

Figure 21A:
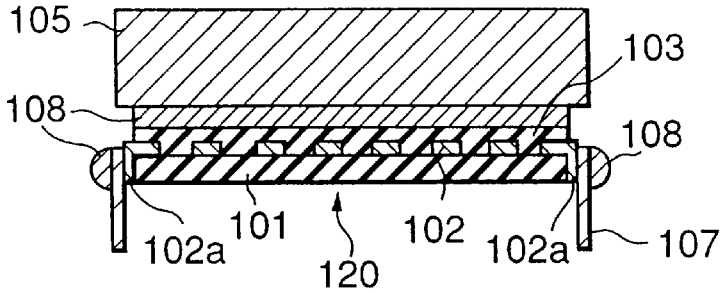
FIG. 21A is a sectional view of a cathode assembly according to a ninth embodiment of the present invention.
Figure 21B:
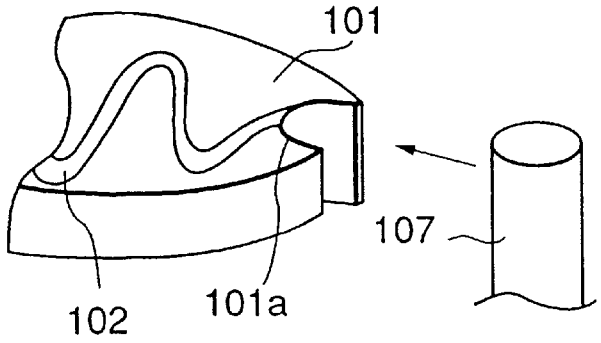
FIG. 21B is a perspective view of a heater in the cathode assembly according to the ninth embodiment.

A cathode assembly according to the ninth embodiment of the present invention will be described below with reference to FIGS. 21A and 21B.

In this embodiment, an impregnated cathode base member 105 consisting of a porous tungsten material impregnated with an emissive material is used. This cathode base member 105 is fixed to an APBN layer 103 with a brazing material 108. A pair of notches 101*a* are formed in the opposing edge portions of an insulating substrate 101. Electrodes 102*a* of a heating member 102 are formed in these notches 101*a*. A heater electrode terminal 107 is fitted in each notch 101*a* in contact with the electrode 102*a*, and is joined/fixed therein with brazing.

According to a heater 120 of the cathode assembly having the above structure, the heater electrode terminal 107 can be positioned/fixed in each notch 101*a* of the insulating substrate 101, and the joining area between the heater electrode terminal 107 and the electrode 102*a* increases. As a result, the joining strength of the terminal and the electrode increases.

A method of manufacturing the above cathode assembly having the heater 120 and the cathode base member 105 will be described next.

The heater electrode terminal 107 and the electrode 102*a* are joined to each other by the same manner as in the eighth embodiment. In this embodiment, Ti is used as the brazing material 108. First of all, a porous tungsten material as the base metal for the cathode base member 105 is brazed to the APBN layer 103. In this case, a metal used as the brazing material and brazing conditions were examined as follows. The following eight types of metals were used as brazing materials: Ni, Ti, Mo, W, Nb, and Ta, which exhibit good wettability with respect to boron nitride and have melting points of 1,400° C. or more, and Ru/Mo and Ru/Mo/Ni, which are generally used for an electron tube. As described above, since APG is unstable in a hydrogen atmosphere, when the treatment temperature was 1,600° C. or higher, heat treatment was performed in a vacuum. That is, in this examination, only Ni brazing was performed in a hydrogen atmosphere, but the remaining brazing materials were treated in a vacuum. Table 3 shows the result.

TABLE 3

Result obtained by brazing APBN and base metal layer using metal powder brazing material

| Brazing material | Process atmosphere | | Result |
|---|---|---|---|
| Ni | Hydrogen | 1475° C. | X |
| Ti | Vacuum | 1670° C. | ○ |
| Mo | Vacuum | 2000° C. | Δ Sintered state |
| W | Vacuum | 2000° C. | Δ Sintered state |
| Nb | Vacuum | 2000° C. | Δ Sintered state |
| Ta | Vacuum | 2000° C. | Δ Sintered state |
| Ru/Mo | Vacuum | 2050° C. | X |
| Ru/Mo/Ni | Vacuum | 1700° C. | X |

According to Table 3, it was confirmed that brazing was properly performed by using Ti. Although the electrode and the wire were joined to each other with Mo, W, Nb, and Ta, since they were refractory metals, joining was achieved by only sintering. Although Ru/Mo, Ru/Mo/Ni, and Ni were fused, the electrode and the wire were not joined to each other with these brazing materials. It was found that Ti was the optimum brazing material.

Finally, the porous tungsten material as the base metal is impregnated with an emissive material to form the impregnated cathode base member 105.

The 10th embodiment of the present invention will be described below with reference to FIG. 22.

The structure of this embodiment is the same as that of the ninth embodiment except for the joining portion between the electrode of the heating member and the heater electrode terminal. The same reference numerals in FIG. 22 denote the same parts as in FIG. 21A, and a detailed description thereof will be omitted. According to the 10th embodiment, an electrode 102*a* of a heating member 102 extends to the other surface of an insulating substrate 101 through its side surface, and a heater electrode terminal 107 is joined/fixed to the electrode 102*a* by brazing. A cathode base member 105 is of an impregnated type.

A method of manufacturing a heater 120 having the above structure and the impregnated cathode base member 105 will be described.

First of all, brazing films are formed on an APBN layer 103 to be joined to the impregnated cathode base member 105 and on the electrode 102*a* to be joined to the heater electrode terminal 107 by flame spraying. As another formation method, ion plating, sputtering, vacuum deposition, or the like may be used. Subsequently, the base metal layer of the impregnated cathode base member 105 and the heater electrode terminal 107 are brazed by using these films as brazing materials. Brazing materials and atmosphere were examined in the same manner as in the above embodiments, and it was found that only titanium allowed the use of a flame spraying coat as a brazing material after flame spraying. Table 4 shows the film formation result in the flame spraying method.

TABLE 4

Result of metal flame spraying experiment on APG/APBN

| Flame spraying metal | APG | APBN |
|---|---|---|
| Ni | ○ | X |
| Ti | ○ | ○ |
| Mo | ○ | ○ |
| W | X | X → Films can be formed by sputtering |
| Nb | ○ | ○ |
| Ta | ○ | ○ |

According to Table 4, Ti, Mo, Nb, and Ta exhibited good effects for the APBN layers and the APG electrodes.

Finally, the base metal layer of the impregnated cathode base member 105 is impregnated with an emissive material, and an iridium coat layer is formed on the surface of the cathode base member 105, as needed, to complete the cathode base member 105.

Figure 23:
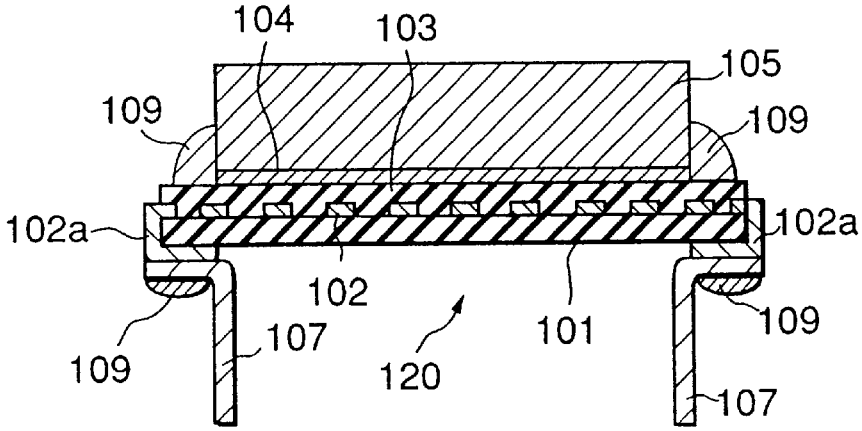
FIG. 23 is a sectional view of a cathode assembly according to a 11th embodiment of the present invention.

According to the 11th embodiment shown in FIG. 23, an impregnated cathode base member 105 is joined to an APBN layer 103 through an APG coat layer 104. TIG welding is performed by using a brazing material 109 to join/fix an electrode 102*a* of a heating member 102 to a heater electrode terminal 107, and the cathode base member 105 to the APBN layer 103. Other arrangements are the same as those in the 11th embodiment.

In a method of manufacturing the cathode assembly having the above structure, when the electrode 102*a* of the heating member 102 is to be joined to the heater electrode terminal 107, the brazing material 109 is applied around the electrode 102*a* and the heater electrode terminal 107, and fused by TIG welding to join the electrode 102*a* to the heater electrode terminal 107. As the brazing material 109, any one of Ni, Ti, W, Mo, Nb, and Ta examined in Table 2 can be suitably used. In this case, Ta is used.

Subsequently, a porous tungsten material as the base metal layer of the impregnated cathode base member 105 is formed on the APBN layer 103 through the APG coat layer 104, and the brazing material 109 is applied around the tungsten material. The brazing material 109 is fused by TIG welding to join the base member layer to the APBN layer 103 as the heating member surface. As the brazing material, any one of Ti, Mo, W, Nb, and Ta examined in Table 3 can be used. In this case, Ta is used. Finally, the base metal layer is impregnated with an emissive material to complete the impregnated cathode base member 105.

Each of the eighth to 11th embodiments comprises the APG coat layers 104 and 106, the APBN layer 103, and the impregnated cathode base member 105. However, these components are arbitrarily set in accordance with the application purpose of the heater, and do not limit the structure of the heater.

Figure 20:
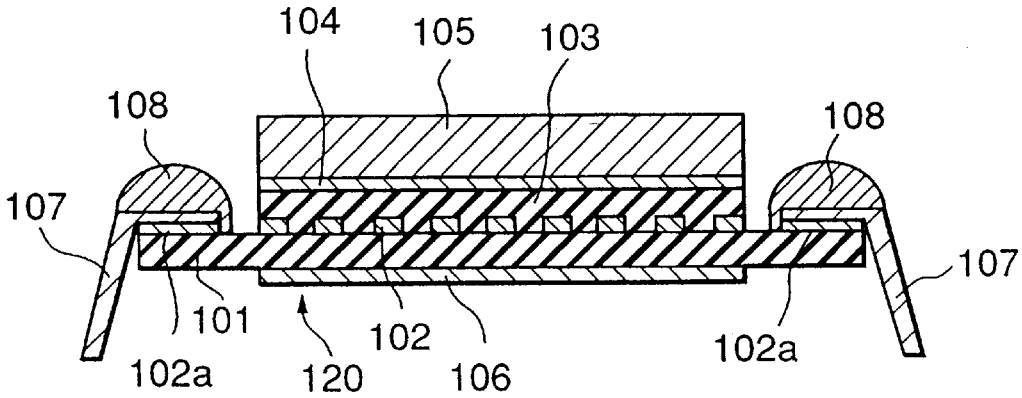
FIG. 20 is a sectional view of a cathode assembly according to a eighth embodiment of the present invention.
Figure 24:
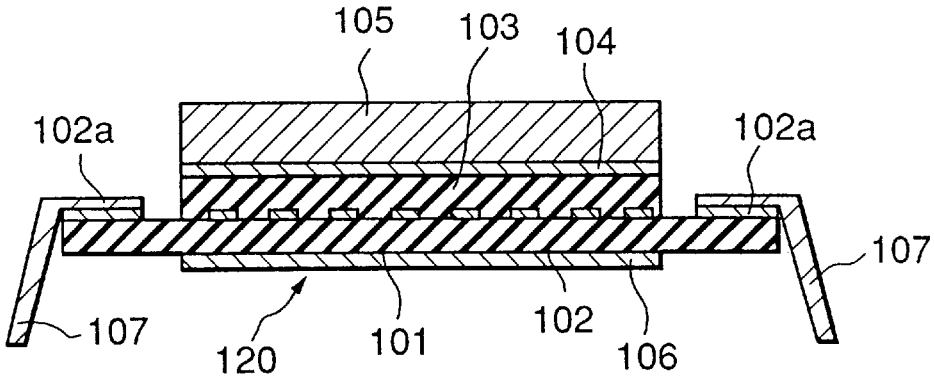
FIG. 24 is a sectional view of a cathode assembly according to a 12th embodiment of the present invention.

In a cathode assembly according to the 12th embodiment in FIG. 24, an electrode 102*a* of a heating member 102 and a heater electrode terminal 107 are joined to each other by a means other than brazing on the basis of the same technique as that used for the cathode assembly in FIG. 20. The same reference numerals in FIG. 24 denote the same parts as in FIG. 20. As the joining means other than brazing, TIG welding, laser welding, electron beam welding, or the like is available.

Since this embodiment comprises an insulating substrate 101 consisting of APBN, the heating member 102 consisting of APG and formed on the insulating substrate 101, and the heater electrode terminal 107 joined to the heating member 102 by a means other than brazing, the heating member 102 can be easily and firmly connected to the heater electrode terminal 107, thereby obtaining a heater 120 especially suitable for a cathode assembly. In addition, since an impregnated cathode base member 105 is joined/fixed to the insulating substrate 101 in a stacked state, no support cylindrical member is required for the impregnated cathode base member 105, realizing a simple structure.

Note that in the 12th embodiment, APG coat layers 104 and 106, an APBN layer 103, and the impregnated cathode base member 105 are arbitrarily set in accordance with application purposes, and can be omitted as needed.

Figure 22:
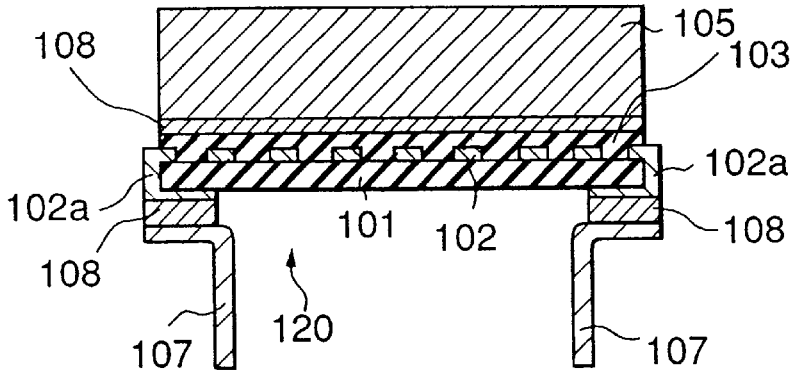
FIG. 22 is a sectional view of a cathode assembly according to a 10th embodiment of the present invention.
Figure 25:
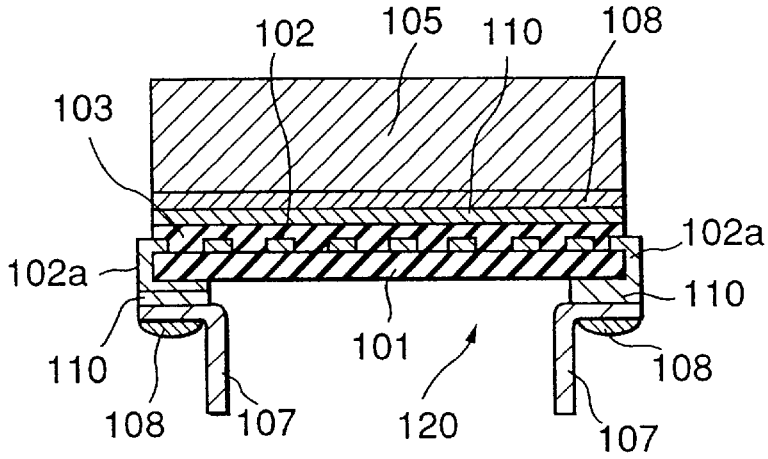
FIG. 25 is a sectional view of a cathode assembly according to a 13th embodiment of the present invention.

The 13th embodiment in FIG. 25 is based on the cathode assembly in FIG. 22. The same reference numerals in FIG. 25 denote the same parts as in FIG. 22. In this embodiment, a metal layer 110 is formed on an electrode 102*a* of a heating member 102, and a heater electrode terminal 107 is brazed to the metal layer 110 with a brazing material 108. A metal layer 110 is formed on an APBN layer 103 of a heater 120, and an impregnated cathode base member 105 is brazed to the metal layer 110 by using a brazing material 108.

In manufacturing the cathode assembly according to this embodiment, first of all, the metal layers 110 are formed on the electrode 102*a* of the heating member 102 and on the APBN layer 103 of the heater 120 by flame spraying. Each metal layer 110 may be formed by ion plating, sputtering, vacuum deposition, or the like. The metal layer 110 may consist of any metal which adheres to APBN and APG and has a melting point of 1,650° C. or higher. In the flame spraying method, in particular, it was confirmed that Ti, Mo, Nb, and Ta in Table 4 could be used to form good metal layers.

A tungsten layer is difficult to form by flame spraying, but can be formed by sputtering. In this embodiment, Nb is used.

Subsequently, the metal layers 110 are brazed to the heater electrode terminal 107 and the base metal layer of an impregnated cathode base member 105 with a general brazing material, e.g., Ru/Mo. The base metal layer is impregnated with an emissive material, and the surface of the resultant structure is coated with Ir, as needed, to complete the impregnated cathode base member 105.

According to this embodiment having the above structure, the heating member 102 can be easily and firmly connected to the heater electrode terminal 107, and the heater 120 especially suitable for the cathode assembly can be obtained. In addition, since the impregnated cathode base member 105 is joined/fixed to the insulating substrate 101 in a stacked state, no support cylindrical member is required for the cathode base member 105.

Figure 26:
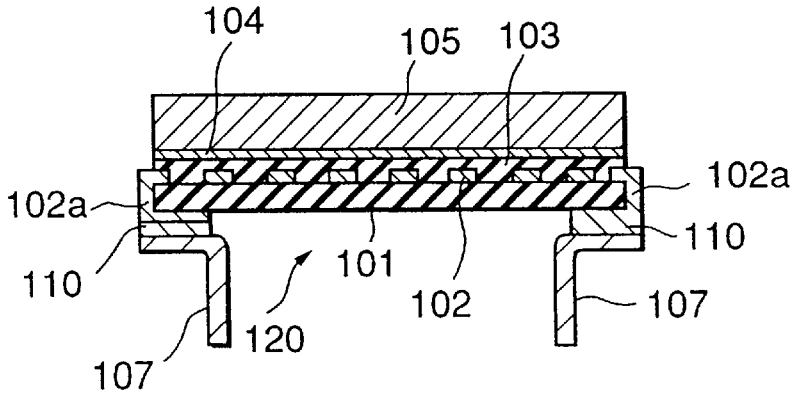
FIG. 26 is a sectional view of a cathode assembly according to a 14th embodiment of the present invention.

A cathode assembly according to the 14th embodiment in FIG. 26 is based on the cathode assembly in FIG. 25, and the same reference numerals in FIG. 26 denote the same parts as in FIG. 25. According to this embodiment, a heater electrode terminal 107 is joined to a metal layer 110 on an electrode 102*a* by a means other than brazing. In addition, an impregnated cathode base member 105 is joined/fixed to an APBN layer 103 of a heater 120 through an APG coat layer 104.

In manufacturing the cathode assembly having the above structure, first of all, the metal layer 110 is formed on the electrode 102*a* of the heating member 102 by flame spraying. This metal layer 110 may consist of a metal which adheres to APBN and APG and has a melting point of 1,650° C. or higher. The heater electrode terminal 107 is then joined to the electrode 102*a* through the metal layer 110 by a means other than brazing. As the means other than brazing, TIG welding, laser welding, electron beam welding, or the like is available. Thereafter, the base metal layer is impregnated with an emissive material, and the surface of the resultant structure is coated with Ir, as needed, to complete the impregnated cathode base member 105.

According to this embodiment, since the heater electrode terminal 107 is joined to the metal layer 110 formed on the electrode of the heating member 102 by a means other than brazing, the heating member 102 and the heater electrode terminal 107 can be easily and firmly connected to each other, thereby obtaining a heater especially suitable for the cathode assembly. In addition, since the impregnated cathode base member 105 is joined/fixed to the insulating substrate 101 in a stacked state, no support cylindrical member is required for the impregnated cathode base member 105.

Table 5 shows comparisons between the characteristics, e.g., the sizes and weights, of the cathode assemblies of the eighth and ninth embodiments and those of a conventional, general cathode assembly.

TABLE 5

Comparison of Dimensions and weights

| | Ninth embodiment | 10th embodiment | Prior art |
|---|---|---|---|
| Cathode diameter | 20 mm | 20 mm | 20 mm |
| Total length | 5 mm | 7 mm | 30 mm |
| Weight | 5 g | 20 g | 30 g |

*Prior art is impregnated cathode base member

According to Table 5, it was confirmed that the cathode assembly of each embodiment was reduced in both size and weight as compared with the conventional, general cathode assembly.

Figure 27:
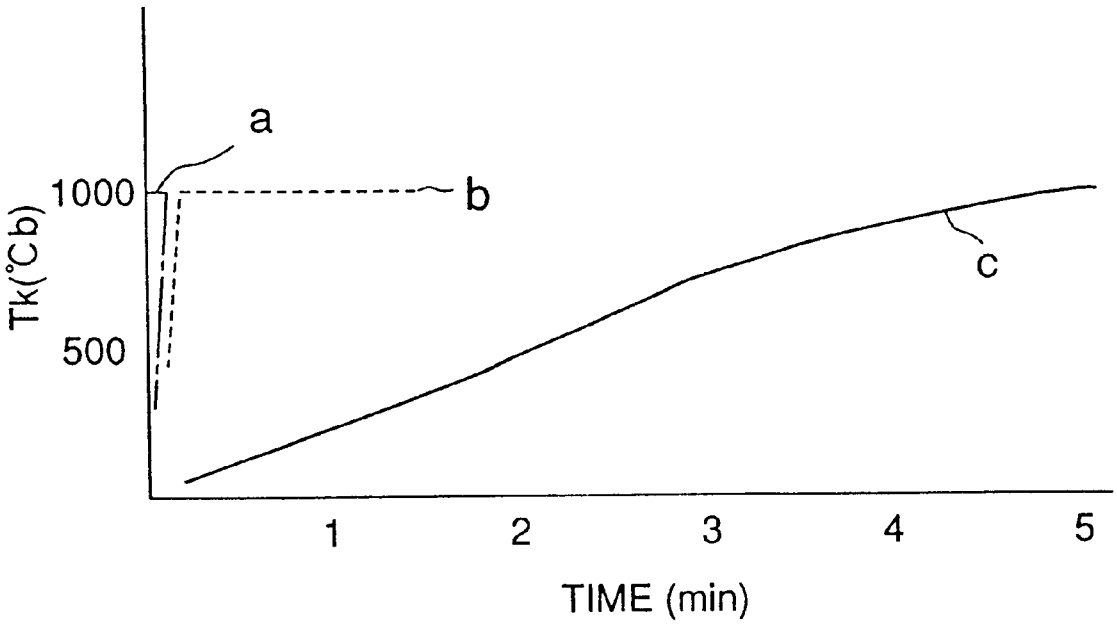
FIG. 27 is a graph showing the rise characteristics of the cathode assembly.
Figure 29A:
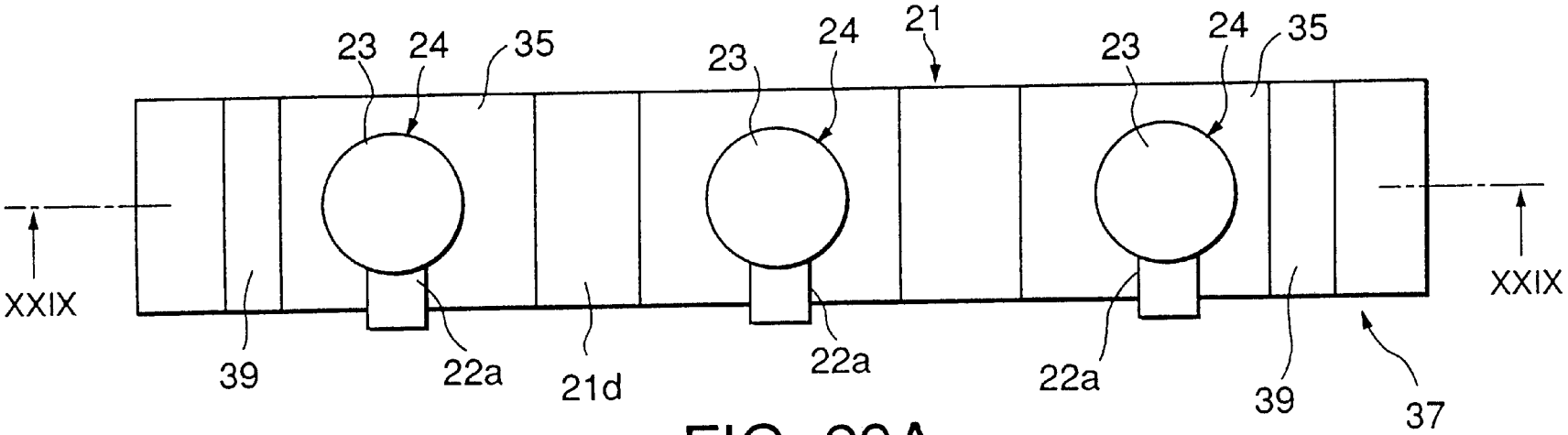
FIGS. 29A and 29B are plan and sectional views showing a cathode assembly according to a 15th embodiment of the present invention.
Figure 29B:
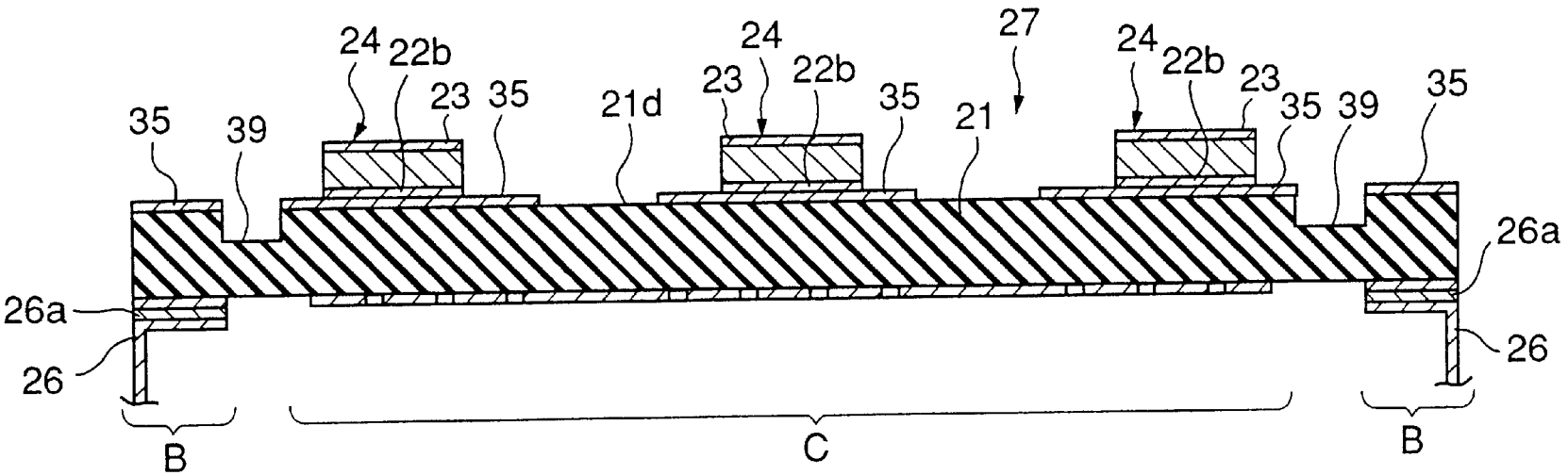

FIG. 27 shows the rise characteristics of the cathode assemblies according to the embodiments and the conventional cathode assembly. Referring to FIGS. 29A and 29B, the ordinate represents a brightness temperature Tk (° C.b) of each cathode assembly, and the abscissa represents a rise time Time (min) of each cathode assembly. Referring to FIG. 29, a chain line a represents the characteristics of the cathode assembly of the eighth embodiment; a dashed line b, the characteristics of the cathode assembly of the ninth embodiment; and a sold line c, the characteristics of the conventional cathode assembly.

In the conventional cathode assembly, it took about five minutes for the cathode temperature to reach 1,000° C. In contrast to this, about five seconds were required in the cathode assembly of the eighth embodiment; and about 10 seconds, in the cathode assembly of the ninth embodiment. It was therefore confirmed that the fast operation characteristics of the cathode assembly of each embodiment were attained.

Figure 28:
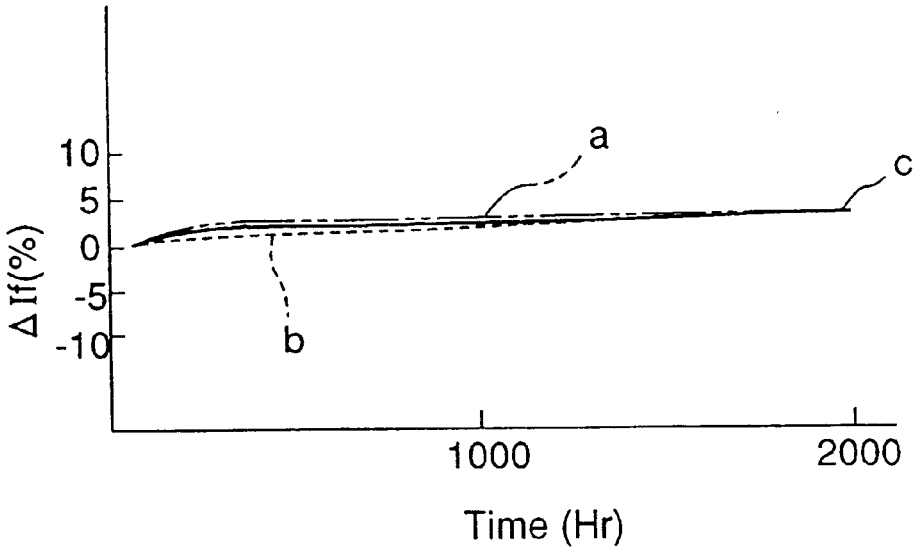
FIG. 28 is a graph showing the stability of the heating member temperature of the cathode assembly.

FIG. 28 is a graph showing comparisons between the stability of the heating member temperature of each of the cathode assemblies of the eighth and ninth embodiments of the present invention and that of the conventional cathode assembly. Referring to FIG. 28, the ordinate represents a rate of change ΔIf (%) in heater current from the start of operation, and the abscissa represents a test time Time (Hr). Changes in heater current were measured while the heating member temperature was set at 1,200° C. Referring to FIG. 28, a chain double-dashed line a represents the characteristics of the cathode assembly of the eighth embodiment; a dashed line b, the characteristics of the cathode assembly of the ninth embodiment; and a solid line c, the characteristics of the conventional cathode assembly. It was confirmed from FIG. 28 that the cathode assembly of each embodiment exhibited the same high temperature stability as that of a conventional, general heater.

The cathode assembly of an electron tube according to the 15th embodiment of the present invention will be described next with reference to FIGS. 29A and 29B. A cathode assembly 27 according to this embodiment is designed to be suited for the electron guns of a color electron tube, and includes three cathode assemblies corresponding to the three primary colors, i.e., red, green, and blue. The basic structure of the cathode assembly 27 is almost the same as that of the cathode assembly of the first embodiment. The same reference numerals in the 15th embodiment denote the same parts as in the first embodiment, and a detailed description thereof will be omitted.

The cathode assembly 27 comprises an insulating substrate 21 consisting of APBN and a heating member 25 consisting APG and formed on one surface of the insulating substrate 21. The insulating substrate 21 is formed into an elongated, flat, rectangular shape having a pair of opposing flat surfaces 21*c* and 21*d*. For example, the insulating substrate 21 has a length of 14 mm, a width of 1 mm, and a thickness of 0.3 mm. The heating member 25 is formed on one surface (lower surface in FIGS. 29A and 29B) of the insulating substrate 21 to have a so-called zigzag pattern throughout the entire length of the insulating substrate 21 in the longitudinal direction. For example, the pattern of the heating member 25 has a line width of 0.15 mm and a thickness of 0.02 mm.

Heater electrode terminals 26 are joined to the two longitudinal end portions of the heating member 25 through metal layers 26*a* consisting of, e.g., titanium. Each heater electrode terminal 26 consists of a conductive metal, e.g., copper.

The heater of the cathode assembly 27 is constituted by the insulating substrate 21, the heating member 25, and the heater electrode terminals 26.

Three cathode base members 24 are formed on the other surface (upper surface in FIGS. 29A and 29B) of the insulating substrate 21 at equal intervals, e.g., 2-mm intervals, in the longitudinal direction of the insulating substrate 21. Each cathode base member 24 includes a base member 22 in the form of a pellet by compressing a nickel powder and an emissive material. For example, the base member 22 has a diameter of 0.6 mm and a thickness of 0.5 mm. The surface of the base member 22 is coated with an emissive material 23 such as barium oxide (BaO), strontium oxide (SrO), or calcium oxide (CaO) by spraying.

Each cathode base member 24 is fixed to an electron tube 35 formed on the surface 21*d* of the insulating substrate 21 through a conductive layer 22*b*. The conductive layer 22*b* is a reaction layer formed by a reaction between a brazing material and the APG layer 35. That is, the APG layers 35 are formed at intervals in the longitudinal direction, and the cathode base members 24 are respectively joined to the APG layers 35. Note that electrode terminals 22*a* for voltage application extend from the base members 22 of the cathode base members 24.

The two longitudinal end portions of the insulating substrate 21 are joining portions B to which the heater electrode terminals 26 are joined, and the regions between these joining portions B are joining portions C to which three base members 34 are joined side by side.

Notches 39 are formed in the insulating substrate 21 at positions between the joining portion B of one heater electrode terminal 26 and the joining portion C of the cathode base member 34 and between the joining portion B of the other heater electrode terminal 26 and the joining portion C of the cathode base member 34. These notches 39 are cut from the surface 21*d* of the insulating substrate 21, on which the cathode base members 24 are formed, to the other surface. That is, each notch 39 is formed in the form of a belt, extends in a direction perpendicular to the longitudinal direction of the insulating substrate 21, and is open to the two side edges of the insulating substrate 21. For example, each notch 39 has a width of 0.5 mm and a thickness of 1 mm.

The cross-sectional area of the portion, of the insulating substrate 21, in which the notch 39 is formed is smaller than that of the remaining portion by 25%.

Figure 30:
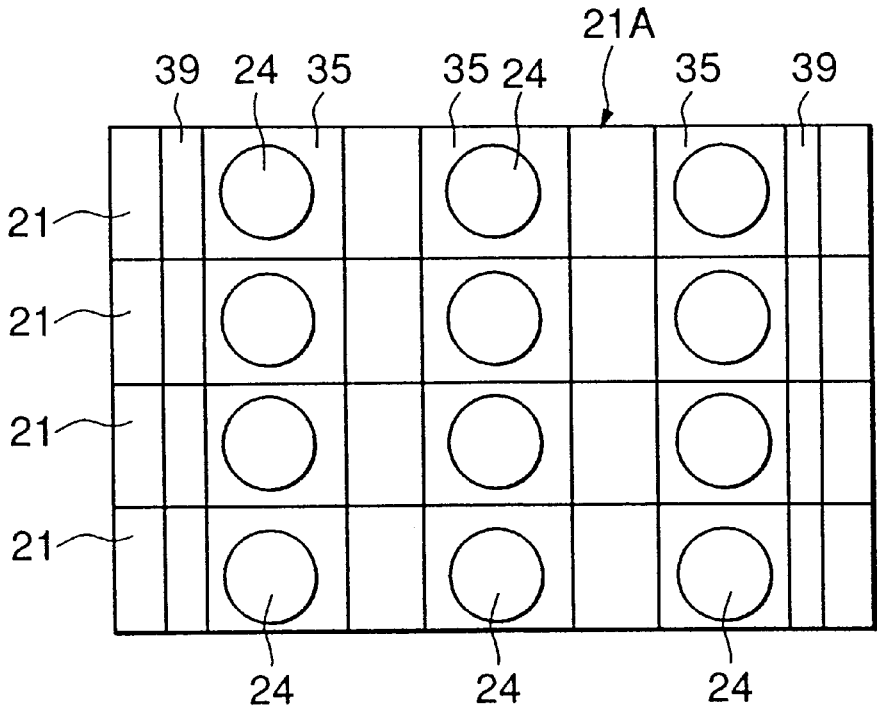
FIG. 30 is a plan view showing a manufacturing process for the cathode assembly according to the 15th embodiment.

The cathode assembly 27 having the above structure is manufactured by the following method. First of all, as shown in FIG. 30, an APBN plate member large enough to allow a plurality of insulating substrates 21 to be formed thereon side by side. More specifically, an APBN plate member 21A 15 cm long, 16 cm wide, and 0.3 mm thick is formed by the CVD method. On both surfaces of the APBN plate member 21A, 0.2-mm thick APG layers are formed on the respective portions corresponding to the insulating substrates 21 by the CVD method, thus manufacturing a wafer.

Subsequently, the APG layers are patterned after resist coating, exposure, and development. The APG layers are etched by the RIE (Reactive Ion Etching) method or the like to form an array of many heating members 25 each having an arbitrary pattern. In addition, on the other surface of the plate member 21A, the portion corresponding to each insulating substrate 21 is etched in the same manner as described above to form three APG layers 35 each having a predetermined pattern.

The notch 39 common to each insulating substrate 21 is formed in the resultant plate member 21A for insulating substrates. In this embodiment, the notch 39 is cut from the cathode base member joining surface side of each insulating substrate by an etching method such as the RIE method, but may be formed by machining.

The cathode base member 24 is fixed to the APG layer 35 of each insulating substrate 21 on the plate member 21A in the wafer state. The cathode base member 24 has a diameter of 0.8 mm and a thickness of 0.1 mm. Fixing is performed by laser brazing using a nickel brazing material. The brazing material is used because APG cannot be directly joined to a metal such as nickel.

Subsequently, a nickel paste is applied to the resultant structure at a predetermined position by screen printing or the like, and the organic solvent contained in the paste is scattered by a dryer. The resultant structure is heated in a hydrogen atmosphere at 1,320° C. to form the conductive layer 22*b* as a reaction layer formed by a reaction between APG and nickel. Each cathode base member 24 is joined to the conductive layer 22*b* by laser welding. The cathode base member formation surfaces are then subjected lapping, and the respective cathode base members 24 are leveled. The insulating substrate plate member 21A is cut into the respective insulating substrates 21 by dicing, thus forming the cathode assembly 27.

The cathode assembly 27 having the above structure is combined with the grid of each electron gun, spacers, retainers, and the like to constitute an electron gun assembly, and is mounted in the neck of the electron tube, as in the first embodiment. In this electron gun assembly, the heating member 25 is energized to generate heat to heat the cathode base member 24 through the insulating substrate 21. With this operation, the cathode base member 24 emits an electron beam. This electron beam is controlled, focused, and accelerated by the electron gun grid.

In the cathode assembly 27 having the above structure, the heating member 25 is formed on one surface of the insulating substrate 21 to form the heater, and the cathode base member 24 is formed on the other surface of the insulating substrate 21. With this structure, as in the various embodiments described above, the decreases in total length and power consumption, and the fast operation characteristics can be attained. For example, the total length of an electron gun assembly formed by using the cathode assembly 27 described above was 1.56 mm, which was smaller than that of the conventional cathode assembly by 10%.

According to the cathode assembly 27, the notches 39 are formed in the portions between the joining portions B and C of the insulating substrate 21 such that the cross-sectional area of the portion between the joining portions B and C is set to be smaller than that of each of the joining portions B and C. Therefore, the total thermal capacity of the insulating substrate 21 can be reduced. Although the insulating substrate 21 may be reduced in profile as a whole, such a decrease in profile is not preferable because the mechanical strength of the substrate decreases.

In addition, the heat dam formed by the notch 39 of the insulating substrate 21 suppresses dispersion of the heat from the heating member 25 to the joining portion B of the heater electrode terminal 26, thereby focusing the heat from the heating member 25 onto the joining portion C of the cathode base member 24. That is, this heat dam can suppress dispersion of the heat to the joining portion B that need not be heated, and focus the heat only onto the joining portion C that needs to be heated. Consequently, the heat loss caused when the heat from the heating member 25 is transmitted through the insulating substrate 21 decreases, and the power consumed by the cathode assembly can be greatly reduced.

This cathode assembly was mounted in an electron gun, and the heater power required to raise the cathode temperature to 830° C. was compared with that in the conventional cathode assembly. As a result, 2.1 W was required in the conventional cathode assembly, whereas 1.3 W was required in this embodiment. In addition, the heater power in the conventional cathode assembly was 1.05 W (6.3V/170 mA), and the heater power in the embodiment was 0.32 W (4.5V/70 mA). That is, the power in the embodiment could be reduced to about 30% of that in the conventional cathode assembly.

Furthermore, according to the cathode assembly 27 having the above structure, the heat from the heating member 25 is transmitted through the insulating substrate 21 consisting of APBN to quickly heat the cathode base member 24. For this reason, the time interval between the instant at which the heater power is turned on and the instant at which the cathode temperature reaches the temperature at which the images displayed by the electron tube are stabilized can be greatly shortened (the fast operation characteristics can be greatly improved) as compared with the conventional cathode assembly. That is, the heat from the heating member 25 is properly transmitted through the insulating substrate 21 to quickly heat the cathode base member 24.

Figure 31A:
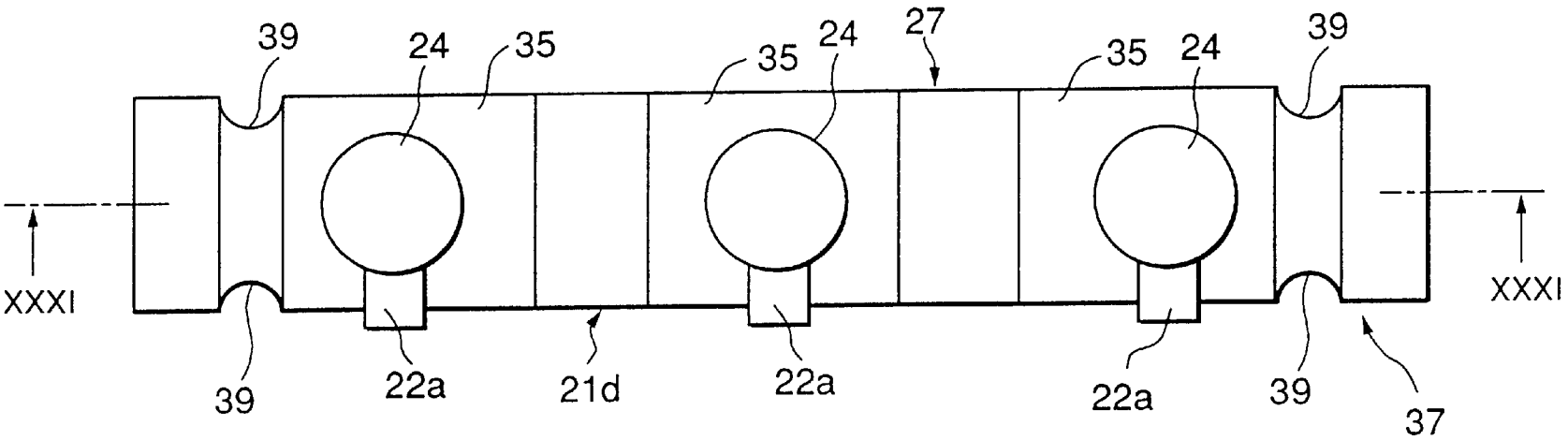
FIGS. 31A and 31B are plan and sectional views showing a cathode assembly according to a 16th embodiment of the present invention.
Figure 31B:
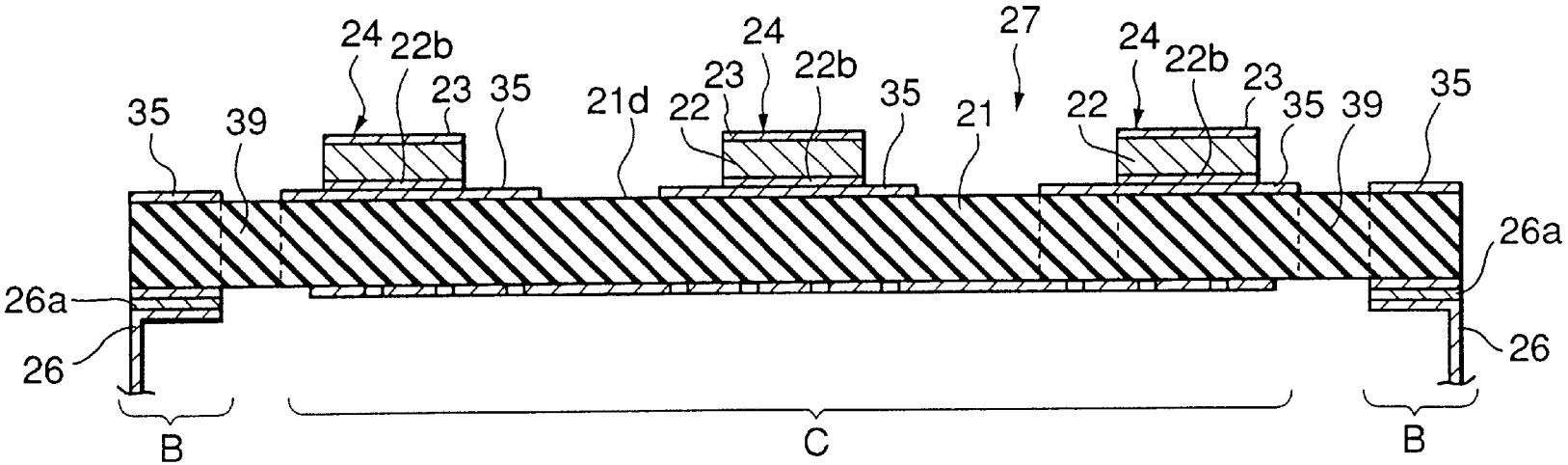

According to a cathode assembly of the 16th embodiment shown in FIGS. 31A and 31B, notches 39 are formed in the side edges of an insulating substrate 21. More specifically, a pair of notches 39 are formed in the right and left side edge portions of the insulating substrate 21, and more specifically, in the region between one joining portion B and one joining portion C of the insulating substrate 21. In addition, a pair of notches 39 are formed in the right and left side edge portions of the insulating substrate 21, and more specifically, in the region between the other joining portion B and the other joining portion C of the insulating substrate 21. Each notch 39 is formed to extend through both surfaces 21*c* and 21*d* and have a semicircular cross-section. That is, the notch 39 is formed such that its axial direction is parallel to the direction of thickness (stacking direction) of the insulating substrate 21.

Other arrangements in this embodiment are the same as those in the 15th embodiment. The same reference numerals in the 16th embodiment denote the same parts as in the 15th embodiment, and a detailed description thereof will be omitted.

Figure 32:
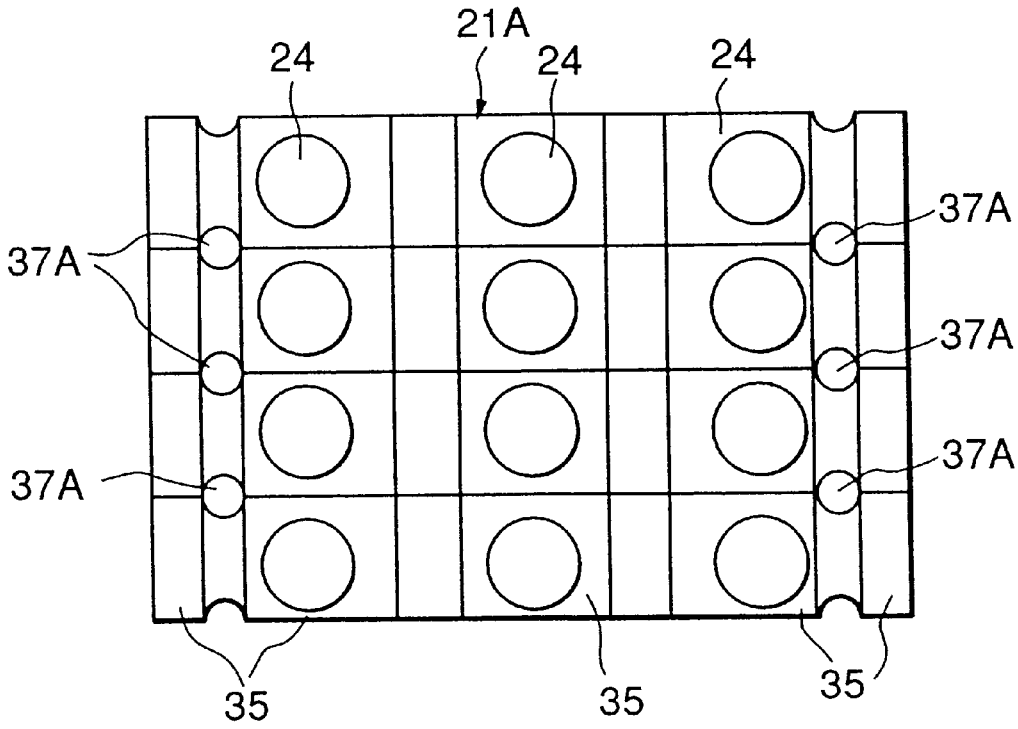
FIG. 32 is a plan view showing a manufacturing process for the cathode assembly according to the 16th embodiment.

When a cathode assembly 27 having the above structure is to be manufactured, as shown in FIG. 32, an APBN plate member 21A on which a plurality of insulating substrates 21 can be formed side by side is prepared. APG layers are formed in the respective insulating substrate regions on both surfaces of this plate member such that each APG layer has a predetermined shape. Circular through holes 39A, each having a diameter of 0.5 mm, are formed on the boundaries of the regions of the respective insulating substrates 21 on the plate member 21A, and the notches 39 of the adjacent insulating substrates 21 are formed at the same time. The subsequent steps are the same as those in the 15th embodiment, and the respective insulating substrates 21 are cut from the plate member 21A by dicing. With this process, the cathode assembly 27 having the semicircular notches 39 formed in the right and left side edge portions can be obtained.

Figure 33A:
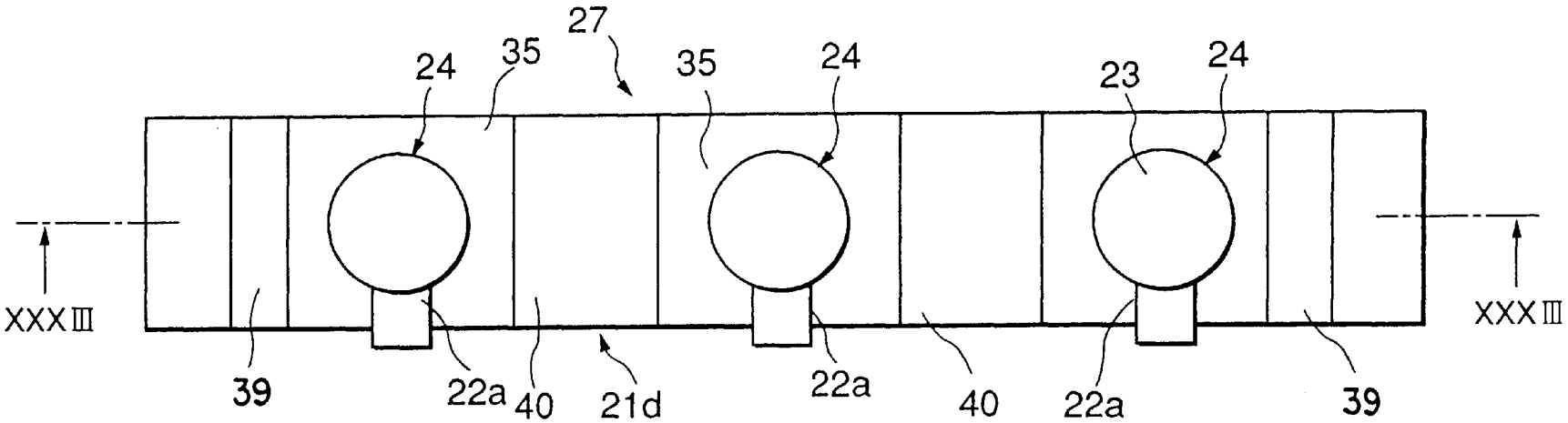
FIGS. 33A and 33B are plan and sectional views showing a cathode assembly according to a 17th embodiment of the present invention.
Figure 33B:
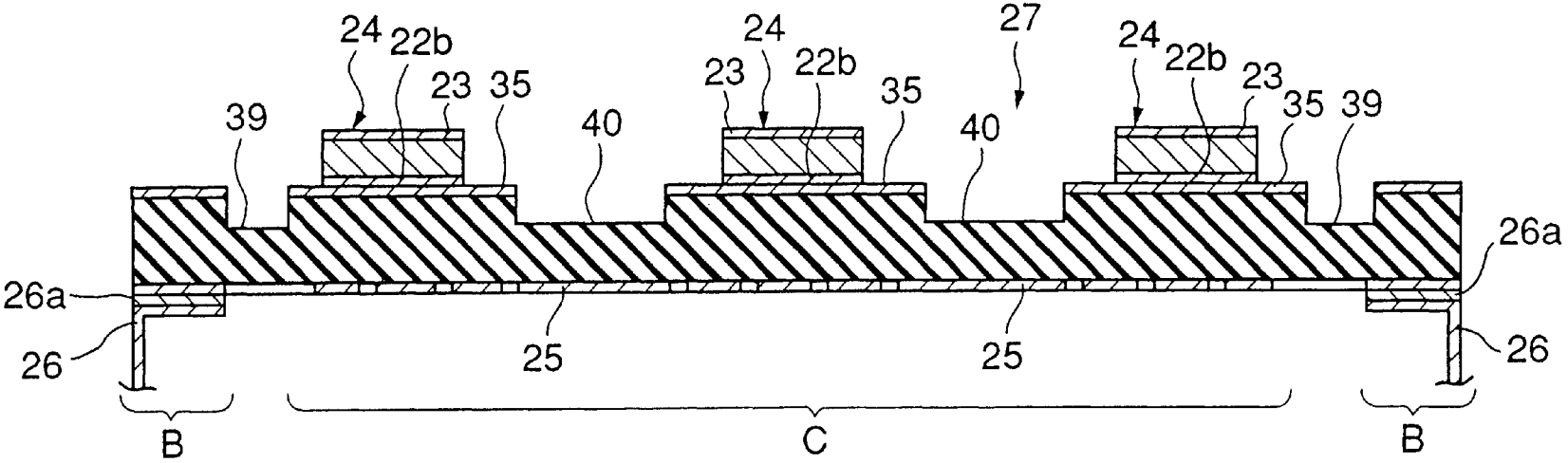

According to the 17th embodiment shown in FIGS. 33A and 33B, in addition to the notches 39 in the 15th embodiment, notches 40 similar to the notches 39 are formed between cathode base members 24. According to this structure, heat dams are formed, by the notches 40, in the regions between the cathode base members 24 on the insulating substrate 21 which need not be heated, thereby focusing the heat from a heating member 25 onto the region facing each cathode base member 24 which needs to be heated.

According to this embodiment, therefore, the heat loss caused when heat is transmitted through the insulating substrate 21 can be reduced, and the cathode base member 24 can be heated more efficiently, thus reducing the power consumed by the heating member.

In each of the 15th to 17th embodiments described above, the notches need not be formed in the cathode base member formation surface of the insulating substrate but may be formed in only the heating member formation surface or in both the surfaces as long as they are formed in the regions between the joining portions B and C.

Figure 34A:
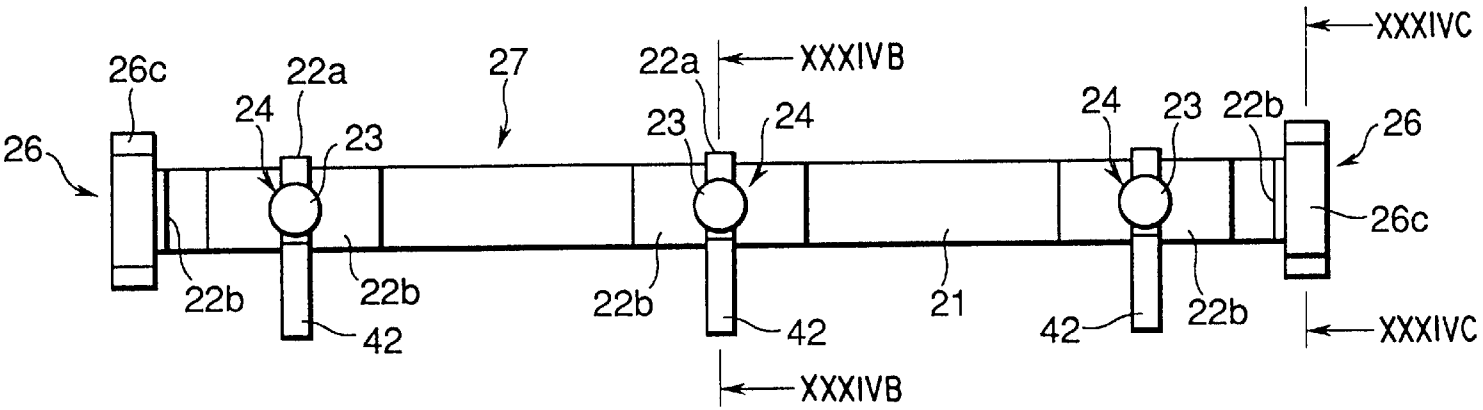
FIGS. 34A to 34C are plan and sectional views showing a cathode assembly according to a 18th embodiment of the present invention.
Figure 34C:
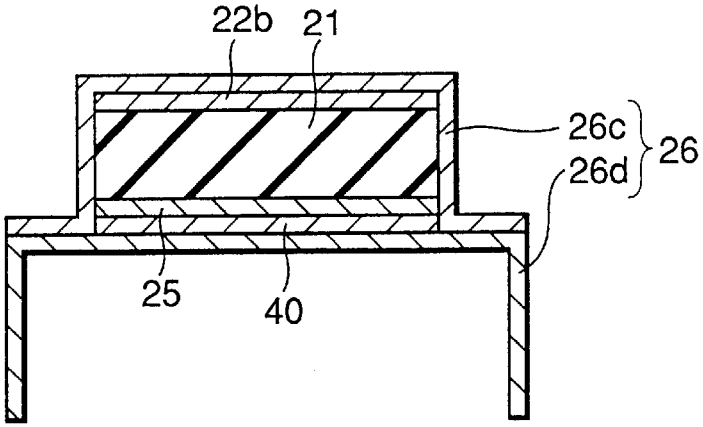
Figure 34B:
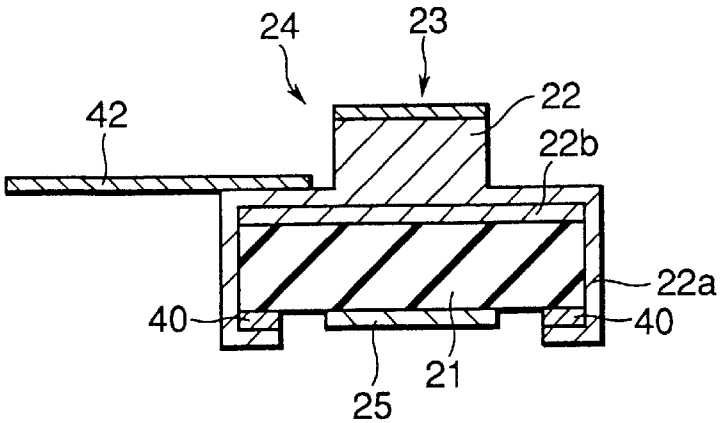

FIGS. 34A to 34C show a cathode assembly according to the 18th embodiment of the present invention. In the cathode assembly having the heater constituted by the above insulating substrate consisting of APBN and the heating member consisting of APG, the insulating substrate is manufactured by the CVD method and has a multi-layer structure. In addition, the insulating substrate is fixed to the heating member by the anchor effect. For this reason, this heater may have a relatively low strength with respect to mechanical stress.

This embodiment is therefore characterized in that the insulating substrate and the heating member are mechanically clamped by an electrode terminal extending from the cathode base member or the electrode terminal of the heating member to improve the mechanical strength of the cathode assembly.

More specifically, as shown in FIGS. 34A and 34B, a cathode assembly 27 according to this embodiment comprises an elongated rectangular insulating substrate 21 consisting of APBN and a heating member 25 consisting of APG and formed on one surface of the insulating substrate 21 to extend throughout its total length in the longitudinal direction. A heater is constituted by the insulating substrate and the heating member. The heater has a thickness of 0.32 mm, a length of 14 mm, and a width of 1 mm.

Three cathode base members 24 are arranged on the other surface of the insulating substrate 21 at predetermined intervals, e.g., 4.92-mm intervals, in the longitudinal direction of the insulating substrate 21. Each cathode base member 24 is constituted by a base metal layer 22 and an emissive material layer 23. The emissive material layer 23 has a diameter of 0.6 mm and a thickness of 0.3 mm. A metal layer 22*b* consisting of titanium is formed on a portion, of the surface of the insulating substrate 21, on which each cathode base member 24 is placed, and the cathode base member 24 is joined to the metal layer 22*b* by laser welding.

The base metal layer 22 of each cathode base member 24 integrally has a tongue piece 22*a* serving as an electrode terminal. The tongue piece 22*a* is formed to have a belt-like shape and extend from the cathode base member 24 toward the two side edges of the insulating substrate 21. For example, the tongue piece 22*a* has a thickness of 0.03 mm, a width of 0.3 mm, and a length of 0.8 mm.

The tongue piece 22*a* is bent along the two side edges of the insulating substrate from the cathode base member formation surface of the insulating substrate 21, and extends to the heating member formation surface of the insulating substrate 21. The two extended end portions of the tongue piece 22*a* are joined to the heating member formation surface of the insulating substrate 21 through a metal layer 40 consisting of titanium. The insulating substrate 21 and the metal layer 22*b* are therefore held by the tongue piece 22*a* from the two surface sides in a clamped state. Note that an electrode lead 42 is joined to the tongue piece 22*a*. As the tongue piece 22*a* and the cathode base member 24, discrete components which are formed independently may be joined to each other.

As shown in FIGS. 34A to 34C, the metal layers 40 consisting of titanium are formed on the two longitudinal end portions of the heating member 25, and the metal layers 22*b* consisting of titanium are formed on the two longitudinal end portions of the cathode base member formation surface of the insulating substrate 21. The electrode terminals 26 are welded/fixed to the two ends of the heating member 25 through the metal layers 40.

In this embodiment, each electrode terminal 26 is constituted by a combination of two belt-like terminals 26*c* and 26*d*. The belt-like terminal 26*c* is welded/fixed to the metal layer 22*b*, located on the cathode base member formation surface of the insulating substrate 21, and bent along the two side edges of the insulating substrate 21 to extend to the other surface of the insulating substrate 21. The belt-like terminal 26*d* is welded/fixed to the metal layer 40 and the belt-like terminal 26*c* and extends downward by a predetermined length.

The two longitudinal end portions of the heating member 25 and the two longitudinal end portions of the insulating substrate 21 are held by the electrode terminal 26 from the two sides in a clamped state.

The cathode assembly 27 having the above structure is manufactured by the following method. First of all, APBN and APG layers are formed in a stacked state by the CVD method. A heating member is formed on the insulating substrate by the RIE method. The resultant structure is then diced into heaters. Metal layers are formed by screen printing on only the portions on which cathode base members and heater electrode terminals are formed. After screen printing of the metal layers, the insulating substrate is heat-treated in a vacuum atmosphere. Thereafter, the resultant structure is sized. In this embodiment, a 50×50 mm insulating substrate was formed, and about 150 heaters were obtained.

Subsequently, cathode base members and tongue pieces are mounted on the metal layers, and the tongue pieces are bent along the shapes of the heaters to clamp the heaters. The cathode base members and the metal layers are joined to each other by laser welding. In addition, electrode leads are welded to the tongue pieces at predetermined positions. Note that the cathode base members need not always be joined to the insulating substrate by laser welding, but may be joined thereto by brazing, TIG welding, or the like.

Heater electrode terminals are fixed to the two longitudinal end portions of each heater by laser welding, and the two end portions of the heater are clamped by the heater electrode terminals. Finally, the surface of each base metal layer 22 is coated with the emissive material layer 23 to complete a cathode assembly.

According to the cathode assembly 27 having the above structure, the decreases in total length and power consumption, and the fast operation characteristics can be attained, as in the above embodiments. In addition, since the insulating substrates and the heating members are clamped by the electrode terminals of the cathode base members and the heater electrode terminals, separation between the cathode base members, the insulating substrates, the heating members, and the electrode terminals can be prevented, thereby greatly increasing the mechanical strength of the cathode assembly.

Figure 35A:
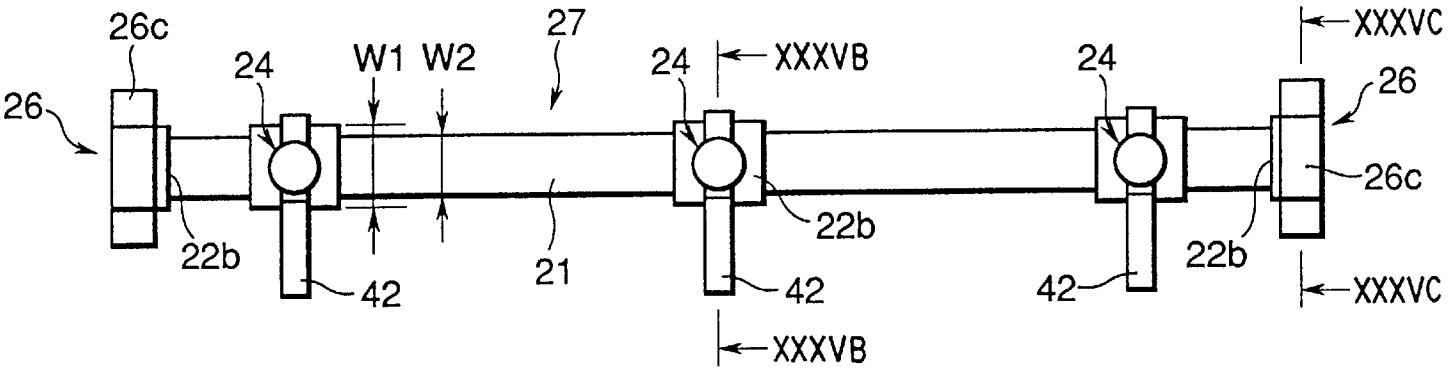
FIGS. 35A to 35C are plan and sectional views showing a cathode assembly according to a 19th embodiment of the present invention.
Figure 35C:
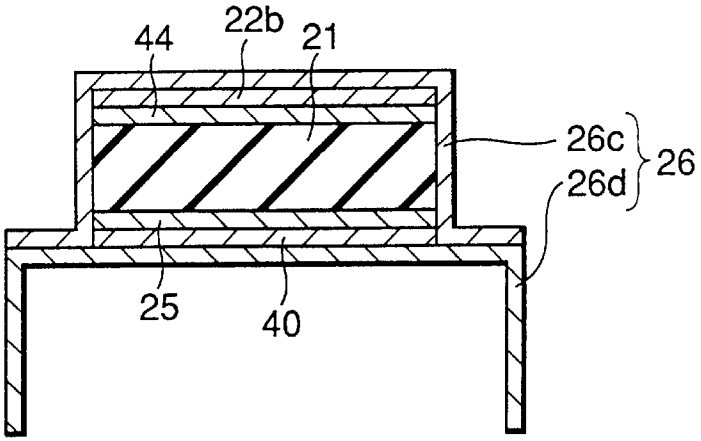
Figure 35B:
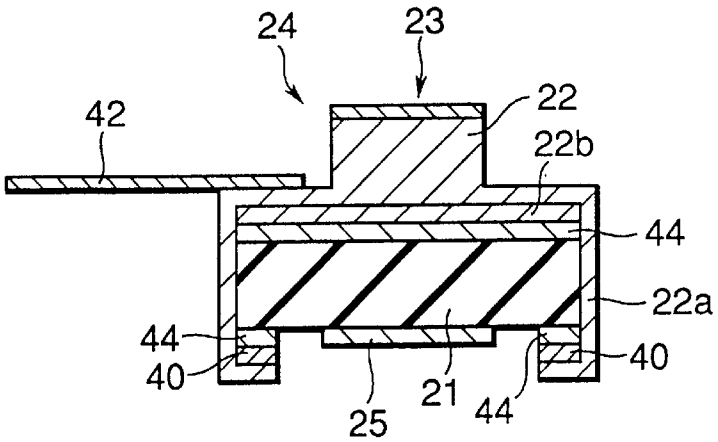

FIGS. 35A and 35C shows a cathode assembly according to the 19th embodiment of the present invention. A cathode assembly 27 of this embodiment is the same as that of the 19th embodiment except that APG layers 44 are additionally formed between the metal layers 22*b* and 40 and the insulating substrate 21.

More specifically, the APG layers 44 are formed on portions, of the insulating substrate 21, on which three cathode base members 24 and heater electrode terminals 26 are formed. The metal layers 22*b* and 40 are respectively formed on the corresponding APG layers 44. As each metal layer, a nickel layer is used.

According to this embodiment, a width W1 of the portion, of the insulating substrate 21, on which the APG layer 44 is formed is set to be larger than a width W2 of the remaining portion of the insulating substrate 21, resulting in a convex shape. Other arrangements are the same as those in the 18th embodiment, and the same reference numerals in the 19th embodiment denote the same parts as in the 18th embodiment.

In the 19th embodiment having the above structure, the same effects as those in the 18th embodiment can be obtained. In addition, in this embodiment, the portions, of the insulating substrate 21, to which the three cathode base members 24 are fixed and the electrode terminals 26 are joined are formed into the convex shapes, and the remaining portion is thinned. With this structure, the total thermal capacity of each heater can be reduced to attain a further decrease in power consumption and better fast operation characteristics.

Table 6 shows the result obtained by measuring the joining strengths of the above cathode assemblies. In strength measurement, a tensile test was performed, and a tensile strength was represented by a breaking load. When the breaking strength of a cathode assembly in which the heaters are not clamped by the electrode terminals was regarded as a reference value of 1, as is apparent from Table 6, it was confirmed that the tensile strength in both the 18th and 19th embodiments was increased by five times or more.

TABLE 6

Joining strength test result

| | | Breaking strength ratio |
|---|---|---|
| Base member | 18th embodiment | 5 |
| metal | 19th embodiment | 5 |
| Heater | 18th embodiment | 8 |
| electrode lead | 19th embodiment | 8 |

FIGS. 36 to 38C show a cathode assembly according to the 20th embodiment of the present invention. This embodiment differs from the above embodiment in the heater electrode terminals and the structure of the heating member. In addition, the 20th embodiment has a holder for supporting the cathode assembly, unlike the above embodiment.

Figure 36:
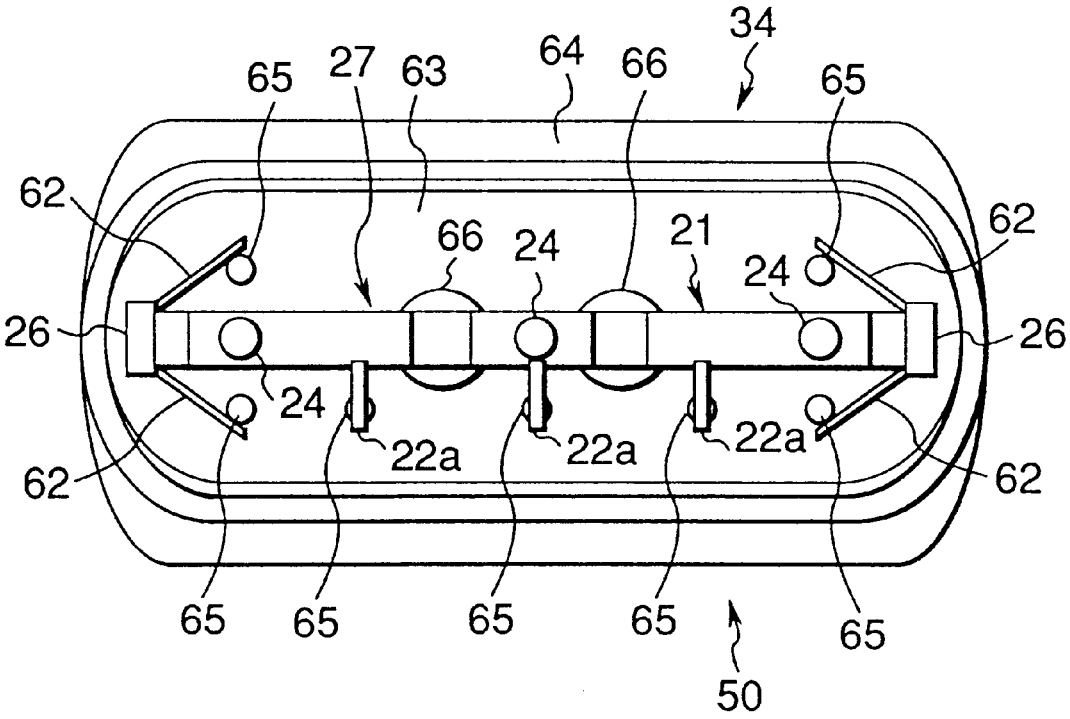
FIG. 36 is a plan view of an electron gun assembly according to a 20th embodiment of the present invention.
Figure 37:
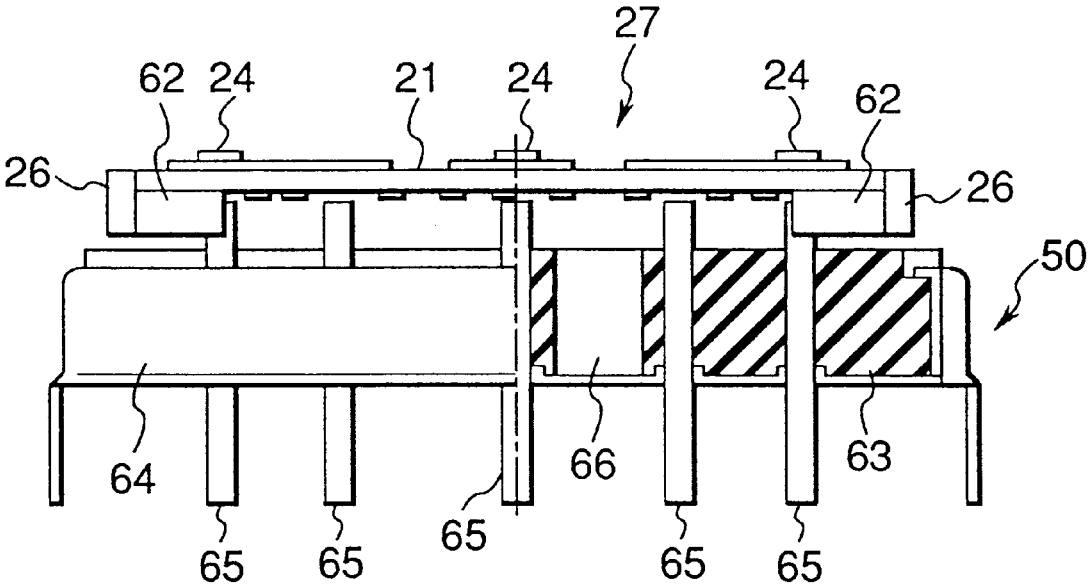
FIG. 37 is a partially cutaway side view of the electron gun assembly according to the 20th embodiment.

More specifically, as shown in FIGS. 36 and 37, an electron gun assembly 34 comprises a cathode assembly 27 having three cathode base members 24, and a holder 52 which holds the cathode assembly 27.

Figure 38A:
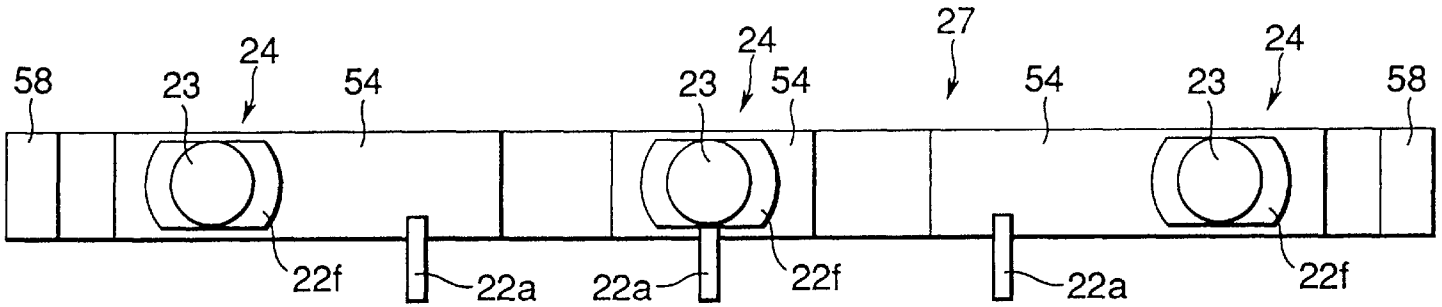
FIGS. 38A to 38C are plan, sectional, and rear views showing the cathode assembly of the electron gun assembly according to the 20th embodiment.
Figure 38B:
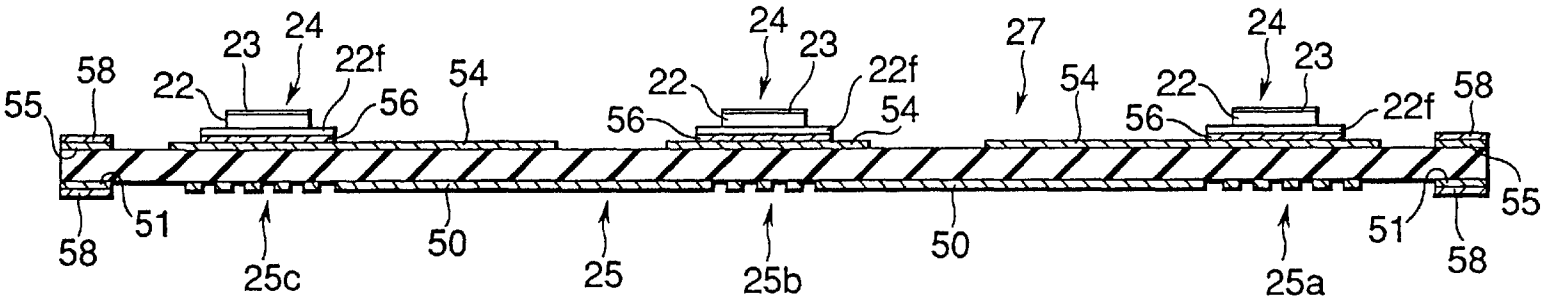
Figure 38C:
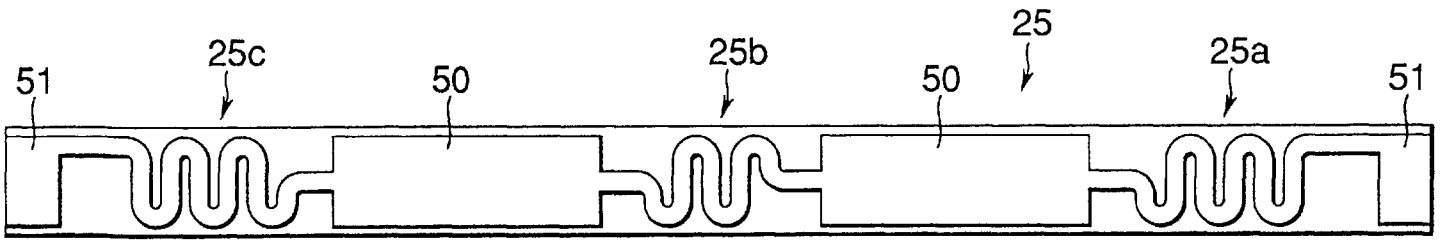

The structure of the cathode assembly 27 will be described in detail first. As shown in FIGS. 38A to 38C, the cathode assembly 27 comprises an elongated, rectangular insulating substrate 21 consisting of APBN, and a heating member 25 consisting of APG and formed on one surface of the insulating substrate 21 throughout its total length in the longitudinal direction. A heater is constituted by the insulating substrate 21 and the heating member 25. The insulating substrate 21 is formed by the CVD method to have a width of 1 mm, a length of 14 mm, and a thickness of 0.3 mm.

The heating member 25 is formed by forming a 0.02-mm thick APG layer on one surface of the insulating substrate 21 by the CVD method, and patterning the APG layer by the same method as that in the above embodiments described above. The heating member 25 has first to third heating portions 25*a*, 25*b*, and 25*c* which generate heat upon energization, a pair of non-heating portions 50 formed between the heating portions 25*a*, 25*b*, and 25*c*, and a pair of electrodes 51 formed on the two longitudinal end portions of the insulating substrate 21.

The first to third heating portions 25*a*, 25*b*, and 25*c* are positioned to oppose the three cathode base members 24. Each heating portion has a zigzag pattern with a line width of 0.12 mm and a 0.12-mm space being ensured between the folded portions. Since the portions, of the insulating substrate 21, other than the portions on which the cathode base members 24 are formed need not be heated, the pair of non-heating portions 50 and the pair of electrodes 51 are formed wide to have almost the same line width as that of the insulating substrate 21, thereby suppressing generation of heat upon energization. The cathode base members 24 can therefore be efficiently heated by the first to third heating portions 25*a*, 25*b*, and 25*c*.

In a color electron tube, in order to make the electron beams emitted from the three cathode base members 24 uniform, these cathode base members must be heated at the same operating temperature. According to the heating member 25 having the above structure, heat tends to escape from the two longitudinal end portions of the insulating substrate 21. For this reason, each of the first and third heating portions 25*a* and 25*c* formed on the two longitudinal end portions of the insulating substrate 21 is longer than the second heating portion 25*b* located in the middle to generate a larger amount of heat than the second heating portion.

On the portions, of the other surface of the insulating substrate 21, on which three cathode base members 24 are formed, 0.02-mm thick APG layers 54 are formed at predetermined intervals. Similarly, 0.02-mm thick APG layers 55 are formed on the two longitudinal end portions of the insulating substrate 21 to leave predetermined spaces from the APG layers 54.

The cathode base members 24 are respectively formed on the three APG layers 54 50 and arranged at predetermined intervals, e.g., 4.92-mm intervals, in the longitudinal direction of the insulating substrate 21. Each cathode base member 24 is constituted by a base metal layer 22 consisting of nickel and an emissive material layer 23 formed on the upper surface of the metal layer. The base metal layer 22 is formed to have a diameter of 0.8 mm and a thickness of 0.1 mm, and integrally has a 0.05-mm thick flange 22*f* extending along the longitudinal direction of the insulating substrate 21. Note that as the cathode base member 24, an impregnated cathode base member obtained by impregnating a porous base metal layer with an emissive material may be used.

Each cathode base member 24 is joined to the APG layer 54 through a conductive layer 56. More specifically, a portion, of the APG layer 54, to which the cathode base member 24 is to be joined is coated with a nickel paste film having a thickness of about 0.02 mm, and the paste is dried in advance. The resultant structure is heat-treated in a hydrogen atmosphere at 1,320° C. to form the conductive layer 56 consisting of a reaction layer formed by a reaction between APG and Ni. Each cathode base member 24 is fixed to the APG layer 54 by joining the flange 22*f* of the base metal layer 22 to the conductive layer 56 by laser welding.

An electrode terminal 22*a* for applying voltage to the cathode base member 24 is joined to each APG layer 54 and extends from a side edge of the insulating substrate 21. Each electrode terminal 22*a* may be joined to the flange 22*f* of the base metal layer 22. Note that conductive layers 58, each consisting of a reaction layer formed by a reaction between APG and Ni, are formed on the surfaces of the APG layer 55 and the surfaces of the electrodes 51 of the heating member 25 by the same method as described above.

Figure 39:
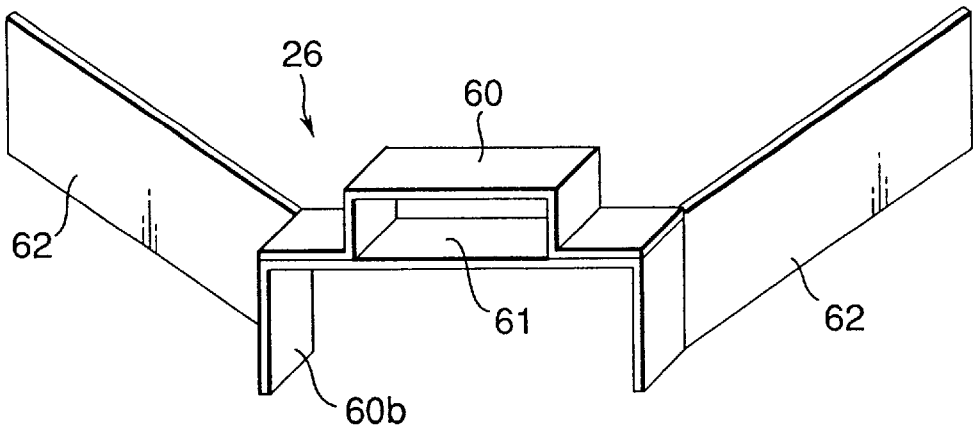
FIG. 39 is a perspective view of the electrode terminal of the cathode assembly according to the 20th embodiment.
Figure 40:
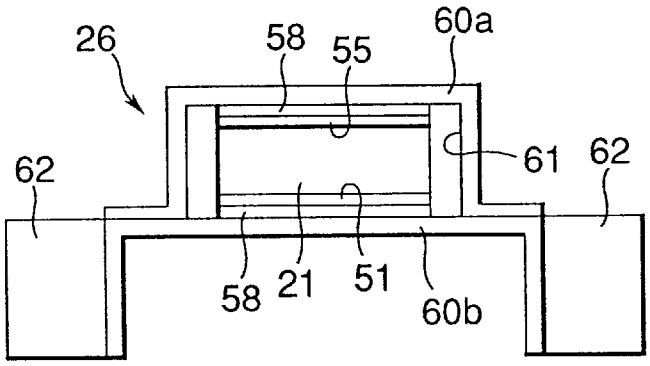
FIG. 40 is a front view of the electrode terminal.

As shown in FIGS. 36 and 37, electrode terminals 26 are fixed to the pair of electrodes 51 formed on the two end portions of the insulating substrate 21. As shown in FIGS. 39 and 40, each electrode terminal 26 is integrally formed by joining first and second terminal plates 60*a* and 60*b*, each of which is bent in a substantially U-shaped form. The first terminal plate 60*a* has a rectangular recess 61 into which an end portion of the insulating substrate 21 can be inserted. The second terminal plate 60*b* has two arms 62 extending in a direction to spread toward the other heater electrode terminal.

The first and second terminal plates 60*a* and 60*b* preferably have small thermal capacities, exhibit good workability, and have high mechanical strength. For this reason, each terminal plate preferably consists of an alloy containing nickel as a major component, e.g., stainless steel, Koval (KOV), or Hastelloy. In this embodiment, each terminal plate is made of a 0.05-mm thick KOV member.

This electrode terminal 26 is fixed to the insulating substrate 21 in the following steps. First of all, an end portion of the insulating substrate 21 is inserted into the recess 61 of the first terminal plate 60*a*, and the central portion of the first terminal plate is joined to the conductive layer 58 formed on the cathode base member formation surface of the insulating substrate 21 by laser welding. The central portion of the second terminal plate 60*b* is joined to the conductive layer 58 formed on the electrode 51 of the heating member 25 by laser welding. Thereafter, the first and second terminal plates 60*a* and 60*b* are coupled to each other by laser welding to cause these terminal plates to clamp the end portion of the insulating substrate 21 from the outside. With the above steps, mounting of the electrode terminal 26 is complete.

The cathode assembly 27 having the above structure is mounted on the holder 52 through the arms 62 of the electrode terminals 26. As shown in FIGS. 36 and 37, the holder 52 comprises a substantially rectangular base plate 63 made of a 2.5-mm thick ceramic member, a support frame 64 consisting of KOV and fixed to the outer surface of the base plate 63, and a plurality of support pins 65 fixed to the base plate 63 and extending from both surfaces of the base plate 63.

The support frame 64 and the support pins 65 consist of KOV. Each support pin 65 has a diameter of 0.5 mm. The support frame 64 and the support pins 65 are joined to the base plate 63 in an electrically insulated state with molten glass. For example, a pair of exhaust holes 66 are formed through the base plate 63. These exhaust holes 66 serve to efficiently exhaust the cracked gas emitted from the emissive material of the cathode base member 24 while the electron tube is evacuated.

The cathode assembly 27 is mounted on the holder 52 such that the pair of arms 62 of each heater electrode terminal 26 are welded to the corresponding pair of support pins 65, and the electrode terminal 22*a* of each cathode base member 24 is welded to the corresponding support pin 65. The heater constituted by the insulating substrate 21 and the heating member 25 is parallel and opposite to the base plate 63 of the holder 52 through a predetermined space. The holder 52 supports the cathode assembly 27, and also has the function of improving the thermal efficiency by causing the ceramic base plate 63 to reflect the heat generated by the heater to the cathode assembly side.

According to the electron gun assembly having the above structure, the distance from the surface of the cathode base member 24 to the surface of the base plate 63 is 1.5 mm, and the overall height is 6.5 mm.

A method of manufacturing cathode assemblies for the electron gun assembly having the above structure will be described in detail next. Assume that in this method, each cathode assembly includes an impregnated cathode base member, and uses a reaction layer formed by a reaction between an APG layer and tungsten as a conductive layer. In addition, in the method, a plurality of cathode assemblies are manufactured at the same time as in the case with the manufacture of semiconductor wafers.

Figure 41A:
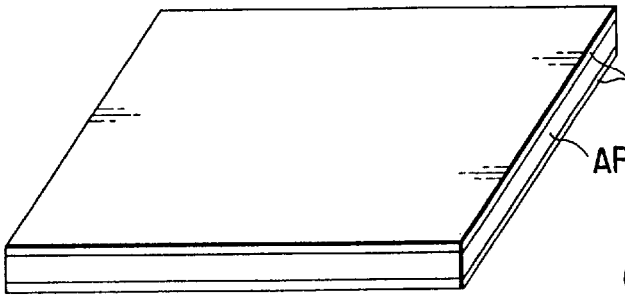
FIGS. 41A to 41E are perspective views schematically showing the steps in manufacturing the cathode assembly according to the 20th embodiment.

As shown in FIG. 41A, a 0.3-mm thick APBN substrate is formed by the thermal LPCVD method. More specifically, boron chloride and ammonium are caused to react with each other in a reduced pressure atmosphere to form APBN on a graphite substrate heated at about 2,000° C. by vapor phase epitaxy. Thereafter, 0.02-mm thick APG layers are formed on both surfaces of the above APBN substrate by vapor phase epitaxy. More specifically, hydrocarbon is decomposed in a reduced pressure atmosphere to form PG on the APBN substrate heated at about 2,000° C. by vapor phase epitaxy.

Figure 41B:
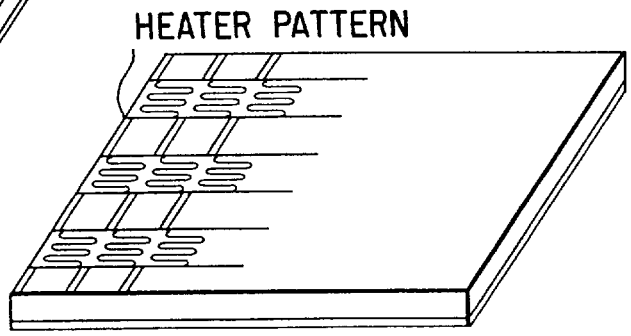

As shown in FIG. 41B, one APG layer is exposed, developed, and etched to form a heating member having a predetermined pattern. More specifically, the resist film covering the APG layer is exposed into a predetermined patter, and developed. Thereafter, the resultant structure is etched into a desired pattern by the reactive ion etching method (RIE method) using a carbon-fluoride-based gas. A heating member is completed by removing the residual resist film.

Figure 41C:
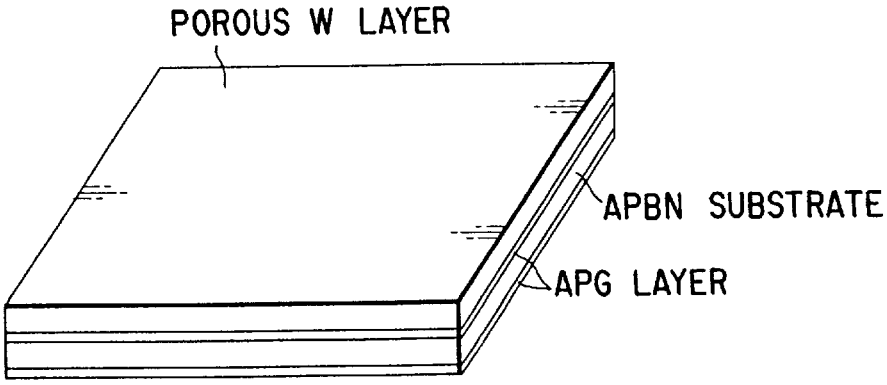

As shown in FIG. 41C, the other APG layer is coated with a paste obtained by mixing a W powder having an average particle size of 3 $\mu$m with an organic binder by the screen printing method, the spin coating method, the spraying method, or the like. The applied W powder is then heated at 1,700 to 1,800° C. in a vacuum to obtain a sintered layer with a porosity of about 20%. The thickness of the sintered layer is set to 0.21 mm.

Figure 41D:
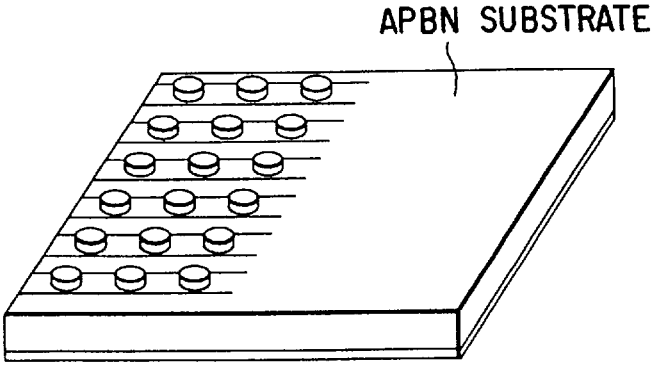

After a resist layer is formed on the porous W layer formed in the above manner, the exposure, development, and etching steps are performed in accordance with the pattern of the cathode base member shown in FIGS. 38A to 38C to form the desired cathode base member patterns. The residual resist is removed to complete the cathode base members, as shown in FIG. 41D.

After the resultant structure is masked except for the cathode base members, the surface of each cathode base member is coated with an emissive material dispersed in an organic solvent by the spraying method. The overall substrate is the heated at 1,650° C. in a vacuum to melt the emissive material applied on each cathode base member and impregnate the pores of each cathode base member with the emissive material, thereby obtaining an impregnated cathode base member.

The surfaces of the respective impregnated cathode base members are lapped such that the precision in the height of each impregnated cathode base member falls within ±1 $\mu$m. Thereafter, the surface of each cathode base member is coated with 1,500-Å thick Ir film by the sputtering method. As this coating material, Os (osmium), Os—Ru, $Sc_2O_3$, or $Sc_2O_3$—W may be used.

Figure 41E:
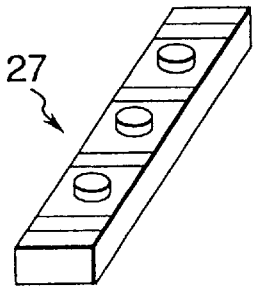

Subsequently, as shown in FIG. 41E, the substrate manufactured in the above manner is divided into cathode assemblies by dicing, and heater electrode terminals are mounted on the cathode assemblies, thereby completing the cathode assemblies.

The following effects can be obtained by the cathode assembly and the electron gun assembly having the above structure according to the 20th embodiment.

First of all, according to this embodiment, similar to the embodiments described above, the decreases in total length and power consumption, and the fast operation characteristics can be attained. If, for example, an electron gun is formed by the electron gun assembly according to the 20th embodiment, the total length can be decreased from 14.5 mm (prior art) to 7 mm, i.e., by 50%. In addition, the heater power required to raise the cathode assembly temperature to 1,000° C. is 2.1 W in the prior art, and 1.7 W in this embodiment. That is, the power consumption can be reduced by 20%. Furthermore, the time interval between the instant at which the heater power is turned on and the instant at which the cathode temperature reaches the stable temperature (1,000° C.) is 10 seconds in the prior art. In contrast to this, according to the cathode assembly of the 20th embodiment, it takes six seconds to reach the stable temperature.

In the conventional cathode assembly, the heater voltage and current are 6.3V and 333 mA, respectively. In contrast to this, in the cathode assembly of this embodiment, the heater voltage and current are 6.3V and 270 mA, respectively. The voltages and currents in both the cathode assemblies comply with those in the heater circuit of a cathode ray tube.

Variations in the spaces between the first grids and the cathode base members in the three cathode assemblies must be eliminated to obtain uniform characteristics. According to this embodiment, since the three cathode base members are rubbed to make their heights uniform, high precision can be attained, and uniform characteristics can be obtained.

The electron gun assembly according to this embodiment was mounted in an electron tube, and a fife test of 3,000 hours was performed while the heater voltage was set to 135%. For comparison, the conventional cathode and a cathode coated with a thin tungsten film by sputtering were simultaneously tested.

In measurement, the initial heater voltage was fixed, and changes in heater current during the test were monitored.

The rate of change in heater current after a lapse of 3,000 hours was 2.0% in the conventional cathode; and 1.9%, in this embodiment. Heater disconnection occurred in the cathode coated with the thin tungsten film after a lapse of 500 hours in the life test. As is apparent from the above result, the cathode assembly of the embodiment has almost the same service life characteristics as those of the conventional cathode.

In addition, according to this embodiment, since a plurality of cathode assemblies are formed on a substrate, and divided afterward, as in the case with the manufacture of semiconductor chips, a large number of cathode assemblies can be manufactured at once, thus improving the productivity.

Furthermore, according to this embodiment, the heating member formed on the insulating substrate includes the heating portions opposing the cathode base members, and the non-heating portions located between the heating portions. The non-heating portions are formed wide to suppress generation of heat. Of the three heating portions, the heating portions on the two sides, from which heat tends to escape, are formed to generate heat more than the central heating portion. The three cathode base members can therefore be heated efficiently and uniformly.

Various embodiments, in each of which a cathode base member and a first grid are integrally formed to keep the space between the cathode base member and the grid with high precision, will be described below.

Figure 42:
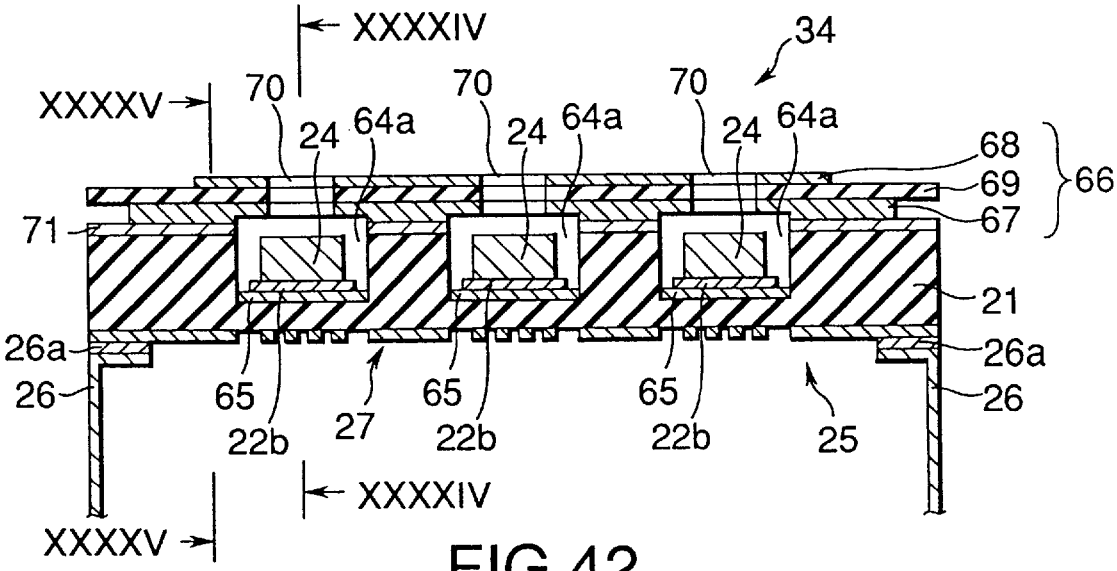
FIG. 42 is a sectional view of an electron gun assembly according to a 21st embodiment of the present invention.
Figure 43A:
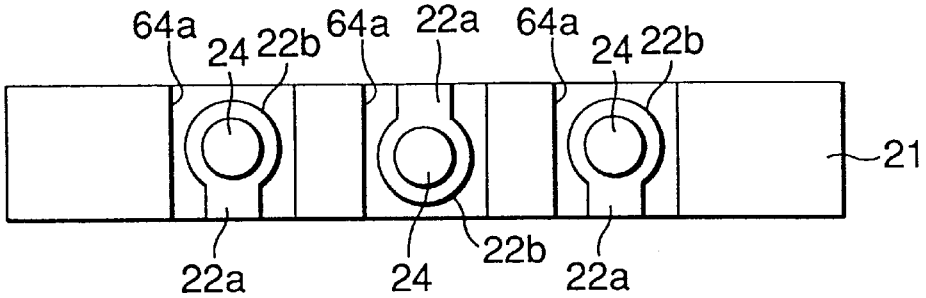
FIGS. 43A to 43D are plan and sectional views showing the structure of the respective components of the electron gun assembly.
Figure 43B:
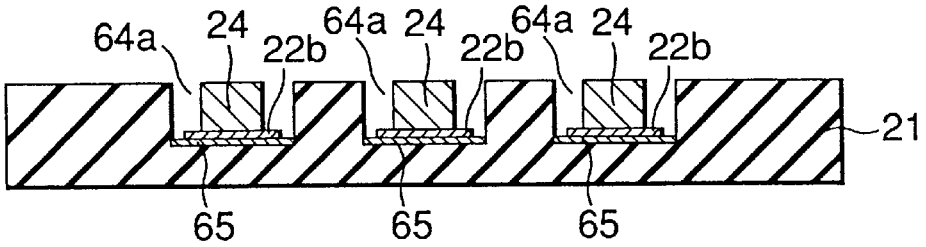
Figure 43C:
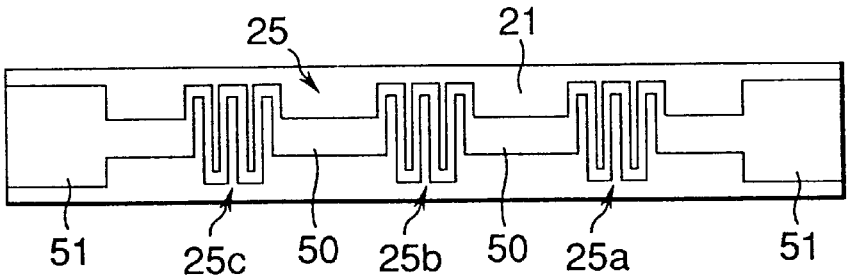
Figure 43D:
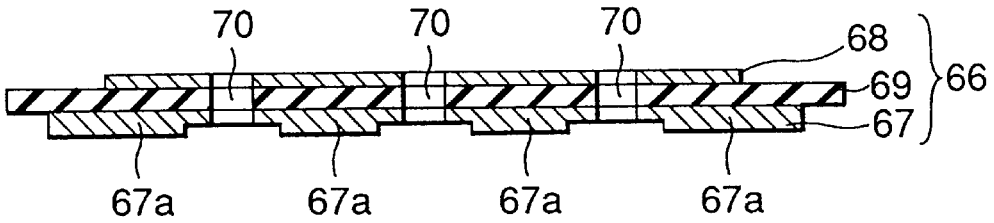

As shown in FIGS. 42 to 43D, an electron gun assembly 34 according to the 21st embodiment of the present invention comprises a cathode assembly 27 and a grid unit 66 fixed to the cathode assembly 27.

The cathode assembly 27 includes an insulating substrate 21 consisting of APBN. This insulating substrate 21 is formed into a rectangular shape 8 mm long, 1.5 mm wide, and 0.7 mm thick. Three recesses 64*a* are formed in one surface of the insulating substrate 21 at predetermined intervals along the longitudinal direction of the insulating substrate 21. Each recess 64*a* extends in a direction perpendicular to the longitudinal direction of the insulating substrate 21.

A cathode base member 24 is placed in each recess 64*a* of the insulating substrate 21. This cathode base member 24 is made of a nickel powder and an emissive material in the form of a pellet having a diameter of 0.6 mm and a thickness of 0.5 mm. The cathode base member 24 is manufactured as follows. For example, a nickel powder and an emissive material are mixed at a composition ratio of 70:30. This mixture is sufficiently stirred and pressurized at 10 tons/cm$^3$ to be formed into a pellet. In this case, about 2% paraffine is preferably mixed with the mixture to hold the shape of the cathode base member 24 after pressing. This cathode base member is a so-called molded cathode.

Each cathode base member 24 is joined to the bottom surface of each recess 64*a* through an APG layer 65 and a metal layer 22*b* consisting of nickel. The metal layer 22*b* is formed to have a diameter of 0.9 mm and a thickness of 0.005 mm. While the cathode base member 24 is joined to the bottom surface of the recess 64*a*, the upper surface of the cathode base member 24 is located to be flush with the surface of the insulating substrate 21. An electrode terminal 22*a* is joined to each cathode base member 24.

A heating member 25 formed by patterning an APG layer is formed on the other surface of the insulating substrate 21. The heating member 25 includes first to third heating portions 25*a*, 25*b*, and 25*c* which generate heat upon energization, a pair of holders 50 formed between the heating portions 25*a*, 25*b*, and 25*c*, and a pair of electrodes 51 formed on the two longitudinal end portions of the insulating substrate 21.

The first to third heating portions 25*a*, 25*b*, and 25*c* are positioned to oppose the three cathode base members 24. Each heating portion has a zigzag pattern with a line width of 0.12 mm and a 0.1-mm space being ensured between the folded portions. Since the portions, of the insulating substrate 21, other than the portions on which the cathode base members 24 are formed need not be heated, the pair of holders 50 and the pair of electrodes 51 are formed wide to have almost the same line width as that of the insulating substrate 21, thereby suppressing generation of heat upon energization.

An electrode terminal 26 is joined to each electrode 51 of the heating member 25 through a metal layer 26*b* consisting of titanium or the like.

The grid unit 66 of the electron gun, which is mounted on the cathode assembly 27, is formed by integrally stacking a first grid 67, a second grid 68, and a spacer 69 consisting of an electric insulating layer sandwiched between the first and second grids. Each of the first and second grids 67 and 68 consists of APG and is formed into a plate-like shape. The spacer 69 consists of APBN. For example, the spacer 69 has a thickness of 0.1 mm and serves to electrically insulate the first grid 67 from the second grid 68.

The grid unit 66 is joined to the cathode assembly 27 while the first grid 67 is in contact with the upper surface of the insulating substrate 21. Joining portions 67*a*, of the first grid 67, which are joined to the insulating substrate 21 are formed thicker than the remaining portion to extend therefrom. Each joining portion 67*a* also serves as a spacer for keeping the distance between the cathode assembly 27 and the grid unit 66 with high precision with respect to the design dimensions. The protrusion height of each joining portion 67*a* as the spacer is 0.1 mm. Through holes 70 for allowing electron beams emitted from the cathode base members 24 to pass therethrough are formed in the portions, of the grid unit 66, which oppose the three cathode base members 24.

The grid unit 66 having the above structure is fixed to the cathode assembly 27 by joining the joining portions 67*a* of the first grid 67 to the surface of the insulating substrate 21 through a metal layer 71.

A method of manufacturing the electron gun assembly 34 having the above structure will be described next. First of all, the cathode assembly 27 is manufactured as follows. As in the embodiments described above, after an insulating substrate consisting of APBN is formed, recesses having a uniform depth of 0.5 mm±1 $\mu$m are formed in one surface of the insulating substrate with high precision. An APG layer is formed on the other surface of the insulating substrate, and patterned into a heating member.

Subsequently, an APG layer and a nickel layer are sequentially formed on the bottom surface of each recess of the insulating substrate. The resultant structure is heated at about 1,300° C. in a hydrogen atmosphere or a vacuum to form a nickel layer on the APG layer. The cathode base member 24 is fixed to each nickel layer by laser welding.

For this metal layer, one material selected from the group consisting of Ni, Ti, Mo, W, Nb, Ta, and an alloy containing any one of them can be used. As a method of forming the metal layer, one of various thick film forming methods, e.g., a method of forming a thick film by forming a powder coat and heating it at a high temperature or one of various thin film forming methods, e.g., the deposition method and the sputtering method can be used.

After the cathode base members 24 are fixed to the insulating substrate 21 in this manner, lapping is performed such that the upper surfaces of the cathode base members 24 are flush with the surface of the insulating substrate. In this case, if, for example, a plurality of cathode base members 24 are fixed to a large substrate having a diameter of about 20 cm, and are simultaneously subjected to lapping, a plurality of cathode assemblies with uniform dimensions can be manufactured at once. That is, this method is suitable for mass production. In addition, the spaces between the first grids and the cathode base members can be adjusted with high precision.

A method of manufacturing the grid unit 66 will be described next. As in the case with the insulating substrate 21 described above, an APBN substrate having a predetermined thickness and serving as the spacer 69 is formed first. The first and second grids 67 and 68 consisting of APG are then formed on the respective surfaces of the APBN substrate by the CVD method. In order to form the joining portions 67*a* on the surface of the first grid 67 in the form of projections, a protective film having a reverse pattern to that of the joining portions 67*a* is formed on the first grid 67 first, and RIE is then performed to thin the regions, of the first grid 67, which oppose the cathode base members. Thereafter, the protective film is removed by an arbitrary means. The through holes 70 are formed in the first and second grids and the spacer by the same method as described above.

In this case, when holes having different diameters or shapes are to be formed in the first and second grids, through holes having different shapes can be formed by separating etching the first and second grids. Note that the through holes 70 can also be formed by machining.

With the above steps, the integrated grid unit 66 having the first and second grids 67 and 68 and the spacer 69 consisting of an electrically insulating material and stacked therebetween is manufactured.

Such grid units may be manufactured one by one by the above manufacturing method. Alternatively, a plurality of grid units may be simultaneously formed on an APBN substrate having a diameter of about 20 cm, and the substrate may be divided into the grid units afterward. By this method, grid units 66 with high dimensional precision can be simultaneously mass-produced.

Subsequently, the cathode assembly 27 and the grid unit 66, which are manufactured in the above manner, are joined to each other through the metal layer 71. More specifically, the cathode assembly 27 and the grid unit 66 are positioned with respect to each other through the metal layer 71 as a brazing material, and the resultant structure is heat-treated, thereby obtaining an electron gun assembly.

Figure 44:
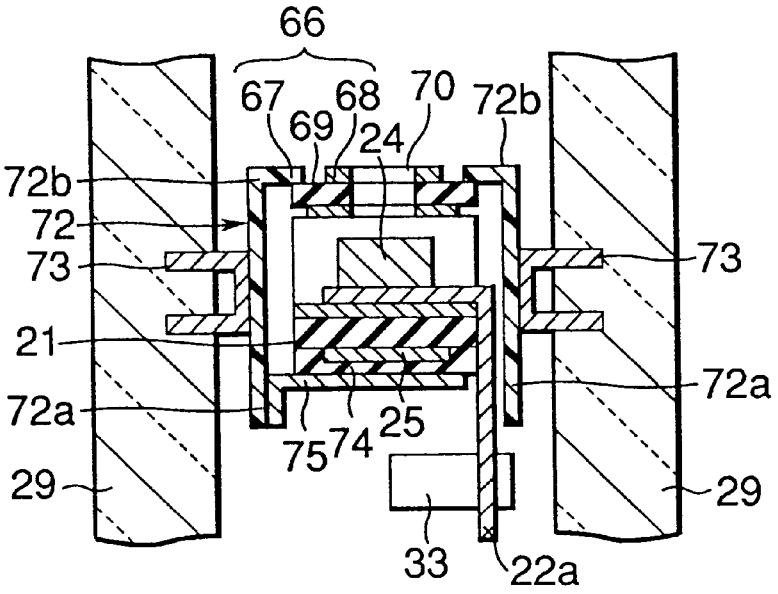
FIG. 44 is a sectional view taken along a line XXXXIV—XXXXIV in FIG. 42, showing a state in which the electron gun assembly is mounted in the electron tube.
Figure 45:
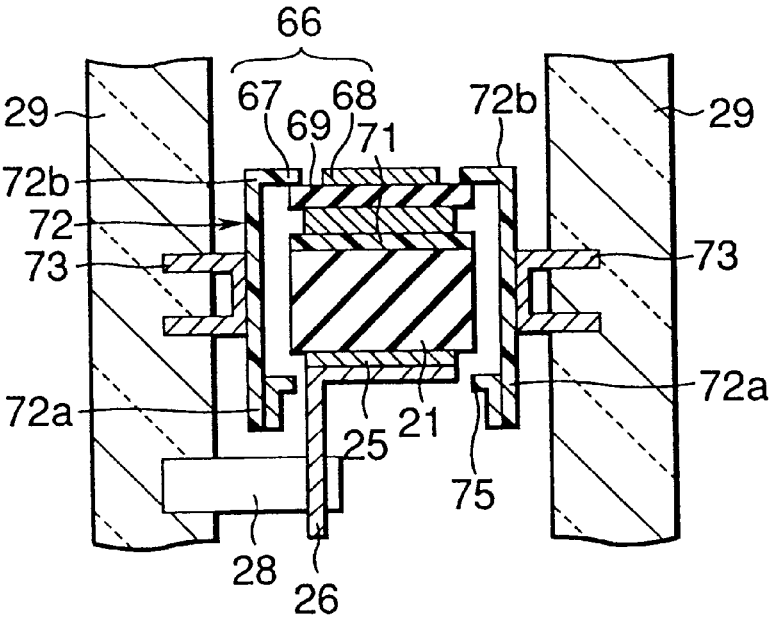
FIG. 45 is a sectional view taken along a line XXXXV—XXXXV in FIG. 42, showing a state in which the electron gun assembly is mounted in the electron tube.

As shown in FIGS. 44 and 45, the electron gun assembly 34 having the above structure is mounted in the neck of the electron tube by using the support frame, the retainer, and the like. More specifically, a support frame 72 is formed into a substantially rectangular frame having a pair of side walls 72*a* which are parallel and opposite to each other. Fixing pins 73 extend from the side walls 72*a*. The support frame 72 is fixed to a bead glass 29 by embedding the fixing pins 73 into the bead glass 29. The upper end portions of the side walls 72*a* are bent inward to form a flange 72*b*.

The electron gun assembly 34 is housed between the side walls 72*a* of the support frame 72, and the edge portion of the upper surface of the spacer 69 is in contact with the inner surface of the flange 72*b*. In addition, a plate-like retainer 75 is fixed to the lower end portions of the two side walls 72*a*. The retainer 75 opposes the heating member formation surface of the insulating substrate 21 except for the heater electrode terminals 26 of the cathode assembly 27 and the electrode terminals 22*a*. The retainer 75 is in contact with the heating member 25 through an insulating layer 74 consisting of APBN to press the electron gun assembly 34 against the flange 72*b* of the side walls 72*a*, thereby holding the electron gun assembly 34. The retainer 75 also has the function of reflecting the heat from the heating member 25. The insulating layer 74 can be formed on the insulating substrate 21 by the CVD method or the like after the heating member 25 is formed. Note that the retainer 75 may be placed to oppose the electron gun assembly 34 through a predetermined space without the mediacy of the insulating layer 74.

The pair of heater electrode terminals 26 of the cathode assembly 27 are fixed to the bead glass 29 through a heater strap 28 consisting of stainless steel. The electrode terminal 22*a* extending from each cathode base member 24 of the cathode assembly 27 is connected to a cathode strap 33.

The electron gun assembly 34 is in the electron tube as follows. First of all, the electron gun assembly 34 is inserted into the support frame 72. The retainer 75 is then mounted on the support frame, and the retainer 75 and the support frame are welded to each other by resistance welding or the like. Thereafter, the fixing pins 73 and the heater strap 28 are embedded/fixed in the bead glass 29 semi-fused by a burner.

In the present invention, the cathode assembly 27 and the grid unit 66 of the electron gun assembly 34 are fixed by brazing through the metal layer. However, when the electron gun assembly 34 is to be mounted in the electron tube, the cathode assembly 27 may be mechanically fixed to the grid unit 66 without brazing by clamping the electron gun assembly 34 between the flange 72*b* of the support frame 72 and the retainer 75.

According to the electron gun assembly according to this embodiment having the above structure, similar to the embodiments described above, the lengths of the cathode assembly and the electron gun assembly can be decreased, and the decrease in power consumption and the fast operation characteristics can be attained.

In addition, according to this embodiment, the first and second grids consisting of APG or the like are integrally stacked on each other by inserting the spacer consisting of an electric insulating material such as APNB therebetween. These films are formed by a thin film formation technique. Therefore, unlike a conventional electron gun grid, the parts need not be separately formed, and high dimensional precision can be maintained, thereby obtaining an electron gun assembly with high quality in terms of quality control.

The spaces between the first grid and the three cathode base members are important to realize uniform characteristics by eliminating variations in electron gun assemblies. In this embodiment, the three cathode base members are lapped, together with the insulating substrate, to make their heights uniform. The projections of the first grid serve as spacers for maintaining the distant from each cathode base member with high precision with respect to the design dimensions. Therefore, high-precision management can be performed to obtain electron gun assemblies with uniform characteristics.

Furthermore, cathode assemblies and grid units can be manufactured in large quantities on the same substrate, and the substrate is divided into electron gun assemblies, as in the case with the manufacture of semiconductor chips. Therefore, a large number of electron gun assemblies with the same precision can be manufactured; high productivity is realized.

Figure 46:
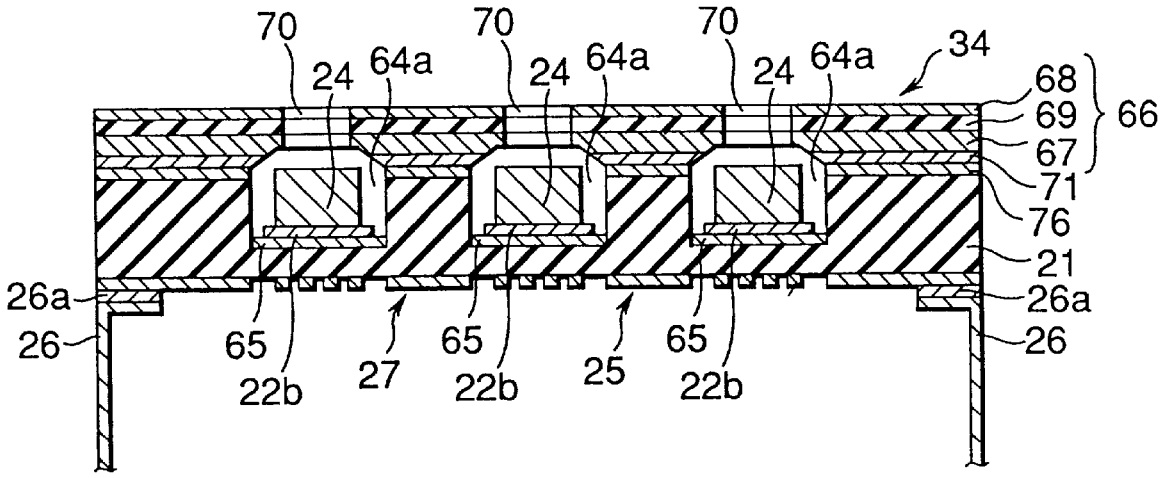
FIG. 46 is a sectional view of an electron gun assembly according to a 22nd embodiment of the present invention.

FIG. 46 shows an electron gun assembly according to the 22nd embodiment of the present invention. This electron gun assembly is the same as that of the 21st embodiment except that impregnated cathodes are used as cathode base members 24, an APG layer 76 is formed on the upper surface of an insulating substrate 21, and a grid unit 66 and a cathode assembly 27 are joined to each other through a metal layer 71 consisting of molybdenum-nickel (Mo—Ni) and serving as a brazing material.

In this case, since the impregnated cathodes are used as the cathode base members 24, when the grid unit 66 is to be joined to the cathode assembly 27, they can be heated at a high temperature, allowing the use of a high-temperature brazing material.

The above electron gun assembly is manufactured as follows. APG layers 65 and 76 are formed as first layers on the surface of the insulating substrate and the bottom surface of each recess by the CVD method. In this case, a relatively thick APG layer is formed on the surface of the insulating substrate. In order to improve the joining properties between the cathode base members and the APG layer, a metal layer 22*b* consisting of Ti, molybdenum-nickel (Mo—Ni), or the like is formed as a second layer in each recess. The resultant structure is then heated at, for example, about 1,600 or 1,450° C. in a hydrogen atmosphere or a vacuum.

Subsequently, each cathode base member 24 is welded to the APG layer 65 an the metal layer 22*b* by using a laser, thus fixing each cathode base member 24 to the insulating substrate 21. Lapping is performed such that the APG layer 76 formed on the upper surface of the insulating substrate 21 is flush with the upper surfaces of the cathode base members 24.

In addition, the APG layer 76 is coated with a brazing material consisting of Mo—Ni, and the grid unit 66 and the insulating substrate 21 are placed at predetermined positions. The resultant structure is heated at 1,450° C. in a hydrogen atmosphere or a vacuum to braze these components, thereby obtaining an electron gun assembly.

Other arrangements and manufacturing methods are the same as those in the 21st embodiment. The same reference numerals in the 22nd embodiment denote the same parts as in the 22nd embodiment, and a detailed description thereof will be omitted.

Figure 47:
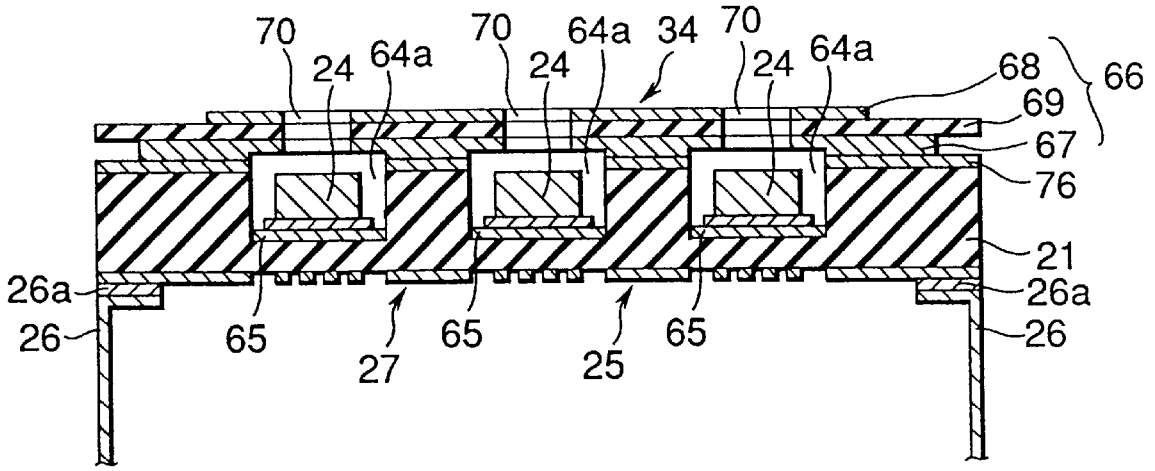
FIG. 47 is a sectional view of an electron gun assembly according to a 23rd embodiment of the present invention.

According to the 23rd embodiment shown in FIG. 47, an APG layer 76 is formed on the surface of an insulating substrate 21, and a grid unit 66 is fixed to a cathode assembly 27 through the APG layer 76 alone.

Figure 48:
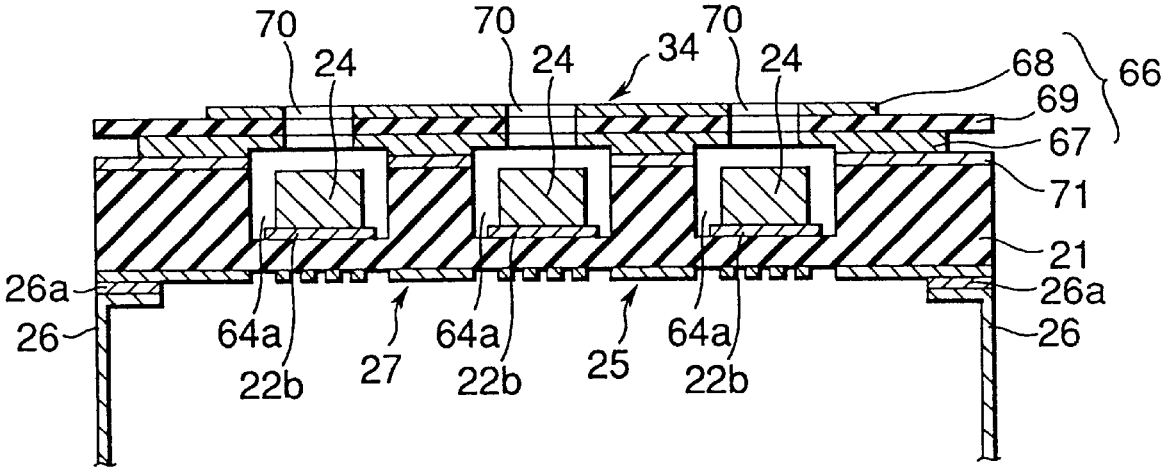
FIG. 48 is a sectional view of an electron gun assembly according to a 24th embodiment of the present invention.

According to the 24th embodiment shown in FIG. 48, each cathode base member 24 is joined/fixed in a recess 64*a* of an insulating substrate 21 through a metal layer 22*b* consisting of Ti without the mediacy of an APG layer.

In this case, since each cathode base member 24 is fixed to a corresponding recess through only the metal layer 22*b* without the mediacy of an APG layer, as the material for this metal layer, one material selected from the group consisting of Ti, Mo, W, Nb, Ta, and an alloy containing one of them can be used. Since each cathode base member 24 can be joined to the insulating substrate 21 by using the metal layer 22*b* alone, the manufacturing process can be simplified.

Figure 49:
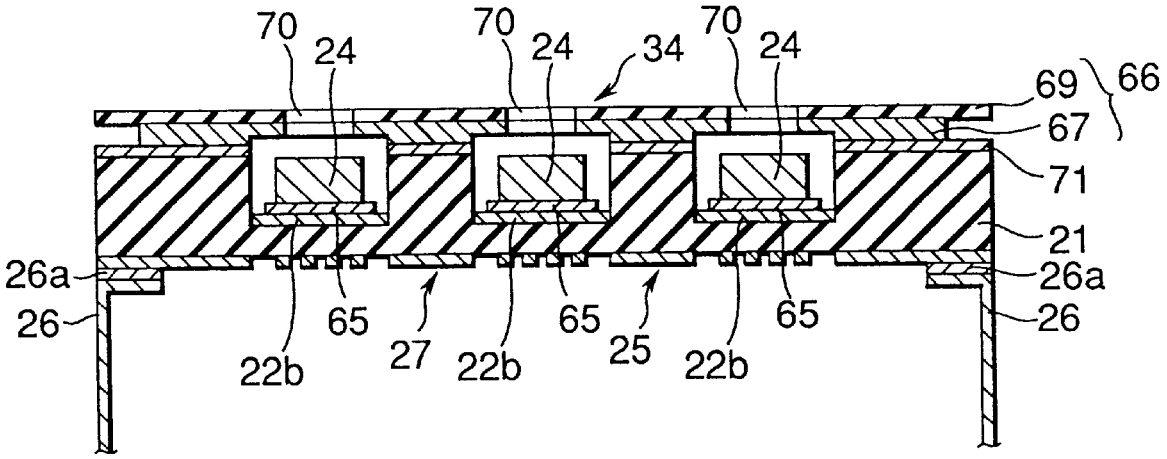
FIG. 49 is a sectional view of an electron gun assembly according to a 25th embodiment of the present invention.

According to the 25th embodiment shown in FIG. 49, a grid unit 66 is constituted by only a first grid 67 and a spacer 69. In this case, since the first grid 67 consists of APG, high strength may not be maintained with the APG layer alone. For this reason, the spacer 69 consisting of an electric insulating material such as ABPN is used as a substrate. The spacer 69 can be omitted, as needed. With this structure, cathode base members and grids other than the first grid can be arbitrarily selected and arranged.

Other arrangements and manufacturing methods in the 23rd to 25th embodiments are the same as those in the 21st embodiment. The same reference numerals in the 23rd to 25th embodiments denote the same parts as in the 21st embodiment, and a detailed description thereof will be omitted.

Figure 50:
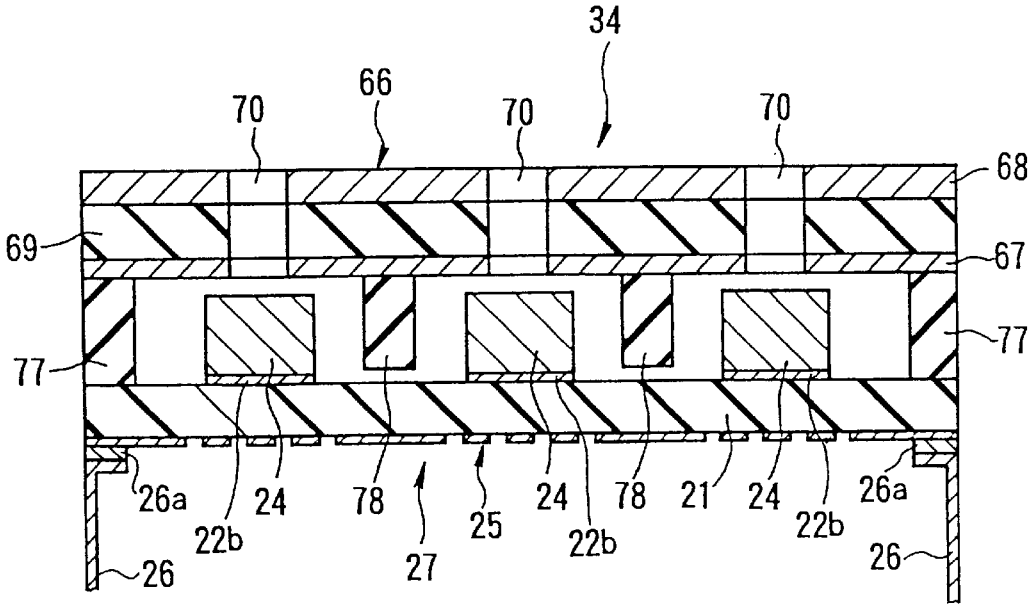
FIG. 50 is a sectional view of an electron gun assembly according to a 26th embodiment of the present invention.

FIG. 50 shows an electron gun assembly according to the 26th embodiment of the present invention. This embodiment differs from the 21st embodiment in the following structure. According to the 26th embodiment, the cathode base member formation surface of an insulating substrate in a cathode assembly is flat, and a grid unit is joined to the cathode assembly through a spacer. In addition, shielding plates are arranged between a plurality of cathode base members.

Other arrangements in the 26th embodiment are the same as those in the 21st embodiment. The same reference numerals in the 26th embodiment denote the same parts as in the 21st embodiment, and a detailed description thereof will be omitted.

As shown in FIG. 50, an insulating substrate 21 of a cathode assembly 27 has a substantially rectangular shape with a pair of flat opposing surfaces. For example, the insulating substrate 21 is 8 mm long, 1.5 mm wide, and 0.3 mm thick. Three cathode base members 24 are arranged on one surface of the insulating substrate 21 at predetermined intervals. Each cathode base member 24 has a pellet-like shape formed by compressing a nickel powder and an emissive material. Each cathode base member 24 has a diameter of 0.7 mm and a thickness of 0.5 mm. These cathode base members 24 are arranged at 2-mm intervals. Each cathode base member 24 is fixed to the insulating substrate 21 through a metal layer 22*b*.

A grid unit 66 is joined to the insulating substrate 21 through a spacer 77 so as to oppose the three cathode base members 24 through a predetermined space. The spacer 77 has a frame-like shape extending along the peripheral portion of the lower surface of a first grid 67, and consists of an electric insulating material such as APBN. The peripheral portion of the lower surface of the first grid 67 is joined to the peripheral portion of the upper surface of the insulating substrate 21 through the spacer 77. In this state, the space between the upper surface of each cathode base member 24 and the first grid 67 is kept to, e.g., 0.1 mm. With this structure, the cathode assembly 27 and the grid unit 66 are integrally fixed.

Shielding plates 78 are respectively placed between the adjacent cathode base members 24. These shielding plates 78 are arranged to prevent the heat of the insulating substrate 21 from being directly transmitted to the first grid 67, and prevent a substance evaporated from the cathode base members 24 during operation of the cathode assembly 27 from scattering, adhering to the surface of the insulating substrate 21, and being deposited thereon.

Each shielding plate 78 consists of an electric insulating material, e.g., APBN, and has a flat, plat-like shape. The shielding plates 78 are fixed to the first grid 67 and extend substantially vertically from the first grid 67 to the insulating substrate 21. The extending end of each shielding plate 78 opposes the insulating substrate 21 through a predetermined space.

With this structure, the shielding plates 78 surround the respective cathode base members 24, in cooperation with the spacer 77, to prevent a substance evaporated from the cathode base member 24 during operation of the electron gun assembly from scattering. The shielding plates 78 therefore prevent the substance evaporated from the cathode base members 24 from adhering to the surface of the insulating substrate 21 and being deposited thereon. Consequently, this structure can prevent the electrons emitted from the respective cathode base members 24 from leaking and causing variations in the amounts of electrons emitted from the respective cathode base members 24, and can prevent a situation in which the cathode base members 24 are difficult to independently operate.

Figure 51A:
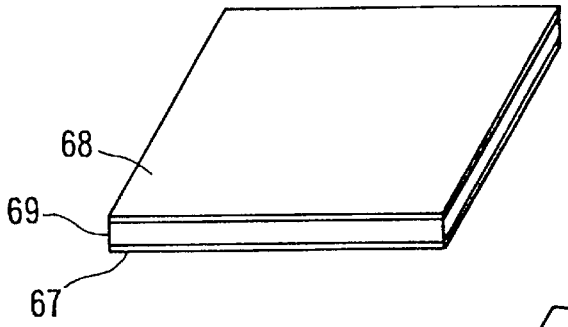
FIGS. 51A to 51C are views showing methods of manufacturing the grid unit and shielding plates of the electron gun assembly.
Figure 51B:
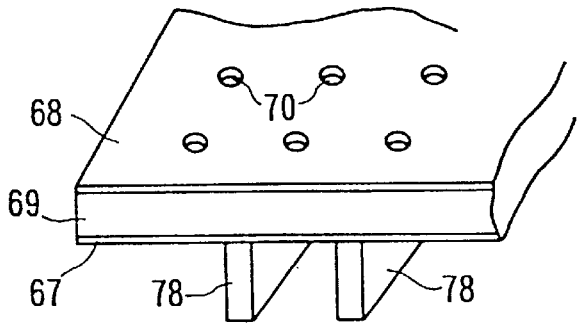
Figure 51C:
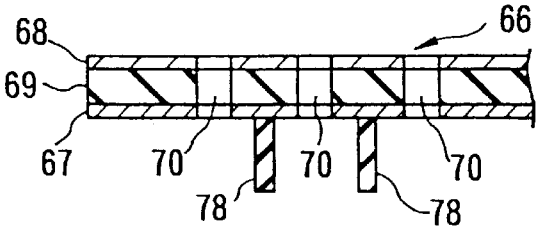

The cathode assembly 27 of the electron gun assembly 24 having the above structure is manufactured by the same manufacturing method as that in the 21st embodiment. The grid unit 66 is formed by stacking the first grid, the spacer, and the second grid using the same manufacturing method as that in the 21st embodiment, as shown in FIG. 51A. As shown in FIGS. 51B and 51C, the shielding plates 78 are formed by masking only the portions, of the surface of the first grid 67, on which the shielding plates 78 are not formed, stacking a 0.5-mm thick APBN layer on the resultant structure, and removing the masking layer. The resultant structure is divided into many grid units.

Subsequently, as shown in FIG. 50, the cathode assembly 27 and the grid unit 66 are positioned to oppose each other and joined to each other through the APBN spacer 77, leaving a predetermined space therebetween, thereby manufacturing an electron gun assembly 34.

According to the electron gun assembly of this embodiment having the above structure, similar to the 21st embodiment described above, the lengths of the cathode assembly and the electron gun assembly can be decreased, a decrease in power consumption, and fast operation characteristics can be attained.

In addition, according to this embodiment, since the grid unit 66 is integrally fixed to the cathode assembly 27 through the spacer 77, the distance between the cathode assembly 27 and the first grid 67 of the grid unit can be set with high precision. In the electron gun assembly 34, the first grid 67 and a second grid 68 consist of APG, i.e., the same material as that for the heating member 25. A spacer 69 and the spacer 77 consist of APBN, i.e., the same material as that for the insulating substrate 21. For this reason, the electron gun assembly 34 can be accurately assembled with a very small change in the distance between the insulating substrate 21 and the first grid 67 due to thermal expansion. The cathode base members and the grid unit of the electron gun assembly can be manufactured in the form of a wafer by the CVD method. This structure therefore exhibits high productivity.

In addition, according to the electron gun assembly 34, the shielding plates 78 arranged between the adjacent cathode base members 24 between the insulating substrate 21 and the first grid 67 prevent a substance evaporated from the cathode base members 24 from scattering, thereby preventing the substance evaporated from the cathode base members 24 from scattering around the cathode base members 24 and being deposited on the surface of the insulating substrate 21. This structure can also prevent a situation in which the amounts of electrons emitted from the cathode base members 24 vary, or the cathode base members 24 are difficult to independently operate.

When, for example, a life test of 3,000 hours was conducted on an electron tube incorporating the electron gun assembly of this embodiment, and the electron gun assembly was disassembled and checked, no substance evaporated from the cathode base members 24 adhered onto the insulating substrate 21, and no current leakage occurred. In addition, it was confirmed that the electron tube operated stably without causing any crosstalk during the life test.

Since the shielding plates 78 are joined to the first grid 67 and are not so tall as to come into contact with the insulating substrate 21, an increase in the thermal capacity of the insulating substrate 21 can be prevented. This structure can also prevent the heat of the insulating substrate 21 from being directly transmitted to the first grid 67 through the shielding plates 78. For this reason, the heat loss caused when the heating member 25 heats the cathode base members 24 can be suppressed, and hence the cathode base members 24 can be efficiently heated. Furthermore, since the shielding plates 78 are not mounted on the insulating substrate 21, the insulating substrate 21 has a simple shape, and the cathode base members 24 can be easily joined thereto.

Figure 52:
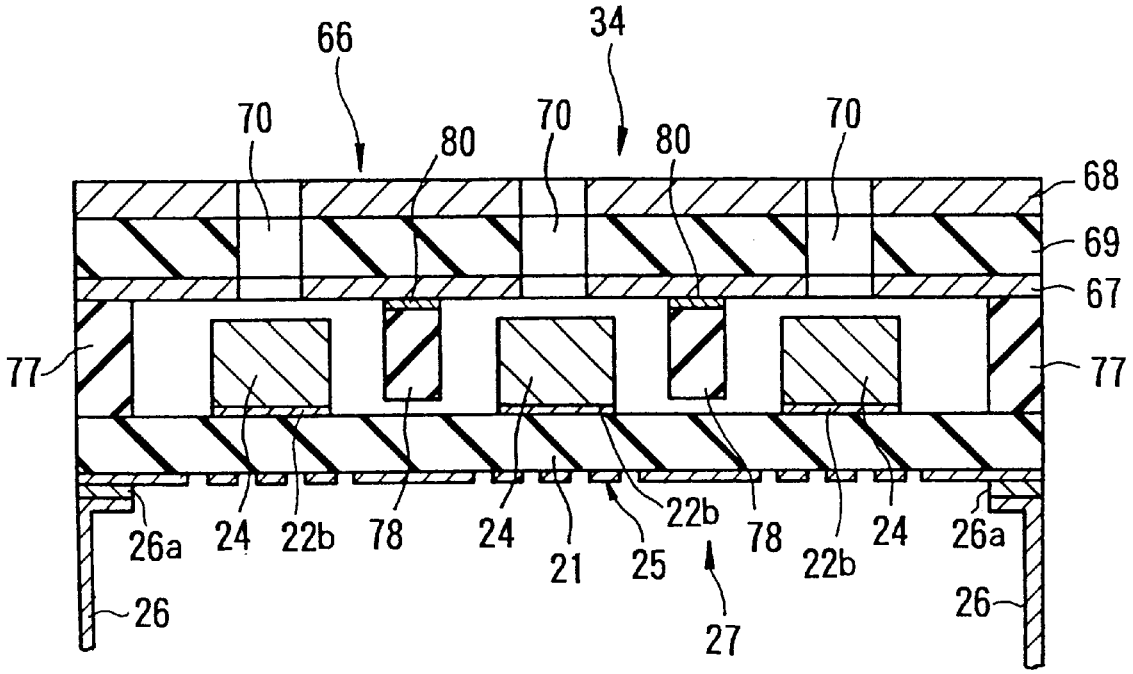
FIG. 52 is a sectional view of an electron gun assembly according to a 27th embodiment of the present invention.

According to the 27th embodiment shown in FIG. 52, shielding plates 78 may be formed as discrete parts in advance, and fixed to a first grid 67 by brazing using a brazing material 80. As the brazing material 80, for example, nickel is used. According to this structure, the shielding plates 78 can be reliably fixed to the first grid 67.

Figure 53:
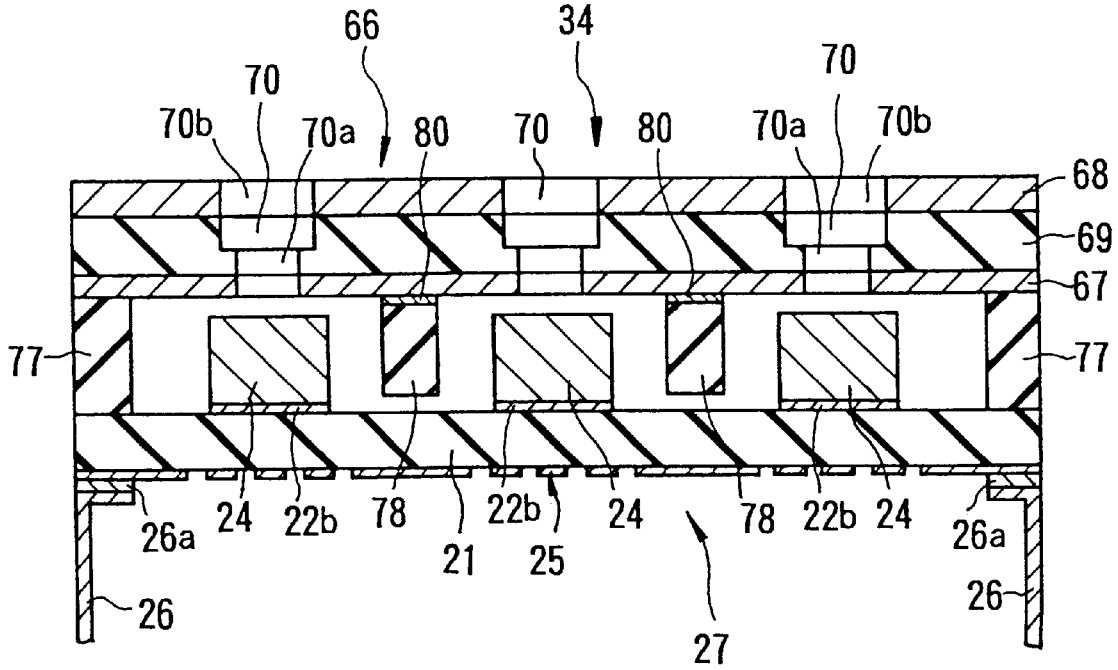
FIG. 53 is a sectional view of an electron gun assembly according to a 28th embodiment of the present invention.

According to the 28th embodiment shown in FIG. 53, stepped through holes are formed as through holes 70 in a grid unit 66. Each through hole 70 has a first portion 70*a* extending from the first grid 67 to the intermediate portion of the spacer 69, and a second portion 70*b* extending from the intermediate portion of the spacer 69 to a second grid 68. The diameter of the second portion 70*b* is larger than that of the first portion 70*a*.

With the use of these stepped through holes 70, even if a substance evaporated from cathode base members 24 enters the through holes 70 and is deposited on the inner surfaces, current leakage between the first and second grids 67 and 68 can be prevented. That is, since the diameter of the second portion 70*b* of each through hole 70 is set to be larger than that of the first portion 70*a*, adhesion and deposition of the substance evaporated from the cathode base members 24 onto the inner surfaces of the second portions 70*b* can be suppressed. This is because, most of the substance evaporated from the cathode base members 24 adheres to the inner surface of the first portion 70*a* when it passes through the first portion 70*a*, and the substance that enters the second portion 70*b* and adheres to its inner surface is greatly reduced in amount. Therefore, current leakage between the first and second grids 67 and 68 owing to the adhesion of the substance can be prevented.

Figure 54:
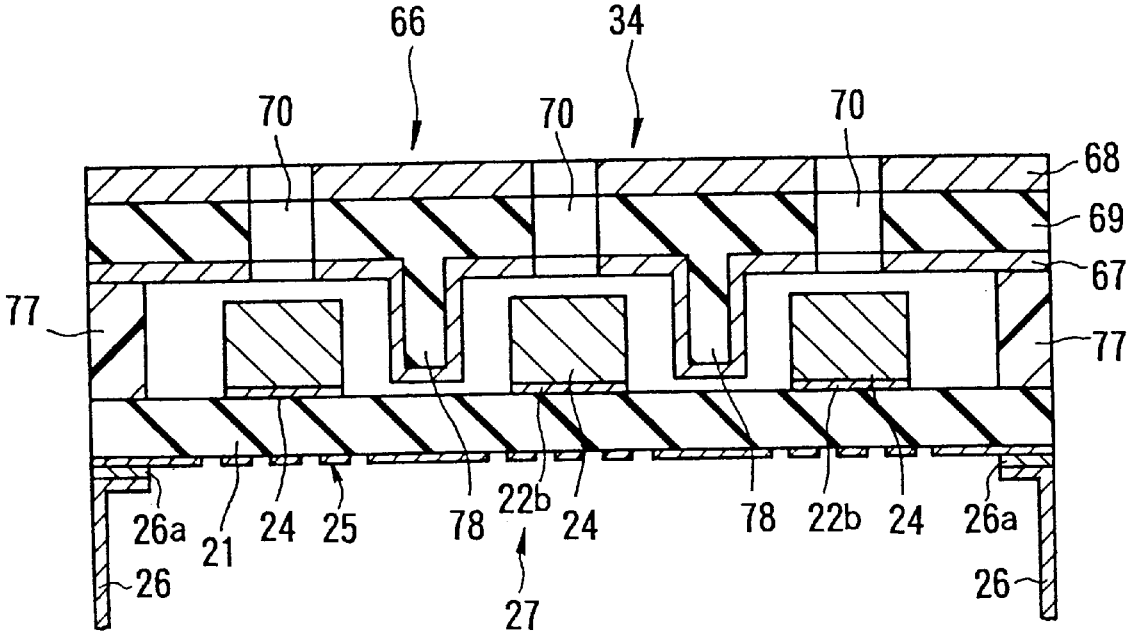
FIG. 54 is a sectional view of an electron gun assembly according to a 29th embodiment of the present invention.

According to the 29th embodiment shown in FIG. 54, each shielding plate 78 is integrally formed with a spacer 69. More specifically, the shielding plates 78 extending toward an insulating substrate 21 are integrally formed on the portions, of the spacer 69 consisting of ABPN, which oppose the portions between cathode base members 24. A first grid 67 is continuously formed on the surface of the spacer 69 and the surface of each shielding plate 78. Each shielding plate 78 is formed to have a protrusion height that does not cause the first grid 67 formed on its surface from coming into contact with the surface of the insulating substrate 21.

In this case, the shielding plates 78 are integrally formed with the spacer 69 by the CVD method, and the first grid 67 is formed on the surfaces of the spacer 69 and the shielding plates 78 by the CVD method. Through holes 70 are formed after the first grid 67 is formed. As each cathode base member 24, an oxide cathode is used.

According to the 29th embodiment having the above structure, an electron gun assembly in which the shielding plate 78 and a grid unit 66 have a high joining strength can be obtained.

Figure 55:
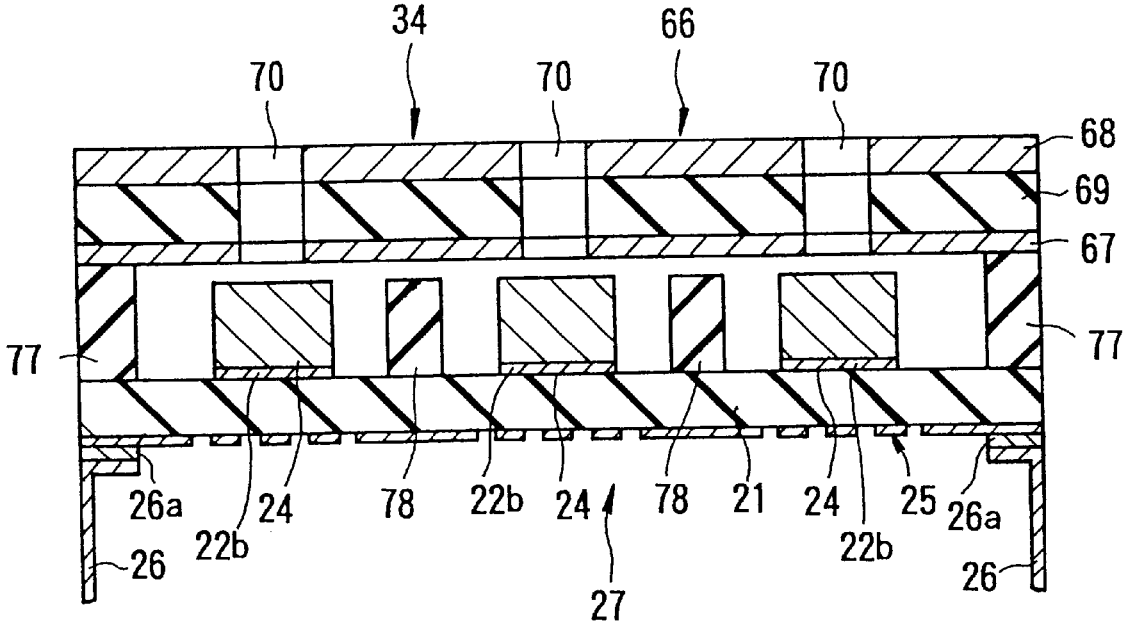
FIG. 55 is a sectional view of an electron gun assembly according to a 30th embodiment of the present invention.

According to the 30th embodiment shown in FIG. 55, shielding plates 78 are fixed to the surface of an insulating substrate 21 and located between adjacent cathode base members 24. Each shielding plate 78 is formed to extend vertically toward a first grid 67 and have a height that does not cause its distal end to come into contact with the first grid 67.

These shielding plates 78 serve to prevent a substance evaporated from the cathode base members 24 from scattering. In addition, each shielding plate 78 prevents the heat of the insulating substrate 21 from being directly transmitted to the first grid 67, thereby effectively using the heat generated by a heating member 25 to heat the cathode base members 24.

According to the 27th to 30th embodiments shown in FIGS. 52 to 55, other arrangements, manufacturing methods, and the like are the same as those in the 26th embodiment, and the same reference numerals denote the same parts in these embodiments. In addition, similar to the structure of the 26th embodiment, the structure of each of the 27th to 30th embodiments can attain the decreases in the profile and power consumption, and the fast operation characteristics of an electron gun assembly, and can also improve the precision in the distance between the cathode assembly 27 and the first grid 67.

An electron gun assembly according to the 31st embodiment of the present invention will be described next with reference to FIGS. 56 to 59. This embodiment differs from the 26th embodiment in that no shielding plates are formed, and also differs therefrom in the structure of a spacer for fixing cathode base members to a grid unit. The same reference numerals in the 31st embodiment denote the same parts in the 26th embodiment.

Figure 56:
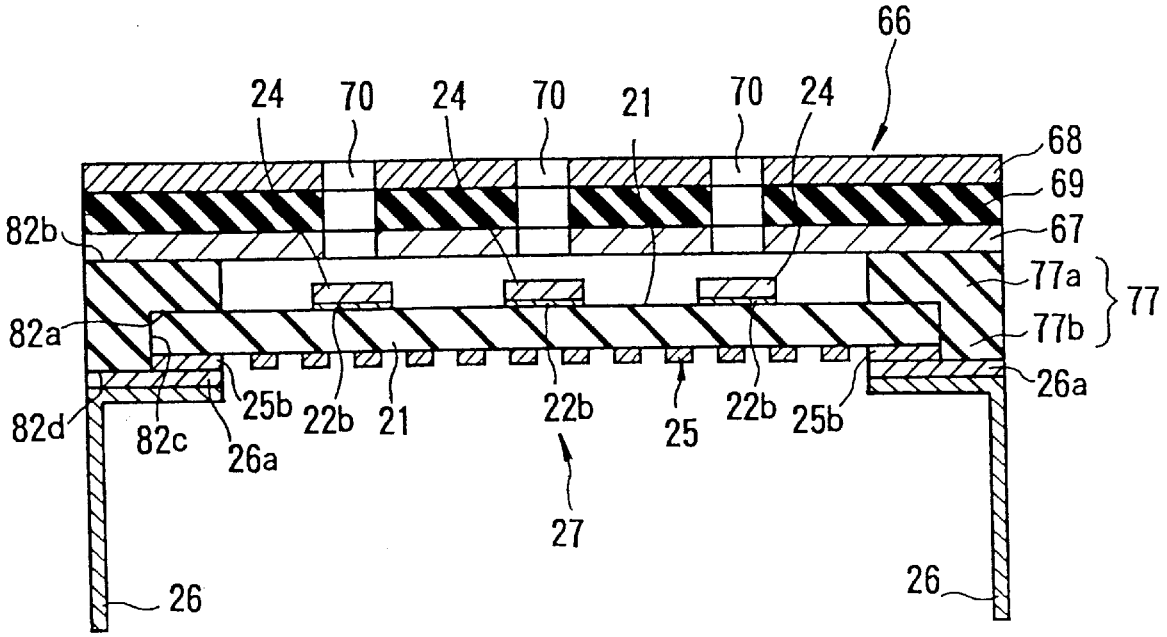
FIG. 56 is a sectional view of an electron gun assembly according to a 31st embodiment of the present invention.

As shown in FIG. 56, according to this embodiment, an insulating substrate 21 of a cathode assembly 27 has a substantially rectangular shape with a pair of opposing flat surfaces. For example, the insulating substrate 21 is 8 mm long, 1.5 mm wide, and 0.3 mm thick. Three cathode base members 24 are arranged on one surface of the insulating substrate 21 at predetermined intervals. Each cathode base member 24 has a pellet-like shape formed by compressing a nickel powder and an emissive material, and is fixed to the insulating substrate 21 through a metal layer 22*b*. A heating member 25 consisting of APG is formed on the other surface of the insulating substrate 21.

A grid unit 66 is joined to the insulating substrate 21 through a spacer 77 to oppose the three cathode base members 24 through a predetermined space. The spacer 77 has a frame-like shape extending along the peripheral portion of the lower surface of a first grid 67, and consists of an electric insulating material, e.g., APBN. The peripheral portion of the lower surface of the first grid 67 is joined to the peripheral portion of the upper surface of the insulating substrate 21 through the spacer 77. In this state, a space of, e.g., 0.1 mm is held between the upper surface of each cathode base member 24 and the first grid 67. With this structure, the cathode assembly 27 and the grid unit 66 are integrally fixed to each other.

Figure 57:
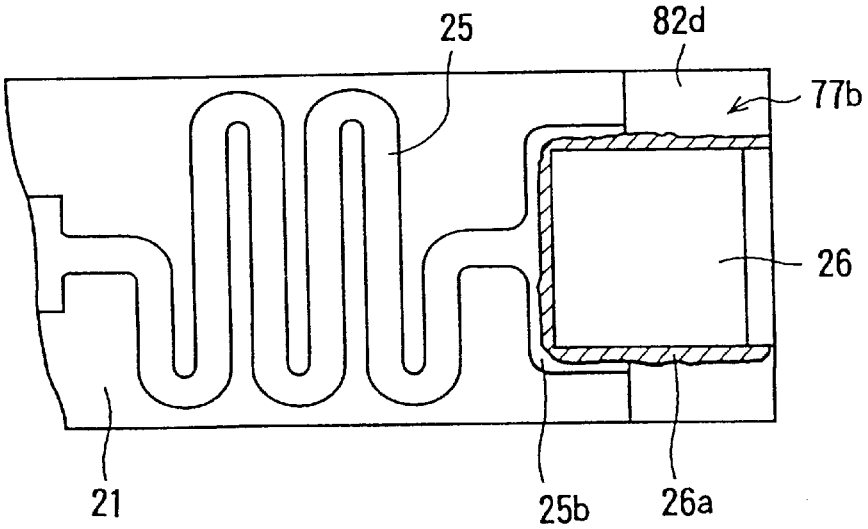
FIG. 57 is a plan view showing the joining portions of the heating member, spacer, and heater electrode terminal of the electron gun assembly.

As shown in FIGS. 56 and 57, in this embodiment, the spacer 77 integrally has a spacer portion 77*a* located between the insulating substrate 21 and the first grid 67 to define the space therebetween, and a fixing positioning portion 77*b* extending vertically with respect to the surface of the insulating substrate 21 to define the position of the insulating substrate 21 in the surface direction. The spacer 77 has an L-shaped cross-section. More specifically, the spacer portion 77*a* of the spacer 77 has a first fixing surface 82*a* adjoining the peripheral portion of the upper surface of the insulating substrate 21, and a second fixing surface 82*b* adjoining the first grid 67. These first and second fixing surfaces are formed to be parallel to each other. The fixing positioning portion 77*b* has a positioning surface 82*c* extending vertically with respect to the first fixing surface 82*a* and adjoining the side edge of the insulating substrate 21, and a third fixing surface 82*d* extending parallel to the first fixing surface 82*a* and formed in the same plane as that of an electrode 25*b* of the heating member 25.

The positioning surface 82*c* of the spacer 77 comes into contact with the side edge of the insulating substrate 21 to position the spacer 77 when it is mounted on the insulating substrate 21. That is, the positioning surface 82*c* serves to define the positional relationship between the cathode assembly 27 and the grid unit 66 when they are assembled and fixed to each other.

The third fixing surface 82*d* of the spacer 77 is fixed to a heater electrode terminal 26, together with the electrode 25*b* of the heating member 25, through a metal layer 26*a*. As the metal layer 26*a*, a metal serving as a brazing material, e.g., titanium, is used. With this metal layer, the insulating substrate 21 of the cathode assembly 27 and the spacer 77 are fixed to each other.

Figure 58:
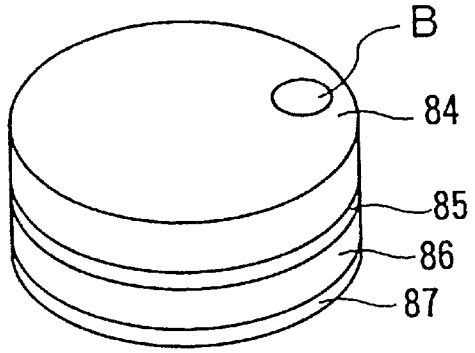
FIG. 58 is a perspective view showing the steps in manufacturing the grid unit of the electron gun assembly.

A method of manufacturing the electron gun assembly 34 according to this embodiment will be described next. The cathode assembly 27 is manufactured by the same method as in the above embodiments. As shown in FIG. 58, the grid unit 66 is formed such that APBN layers 84 and 86 respectively corresponding to the spacer 77 and a spacer 69, and APG layers 85 and 87 respectively corresponding to the first grid 67 and a second grid 68 are stacked to form a four-layer structure by the CVD method. The APBN layer 84 is 1 mm thick; the APG layer 85, 0.1 mm thick; the APBN layer 86, 0.32 mm thick; and the APG layer 87, 0.4 mm thick.

The area of this four-layer structure is set to allow many grid units (to be extracted later) to be formed thereon. For example, this structure has a diameter of 20 cm.

Figure 59:
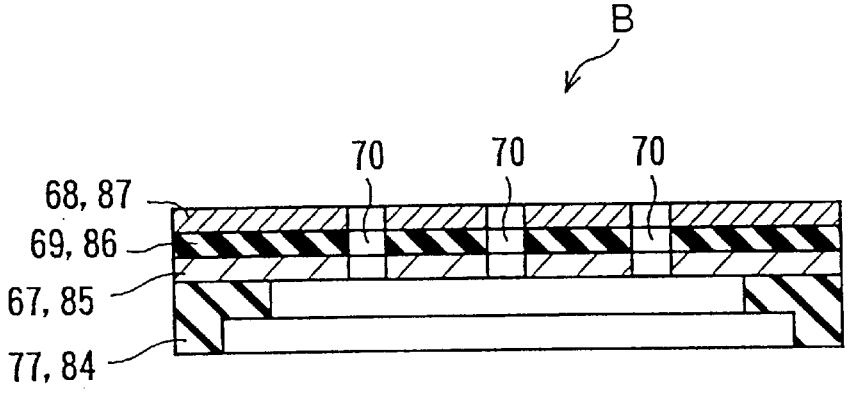
FIG. 59 is a sectional view of the electron gun assembly.

Subsequently, as shown in FIG. 59, through holes 70 are formed in the APBN layers 84 and 86 and the APG layers 85 and 87 by the RIE method or the like. In addition, stepped portions (the spacer portion 77*a* and the fixing positioning portion 77*b*) are formed in the APBN layer 84 by the RIE method. Finally, the resultant structure is diced into many grid units 66.

The grid unit 66 integrally having the spacer 77 is positioned to oppose the cathode assembly 27, and the first fixing surface 82*a* and the positioning surface 82*c* of the spacer 77 are brought into tight contact with the upper surface and the side edge of the insulating substrate 21. With this process, the distance between the cathode assembly 27 and the grid unit 66 is set with high precision. At the same time, the cathode assembly 27 is accurately positioned to a predetermined position with respect to the grid unit 66. Thereafter, the heater electrode terminals 26 are fixed to the surfaces of the electrodes 25*b* of the heating member 25 and the third fixing surface 82*d* of the spacer 77 by laser brazing using a brazing material. As the brazing material, tantalum, niobium, molybdenum, tungsten, or the like can be used suitably for fixing.

According to the electron gun assembly of this embodiment having the above structure, similar to the 21st embodiment described above, the lengths of the cathode assembly and the electron gun assembly can be decreased, and the decrease in power consumption, and the fast operation characteristics can be attained. In addition, according to this embodiment, since the grid unit 66 is integrally fixed to the cathode assembly 27 through the spacer 77, the distance between the cathode assembly 27 and the first grid 67 of the grid unit 66 can be accurately set with an error of 0.5% or less.

When a forced life test was performed while the heater voltage was set to 135%, the rate of change in heater current after a lapse of 3,000 hours was about 2% in both the conventional electron gun assembly and the electron gun assembly of this embodiment. This indicates that the cathode assembly is fixed to the grid unit with sufficient strength. In addition, since the spacer 77 has the positioning surface 82*c* adjoining the side edge of the insulating substrate 21, even if an external force acts on the grid unit 66 in a direction parallel to the surface of the insulating substrate 21, the fixed state between the cathode assembly 27 and the grid unit 66 can be reliably maintained.

The spacer 77 consisting of APBN and the heating member 25 consisting of APG exhibit poor wettability with respect to metals, have very small thermal expansion coefficients, and greatly differ in physical properties in the crystal direction. For this reason, if the spacer 77 and the heating member 25 are fixed to each other by only brazing, the fixing strength is low with respect to an external force acting in the surface direction of the cathode assembly 27. Upon reception of this external force, therefore, the cathode assembly 27 and the grid unit 66 may shift from each other. According to this embodiment, however, the cathode assembly 27 and the grid unit 66 can be firmly fixed to each other without posing such a problem.

Furthermore, in the electron gun assembly 34, each of the first and second grids 67 and 68 consists of APG, which is the same material for the heating member 25, and each of the spacers 69 and 77 consists of APBN, which is the same material for the insulating substrate 21. For this reason, an assembly process can be accurately performed with a very small change in the distance between the grids due to thermal expansion.

Figure 60:
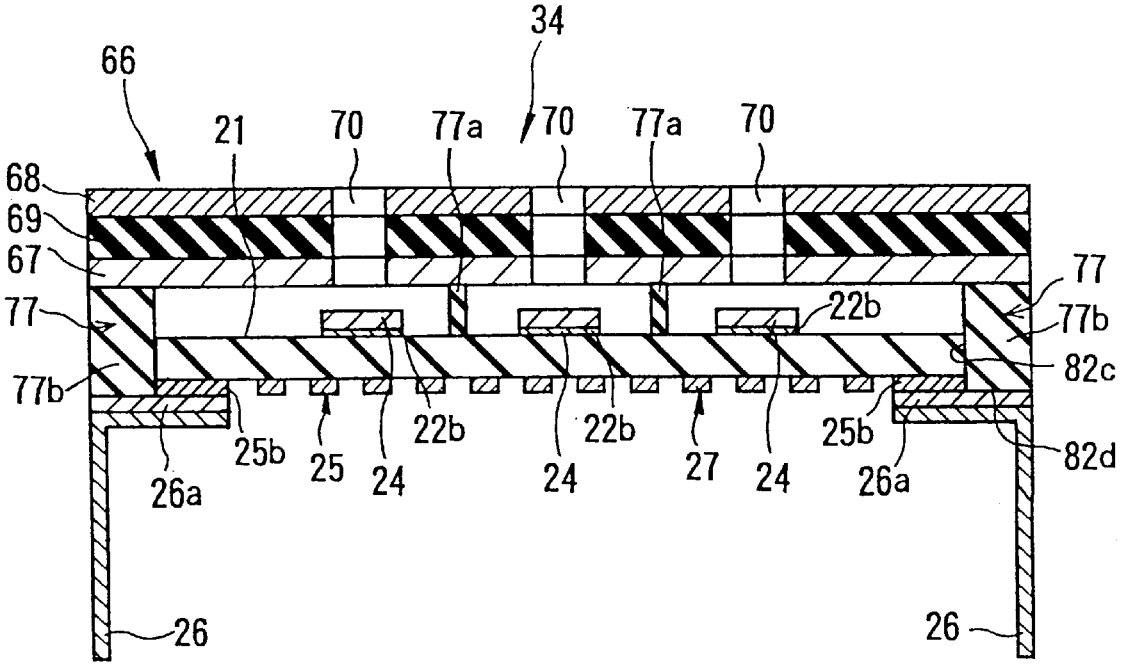
FIG. 60 is a sectional view of an electron gun assembly according to a 32nd embodiment of the present invention.

FIG. 60 shows an electron gun assembly according to the 32nd embodiment of the present invention. The same reference numerals in this embodiment denote the same parts as in the 31st embodiment. According to the 32nd embodiment, spacer portions 77*a* and fixing positioning portions 77*b* of a spacer 77 placed on a grid unit 66 are formed separately.

More specifically, the spacer 77 has the spacer portions 77*a* consisting of APBN, and the fixing positioning portions 77*b*. Each spacer portion 77*a* has a plate-like shape, and is placed between the surface of an insulating substrate 21 and a first grid 67 in contact therewith to hold a space therebetween. The spacer portions 77*a* are arranged between adjacent cathode base members 24.

Each fixing positioning portion 77*b* has a frame-like shape and is fixed to the peripheral portion of the first grid 67. The fixing positioning portions 77*b* has positioning surfaces 82*c* adjoining the side edges of the insulating substrate 21 and surrounding the periphery of the insulating substrate 21. The distal end face of each fixing positioning portion 77*b* has a third fixing surface 82*d* flush with that of an electrode 25*c* of a heating member 25. This distal end face is brazed to a heater electrode terminal 26 through a metal layer 26*a*.

Figure 61:
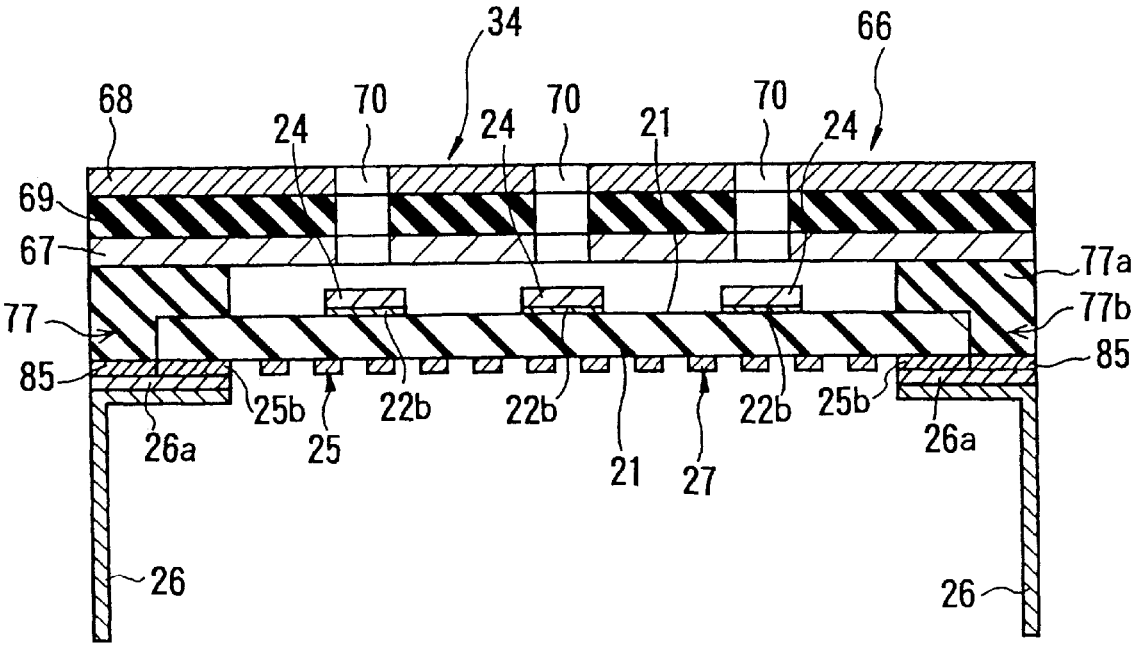
FIG. 61 is a sectional view of an electron gun assembly according to a 33rd embodiment of the present invention.

FIG. 61 shows an electron gun assembly according to the 33rd embodiment of the present invention. The same reference numerals in this embodiment denote the same parts as in the 31st embodiment. According to the 33rd embodiment, a spacer 77 consists of APBN and has an L-shaped cross-section. A third fixing surface 82*d* of the spacer 77 is formed to be flush with the lower surface of an insulating substrate 21. Each fixing layer 85 consisting of APG and sharing the same surface with an electrode 25*b* of a heating member 25 is formed on the third fixing surface 82*d*. Spacer portions 77*a* of the spacer 77 are fixed to a first grid 67. The fixing layer 85 is brazed to a heater electrode terminal 26, together with the electrode 25*b* of the heating member 25, by using a metal layer 26*a* consisting of a nickel brazing material. Note that the fixing layer 85 may consist of a metal other than APG, e.g., titanium, molybdenum, tantalum, or niobium.

Figure 62:
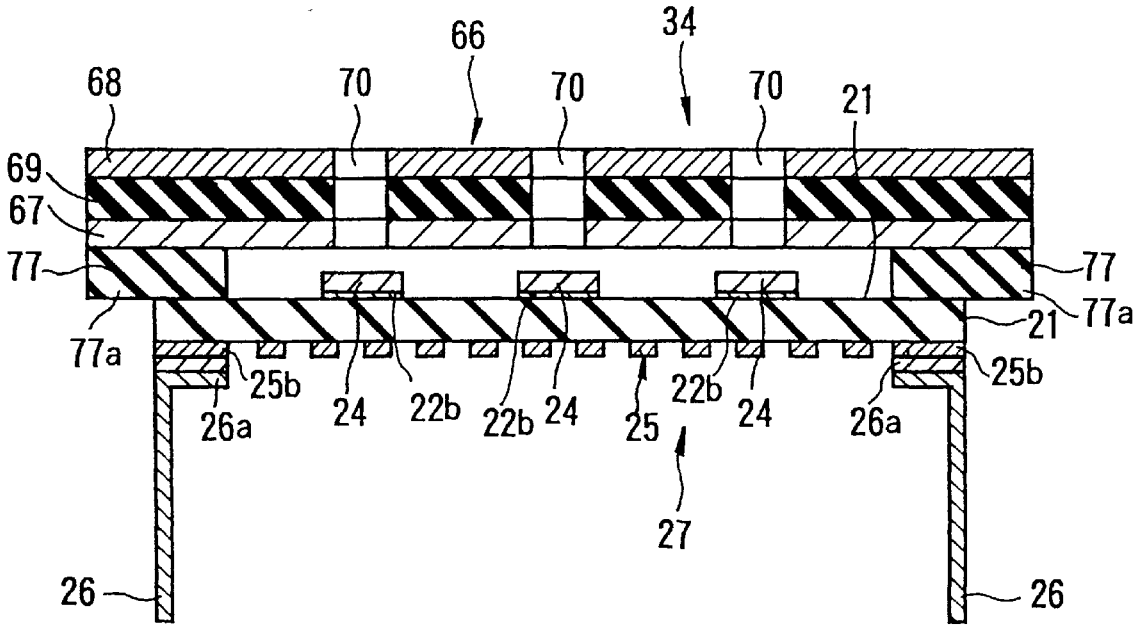
FIG. 62 is a sectional view of an electron gun assembly according to a 34th embodiment of the present invention.

FIG. 62 shows an electron gun assembly according to the 34th embodiment of the present invention. The same reference numerals in this embodiment denote the same parts as in the 31st embodiment. According to the 34th embodiment, a spacer 77 includes only spacer portions 77*a* with fixing/positioning portions being omitted. The spacer portions 77*a* are fixed on the upper surface of an insulating substrate 21 by brazing.

Figure 63:
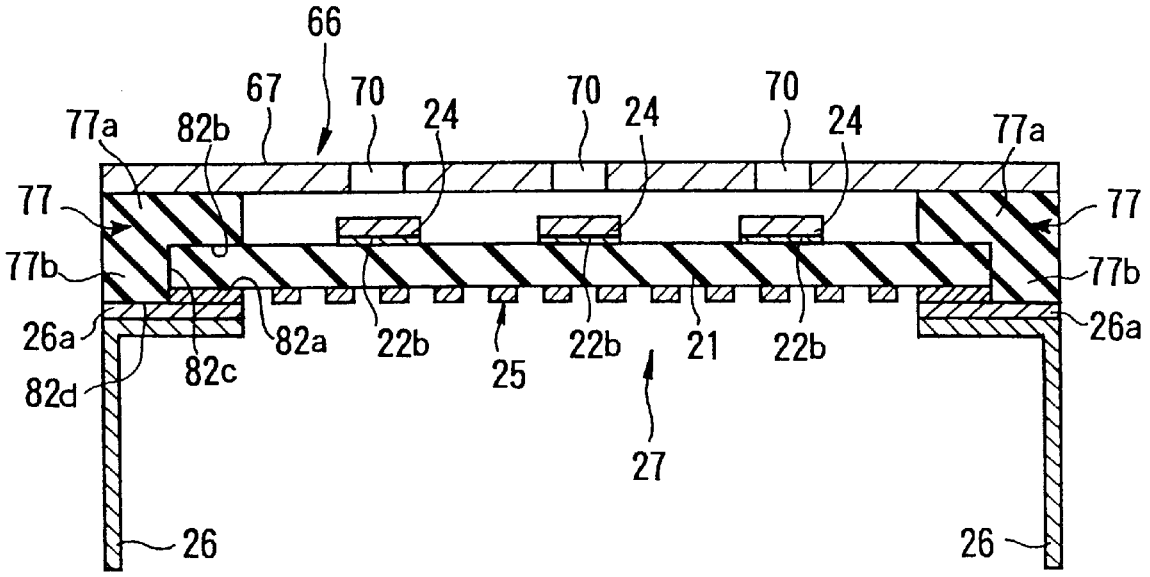
FIG. 63 is a sectional view of an electron gun assembly according to a 35th embodiment of the present invention.

FIG. 63 shows an electron gun assembly according to the 35th embodiment of the present invention. The same reference numerals in this embodiment denote the same parts as in the 31st embodiment. According to the 35th embodiment, a grid unit 66 is not constituted by two grids but includes only a first grid 67.

In addition, similar to the structure of the 31st embodiment, the structure of each of the 32nd to 35th embodiments can attain the decreases in the profile and power consumption, and the fast operation characteristics of an electron gun assembly 34, and can also improve the precision in the distance between a cathode assembly 27 and the first grid 67. Furthermore, the fixing strength between the cathode assembly 27 and the first grid 67 in the electron gun assembly can be increased.

Figure 64:
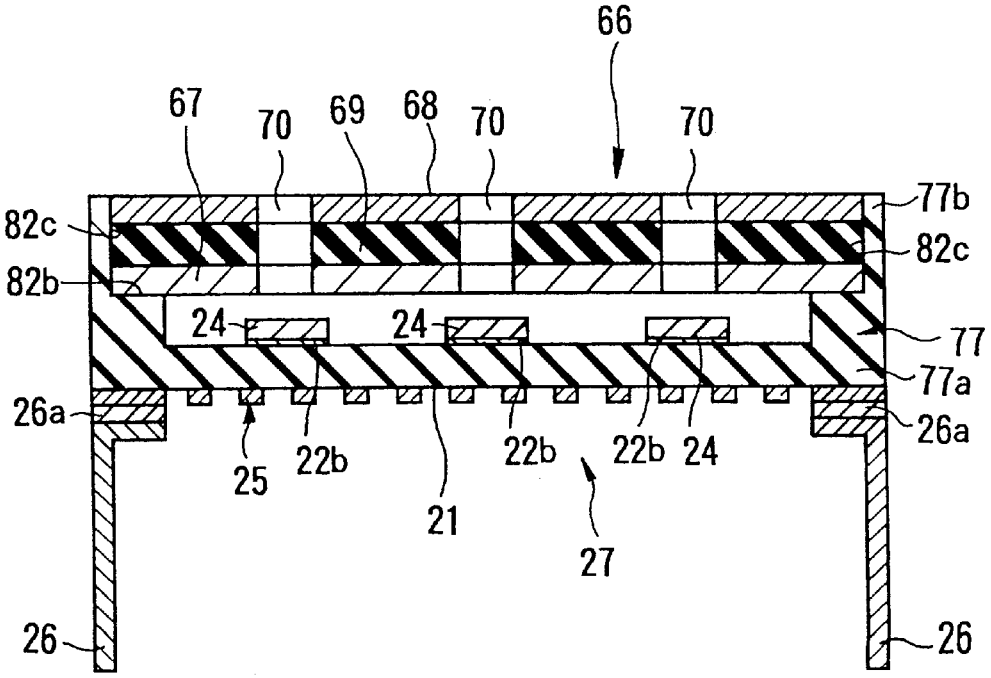
FIG. 64 is a sectional view of an electron gun assembly according to a 36th embodiment of the present invention.

FIG. 64 shows an electron gun assembly according to the 36th embodiment of present invention. The same reference numerals in this embodiment denote the same parts as in the 31st embodiment. According to the 36th embodiment, a spacer 77 is integrally formed with an insulating substrate 21 at its peripheral portion using APBN. More specifically, the spacer 77 integrally has frame-like spacer portions 77*a* extending vertically from the peripheral portion of the upper surface of the insulating substrate 21, and fixing positioning portions 77*b* extending upward from the spacer portions 77*a* and surrounding a grid unit 66. Each spacer portion 77*a* has a second fixing surface 82*b* which is parallel to the upper surface of the insulating substrate 21 and fixed to the lower surface of a first grid 67. Each fixing positioning portion 77*b* has a positioning surface 82*c* extending vertically with respect to the second fixing surface 82*b*. Each positioning surface 82*c* is fixed to a side surface of the grid unit 66 (side surfaces of the first grid 67, a spacer 69 between grids, and a second grid 68) by brazing. As a brazing material, titanium, niobium, tantalum, molybdenum, tungsten, or the like is used.

Similar to the structure of the 31st embodiment, the structure of this embodiment can attain the decreases in the profile and power consumption, and the fast operation characteristics of an electron gun assembly, and can also improve the precision in the distance between a cathode assembly 27 and the first grid 67. Furthermore, the fixing strength between the cathode assembly 27 and the first grid 67 in the electron gun assembly can be increased.

Note that the present invention is not limited to the embodiments described above, and can be variously modified. For example, each embodiment described above has exemplified the electron tube having a single electron gun. However, the present invention can be applied to an electron tube having a plurality of electron guns, like the one shown in FIGS. 65 and 66.

Figure 65:
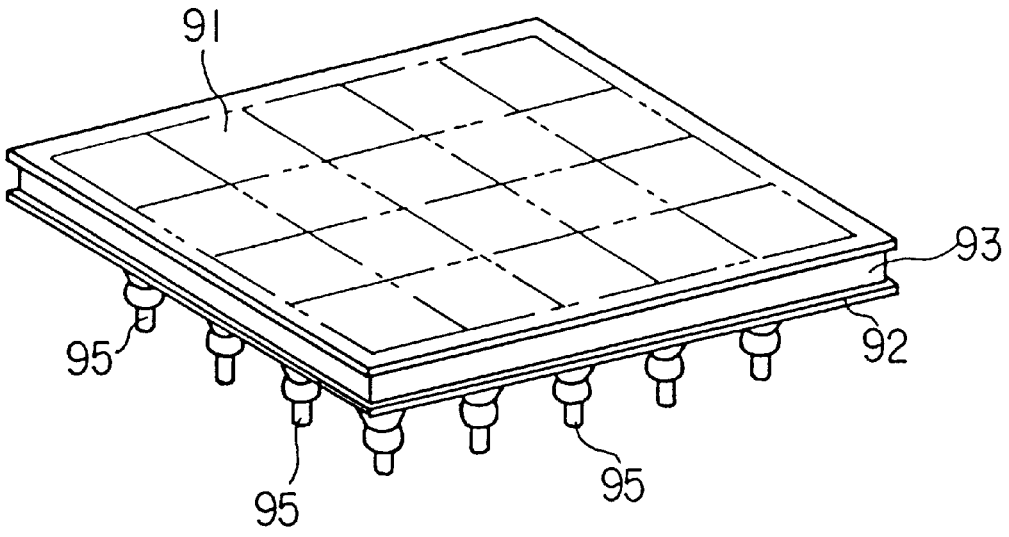
FIG. 65 is a perspective view showing another electron tube in which the cathode base members and electron gun assemblies of the present invention are mounted.
Figure 66:
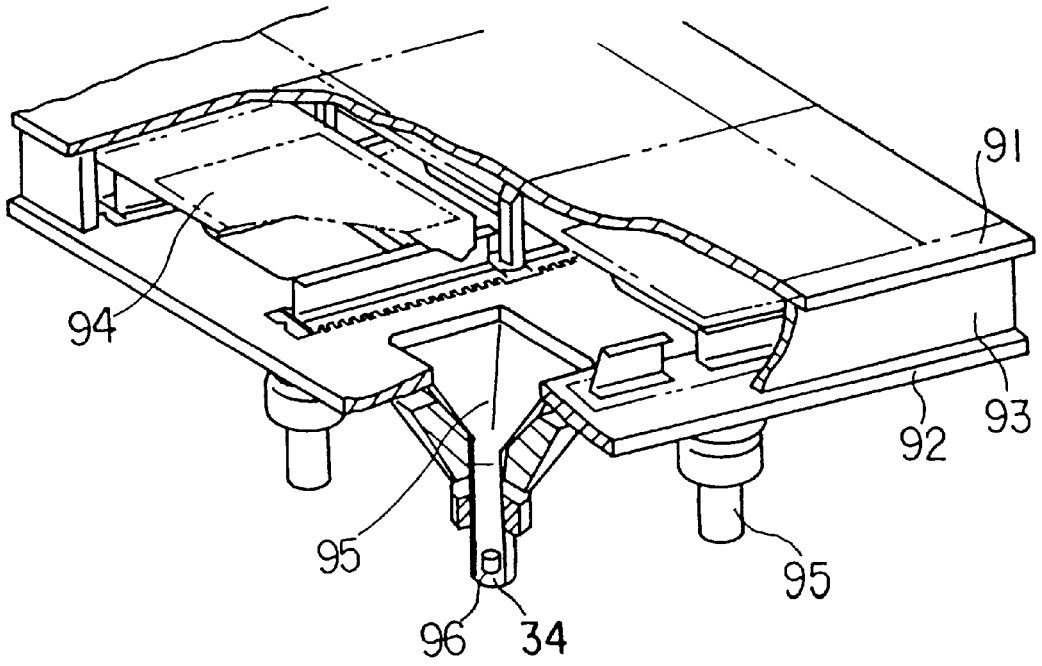
FIG. 66 is a partially cutaway perspective view of part of the electron tube.
Figure 67:
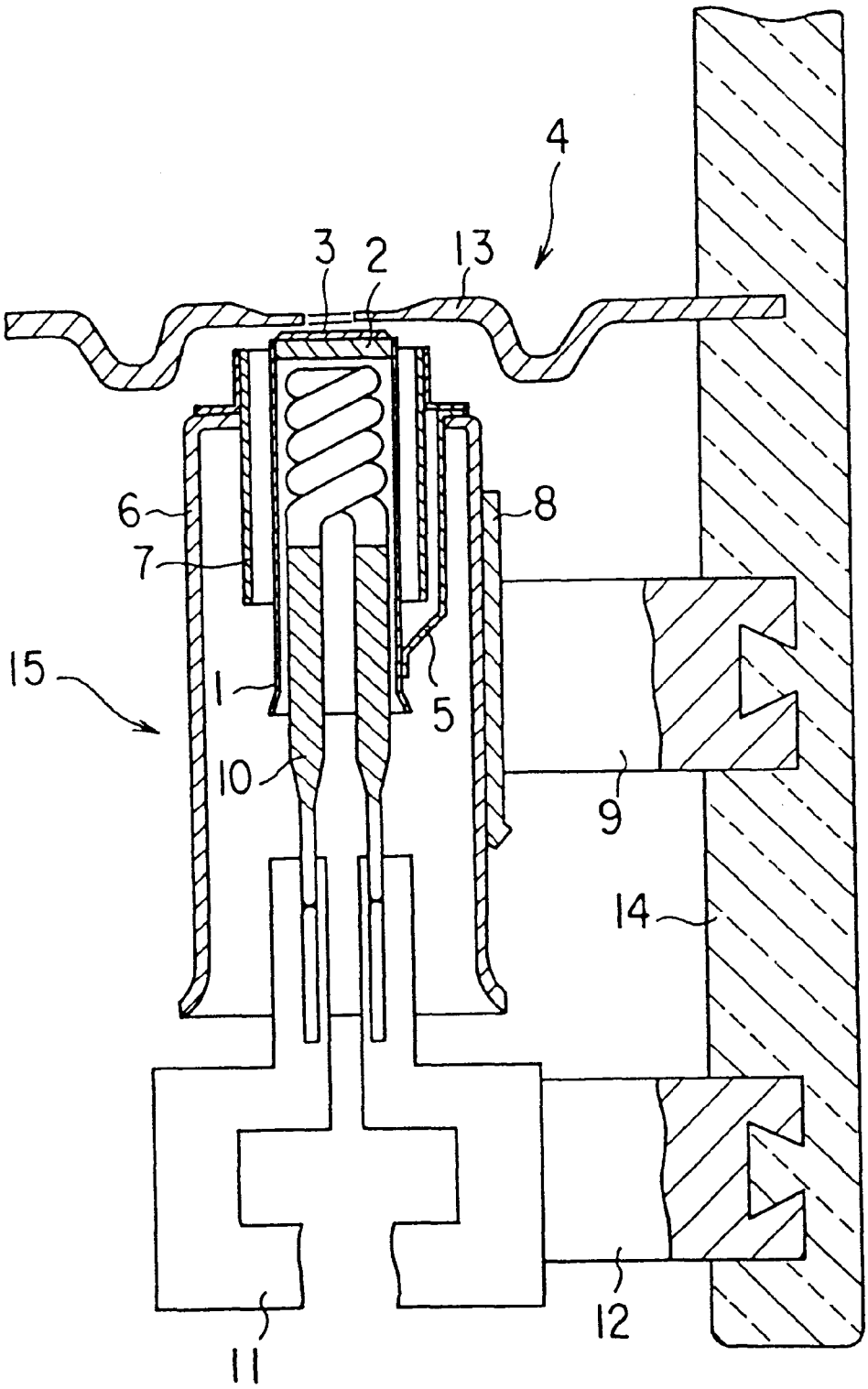
FIG. 67 is a sectional view of a conventional electron gun assembly.

The electron tube shown in FIGS. 65 and 66 comprises a flat faceplate 91 having a phosphor screen 97 formed on its inner surface, a flat rear plate 92 facing the faceplate 91, and a frame-like side wall 93 coupling the peripheral portions of the faceplate 91 and the rear plate 92 to each other. A shadow mask 94 is placed inside the faceplate 91 to oppose the phosphor screen 97. Many funnels 95 are arranged on the rear plate 92 in the form of a matrix. An electron gun 96 having a cathode assembly 27 and an electron gun assembly 34 is mounted in the neck of each funnel 95.

A plurality of areas on the phosphor screen 97 are independently scanned with electron beams emitted from a plurality of electron guns 96, and images drawn on the respective areas are connected to each other to display one large image.

By reducing the size and power consumption of each electron gun assembly 34 and attaining the fast operation characteristics in the electron tube having the above electron tube, the decreases in size and power consumption of the overall electron tube and the fast operation characteristics can be attained. That is, an electron tube suitable for a low-profile display unit can be obtained.

The cathode assembly, electron gun assembly, electron tube, and heater of the present invention are not limited to the structures in the embodiments described above and the materials used therefor, and various forms and materials can be used. These structures can be variously modified in accordance with the intended characteristics and application purposes.

As described in detail above, a cathode assembly according to the present invention comprises a thermally conductive insulating substrate having a pair of opposing surfaces, a cathode base member formed on one surface of the insulating substrate, and a heating member formed on the other surface of the insulating substrate to heat the cathode base member. In this structure, an electrode terminal is joined to the heating member through a conductive layer. Therefore, the length of a heater constituted by the insulating substrate and the heating member can be greatly decreased as compared with that in the prior art. In addition, the heater power can be reduced, and the fast operation characteristics can be improved. At the same time, the electrode terminal can be firmly joined to the heating member.

According to the present invention, since the cathode base member of the cathode assembly is fixed to the insulating substrate through a metal layer consisting of one material selected from the group consisting of titanium, molybdenum, tungsten, niobium, tantalum, and an alloy containing any one of them, the cathode base member can be reliably joined to the surface of the insulating substrate through the metallized layer.

According to the present invention, since a grid is formed in the cathode assembly having the above structure to oppose the cathode base member, an electron gun assembly that attains the decreases in size and power consumption, and the fast operation characteristics can be obtained.

A heater according to the present invention comprises an insulating substrate consisting of boron nitride, a heating member consisting of graphite and formed on the insulating substrate, and an electrode terminal joined to the heating member through a conductive layer. With this structure, the heating member and an electrode extraction member can be easily and firmly connected to each other, and hence a heater especially suitable for a cathode assembly can be obtained.

According to an electron gun assembly of the present invention, since a grid unit having a first grid is integrally joined to the insulating substrate of a cathode assembly, an electron gun assembly that attains a great reduction in total length, a decrease in heater power, fast operation characteristics, and high precision in the distance between the first grid and the cathode assembly can be obtained.

According to the present invention, the shielding plates arranged between the adjacent cathode base members of the cathode assembly can prevent a substance evaporated from the cathode base members from scattering so as to prevent the electrons emitted from the respective cathode base members from leaking and causing variations in the amounts of electrons emitted from the respective cathode base members, and can also prevent a situation in which the cathode base members are difficult to independently operate.

According to the present invention, the cathode assembly and the grid unit are joined to each other through the spacer, and the cathode assembly is positioned by using this spacer. With this structure, there are provided an electron gun assembly and an electron tube which attain decreases in profile and power consumption, fast operation characteristics, an improvement in precision in the distance between the cathode assembly and the grid, and an increase in fixing strength.

According to the present invention, cathode assemblies, each having the above structure, are arranged side by side to obtain an electron gun assembly that attains the decreases in size and power consumption, and the fast operation characteristics, thereby obtaining an electron tube suitable for a color cathode ray tube, and an electron tube suitable for a low-profile display unit.

According to the present invention, there is provided a cathode assembly manufacturing method capable of mass-producing cathode assemblies by forming an insulating substrate having a predetermined thickness using anisotropic pyrolytic boron nitride, forming an anisotropic pyrolytic graphite layer on one surface of the insulating substrate, forming a plurality of heating members, each having a predetermined pattern, by patterning the anisotropic pyrolytic graphite layer, joining a plurality of cathode base members on the other surface of the insulating substrate through a conductive layer, forming a plurality of cathode assemblies by dividing the insulating substrate on which the heating members and the cathode base members are formed, and fixing electrode terminals to the electrodes of the heating members of the cathode assemblies through a conductive layer.

What is claimed is:

1. A cathode assembly comprising:

a thermally conductive insulating substrate comprising an anisotropic pyrolytic boron nitride and having a pair of opposing surfaces;

a cathode base member formed on a first of said pair of opposing surfaces of the insulating substrate;

a heating member comprising an anisotropic pyrolytic graphite layer and provided on a second of said pair of opposing surfaces of the insulating substrate to heat the cathode base member; and an electrode terminal joined to the heating member through a conductive layer serving as a joining material, the conductive layer comprising a material selected from the group consisting of nickel, titanium, molybdenum, tungsten, niobium, tantalum and an alloy containing any one of titanium, molybdenum, tungsten, niobium or tantalum.

2. A cathode assembly according to claim 1, wherein the conductive layer comprises a reaction layer, wherein said reaction layer is formed by reacting the pyrolytic graphite layer with a metal powder wherein the metal powder applied to the pyrolytic graphite layer is heat-treated.

3. A cathode assembly according to claim 1, wherein the cathode base member is joined to the insulating substrate through a layer comprising a material selected from the group consisting of titanium, molybdenum, tungsten, niobium, tantalum and an alloy containing any one of titanium, molybdenum, tungsten, niobium, or tantalum.

4. A cathode assembly according to claim 1, wherein the cathode base member is joined to the insulating substrate through a graphite layer and an additional layer comprising a material selected from the group consisting of nickel, titanium, molybdenum, tungsten, niobium, tantalum, and an alloy containing any one of nickel, titanium, molybdenum, tungsten, niobium or tantalum.

5. A cathode assembly according to claim 1, wherein the cathode base member is directly joined to the first of said pair of opposing surfaces of the insulating substrate.

6. A cathode assembly according to claim 1, wherein an electrode terminal for the cathode base member is joined through a graphite layer to at least one portion of the cathode base member, and a layer comprising a material selected from the group consisting of nickel, titanium, molybdenum, tungsten, niobium, tantalum and an alloy containing any one of nickel, titanium, molybdenum, tungsten, niobium, or tantalum.

7. A cathode assembly according to claim 1, further comprising a n electric insulating layer formed on the second of said pair of opposing surfaces of the insulating substrate to be stacked on the heating member, and a reflecting layer formed on the electric insulating layer to reflect heat generated by the heating member toward the insulating substrate.

8. A cathode assembly according to claim 1, further comprising a reflecting member placed to oppose the second of said pair of opposing surfaces of the insulating substrate through a space to reflect heat generated by the heating member toward the insulating substrate.

9. A cathode assembly according to claim 1, wherein the insulating substrate comprises a first joining portion to which the electrode terminal is connected, and a second joining portion to which the cathode base member is connected, and a cross-sectional area of a portion between the first and second joining portions is set to be smaller than a cross-sectional area of each of the first and second joining portions.

10. A cathode assembly according to claim 9, wherein the insulating substrate comprises a notch which is formed between the first and second joining portions and said notch is open to the first of said pair of opposing surfaces of the insulating substrate.

11. A cathode assembly according to claim 9 or 10, wherein a plurality of cathode base members is provided on the insulating substrate, and the insulating substrate has a notch between two adjacent said cathode base members.

12. A cathode assembly according to claim 1, further comprising a belt-like tongue piece electrically connected to the cathode base member, the tongue piece being joined to the insulating substrate while being bent to clamp the insulating substrate and the heating member from outside.

13. A cathode assembly according to claim 1, wherein a belt-like tongue piece is brazed to the heating member and is joined to the insulating substrate while being bent to clamp the insulating substrate and the heating member from outside.

14. A cathode assembly according to claim 12 wherein the cathode base member is joined to the insulating substrate through a layer consisting mainly of a material selected from the group consisting of nickel, titanium, molybdenum, tungsten, niobium, tantalum and an alloy containing any one of nickel, titanium, molybdenum, tungsten, niobium or tantalum, and wherein the electrode terminal is integrally formed with the layer.

15. An assembly according to claim 12, wherein portions of the insulating substrate, to which the cathode base member and the electrode terminal are joined, protrude in a widthwise direction of the insulating substrate to become wider than a remaining portion.

16. A cathode assembly according to claim 4 wherein the cathode base member includes a base metal which is joined to the insulating substrate through a layer comprising a material selected from the group consisting of nickel, titanium, molybdenum, tungsten, niobium, tantalum and an alloy containing any one of nickel, titanium, molybdenum, tungsten, niobium, or tantalum, and wherein said layer has a flange.

17. A cathode assembly according to claim 1, wherein a plurality of cathode base members is arranged on the insulating substrate at predetermined intervals, and the heating member has heating portions opposing the respective cathode base members and non-heating portions formed between the adjacent heating portions, and each of the heating portions has a line width smaller than that of the non-heating portion.

18. A cathode assembly comprising:

a thermally conductive insulating substrate having a pair of opposing surfaces and comprising an anisotropic pyrolytic boron nitride;

a cathode base member formed on a first of said pair of opposing surfaces of the insulating substrate;

a heating member formed of anisotropic pyrolytic graphite layer and provided on a second of said pair of opposing surface of the insulating substrate to heat the cathode base member; and an electrode terminal joined to the heating member through a conductive layer comprising nickel wherein said nickel serves as a brazing material.

* * * * *